US011735409B2

(12) United States Patent
Papallo

(10) Patent No.: US 11,735,409 B2
(45) Date of Patent: Aug. 22, 2023

(54) LAMP COMPRISING MULTIPLE COMPONENT DESIGNS AND CONSTRUCTIONS

(71) Applicant: TESLO PTY LTD, Denistone (AU)

(72) Inventor: Anthony Papallo, Denistone East (AU)

(73) Assignee: TESLO PTY LTD, Denistone (AU)

( * ) Notice: Subject to any disclaimer, the term of this patent is extended or adjusted under 35 U.S.C. 154(b) by 0 days.

(21) Appl. No.: 17/873,542

(22) Filed: Jul. 26, 2022

(65) Prior Publication Data

US 2023/0030685 A1 Feb. 2, 2023

Related U.S. Application Data

(63) Continuation of application No. 17/073,546, filed on Oct. 19, 2020, now Pat. No. 11,450,522, which is a continuation of application No. 16/086,479, filed as application No. PCT/AU2017/050247 on Mar. 20, 2017, now Pat. No. 10,847,358.

(30) Foreign Application Priority Data

Mar. 21, 2016 (AU) ..... 2016901058

(51) Int. Cl.

| | |
|---|---|
| ***H01J 65/04*** | (2006.01) |
| ***H01J 61/10*** | (2006.01) |
| ***H01J 5/24*** | (2006.01) |
| ***H01J 9/26*** | (2006.01) |
| ***H01J 61/35*** | (2006.01) |
| ***H01J 61/32*** | (2006.01) |
| ***F21V 19/00*** | (2006.01) |
| ***H01F 38/10*** | (2006.01) |

(52) U.S. Cl.

CPC ..... *H01J 65/048* (2013.01); *F21V 19/009* (2013.01); *H01F 38/10* (2013.01); *H01J 5/24* (2013.01); *H01J 9/266* (2013.01); *H01J 61/10* (2013.01); *H01J 61/327* (2013.01); *H01J 61/35* (2013.01)

(58) Field of Classification Search

CPC .. H01J 65/048; H01J 5/24; H01J 9/266; H01J 61/10; H01J 61/327; H01J 61/35; H01F 38/10; F21V 19/009

See application file for complete search history.

(56) References Cited

U.S. PATENT DOCUMENTS

2003/0076020 A1* 4/2003 Anami ..... H01J 65/048 313/35

* cited by examiner

*Primary Examiner* — Jimmy T Vu
(74) *Attorney, Agent, or Firm* — WC&F IP

(57) ABSTRACT

The present invention provides a bulb (100, 110, 120, 130, 140, 140') an excitation chamber (200, 210, 220, 230, 230') a ferrite core (300, 310, 310'), a spool (400, 410); an assembly or subassembly of such components, and a lamp (100, 1100, 1200, 1300, 1400, 1500, 1600, 1600', 1600'', 1700, 1800) for producing electromagnetic radiation, such as in the light spectrum, UV or IR.

13 Claims, 34 Drawing Sheets

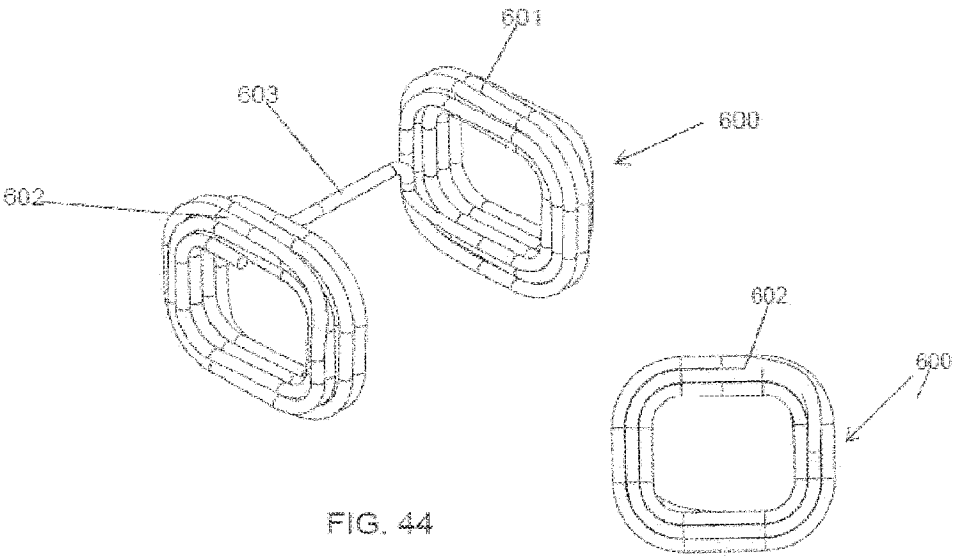
FIG. 44
FIG. 45
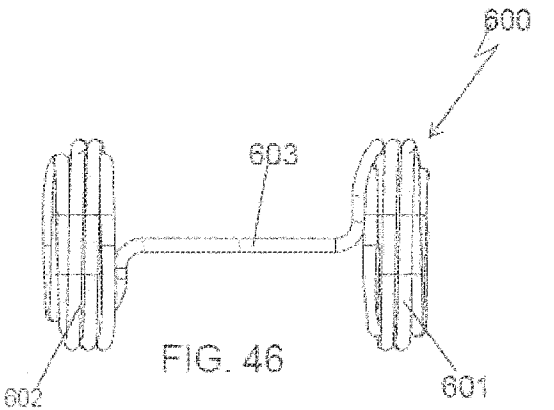
FIG. 46
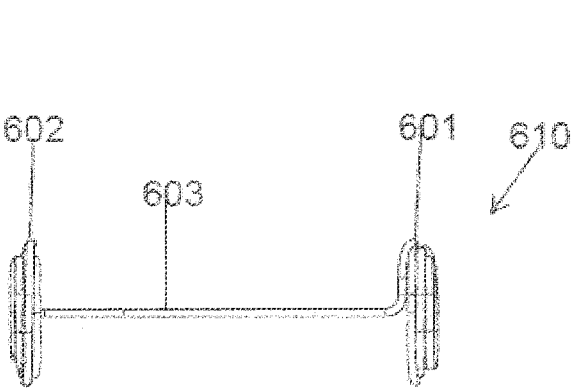
FIG. 49
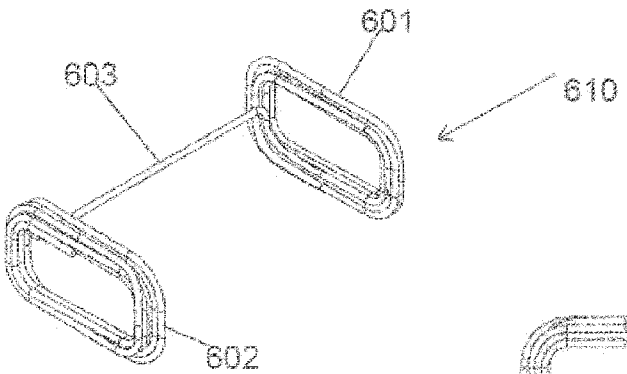
FIG. 47
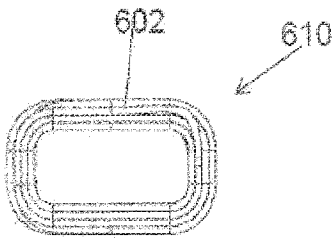
FIG. 48

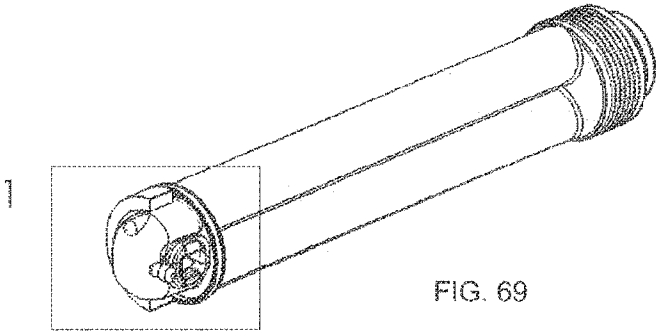
FIG. 69
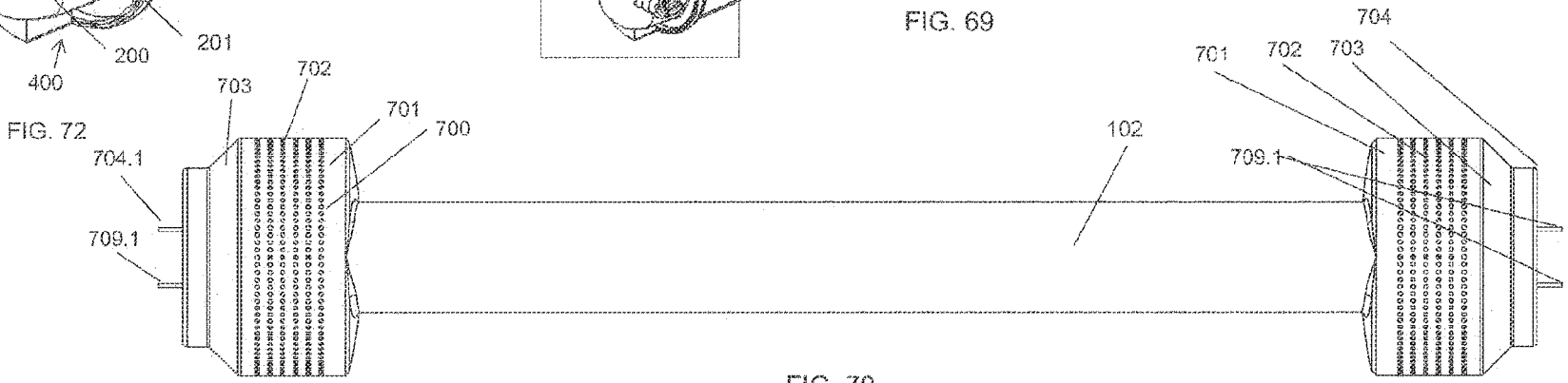
FIG. 70
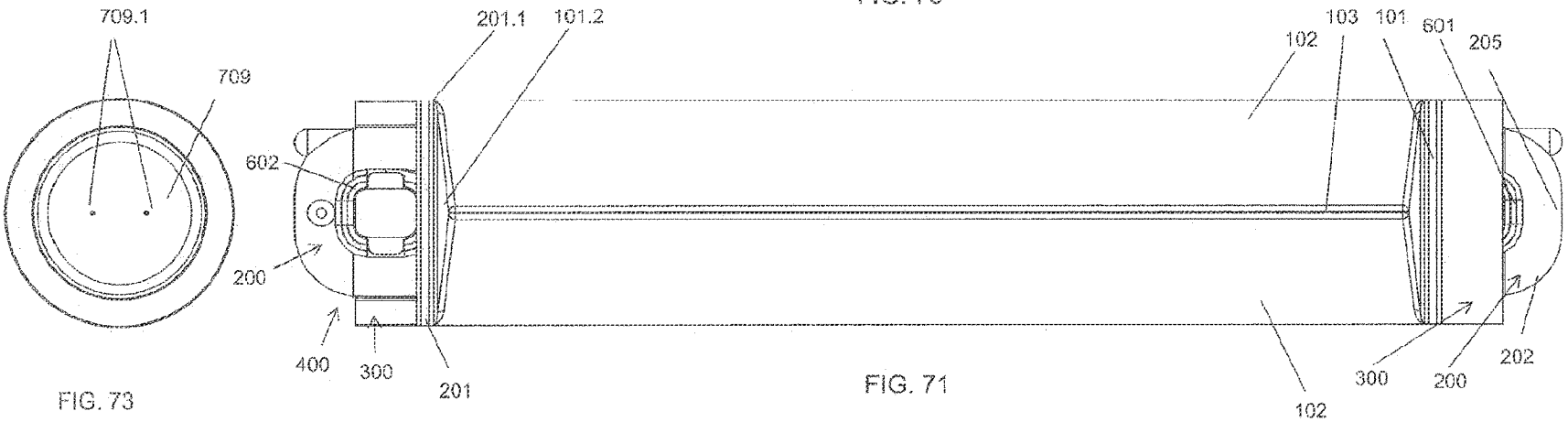
FIG. 71
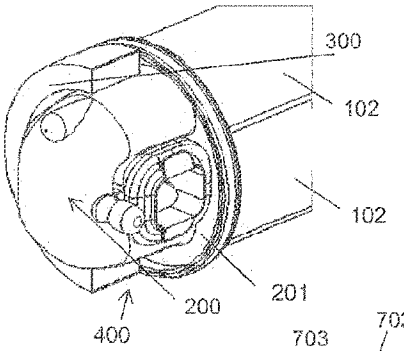
FIG. 72
FIG. 73

LAMP COMPRISING MULTIPLE COMPONENT DESIGNS AND CONSTRUCTIONS

CROSS-REFERENCE TO RELATED APPLICATIONS

This application is a continuation application of U.S. Ser. No. 17/073,546 filed Oct. 19, 2020, which itself was a continuation application of U.S. Ser. No. 16/086,479, filed on Sep. 19, 2019.

FIELD OF THE INVENTION

This invention relates to electrodeless radio frequency (RF) powered external closed core electromagnetic (inductively coupled) field excitation of a low pressure gas discharge light source or lamp and bulbs relating to same.

More specifically this invention relates to external electromagnetic closed core induction lamps that usually operate at the low radio frequency of 250 kHz to 300 kHz and bulbs relating to same. However, this invention can also operate at low frequencies of 30 kHz to 300 kHz, medium frequencies of 300 kHz to 3000 kHz or higher frequency. Such lamps can produce electromagnetic radiation in the ultra-violet, visible light, and infra-red bands

BACKGROUND OF THE INVENTION

An electrodeless gas discharge (plasma) lamp can be driven by three design methods:

a) an electric field generated by an induction coil powered by a medium or higher frequency power supply and mounted outside the bulb or arc tube;
b) an electric field generated by a medium or higher radio frequency power supply in combination with a resonant cavity; or
c) an electric field generated by a low to medium radio frequency power supply together with one or more electromagnetic cores encompassing the bulb or arc tube. This lamp is often called an induction-coupled electrodeless lamp or "Induction lamp".

Induction lamps are split into two categories:

1) category 1 being lamps that use an external closed electromagnetic core usually in the shape of a torus: and
2) category 2 being lamps that use an open electromagnetic core usually in the shape of a rod.

Open core induction lamps of category 2 operate at frequencies of 1 MHz and above for efficient operation and are not the subject of the invention and embodiments described herein.

Electrodeless closed external electromagnetic core induction lamps have been pioneered by many researchers as disclosed in U.S. Pat. No. 3,500,118 issued Mar. 10, 1970 to Anderson, and the operational principles outlined in Illuminating Engineering April 1969 pages 236-244 as follows:

"An electrodeless inductively coupled lamp includes a low pressure mercury/buffer gas in a discharge tube which forms a continuous closed electrical path. The path of the discharge tube goes through the centre of one or more toroidal ferrite cores such that the discharge tube becomes the secondary of a transformer. Power is coupled to the discharge by applying a sinusoidal voltage to a number of turns of wire wound around the toroidal core that encircles the discharge tube. The current through the primary winding creates a time varying magnetic flux which induces along the discharge tube a voltage that maintains the discharge. The inner surface of the discharge tube is coated with a phosphor which emits visible light when irradiated by photons emitted by the excited mercury gas atoms."

In an induction lamp a low to medium RF frequency magnetic field is typically used to create the electric field in the lamp eliminating the need for electrodes. This electric field then powers the gas discharge plasma.

There are presently few electrodeless closed core induction lamps on the market due to the following reasons, listed in the next paragraph. The reasons why electrodeless external electromagnetic closed core induction lamp technology has not achieved market success, is that the current technology does not appeal to users as a desirable light source to meet their needs.

Some of the limitations of existing electrodeless lamps include:

they are physically too large, making them cumbersome;
they lack versatility in regard to their respective light output;
they are Industrial in appearance and unappealing for commercial and residential use;
they are awkward and it is expensive to utilise the light generated due to their large bulb geometry;
they are relatively inefficient compared to competitive commercially available lamps; and
they are expensive to manufacture and use due to their relatively large and unwieldy bulb geometry.

Any reference herein to known prior art does not, unless the contrary indication appears, constitute an admission that such prior art is commonly known by those skilled in the art to which the invention relates, at the priority date of this application.

SUMMARY OF THE INVENTION

This present invention and embodiments are primarily directed to category 1 external electromagnetic closed core induction lamps that usually operate at the low to medium radio frequency.

Throughout the following description and claims, the word "lamp" while normally reserved for articles which produce visible light, will be taken to include such articles which produce any one of or two or more of ultra-violet, visible light, and infra-red bands of electromagnetic spectrum.

Throughout the following description and claims, the term "obround" is used to describe a general geometric shape. At the time of writing this specification and claims very few English dictionaries define this word. Notwithstanding, the word is used herein to describe a shape consisting of two semicircles connected by parallel lines tangent to their endpoints, which generally looks as follows:

Lamps of the type to which this invention relates utilise a closed electromagnetic core, coupled with a closed loop gas filled discharge tube that effectively becomes a single-turn secondary winding of a transformer enabling a plasma current to be generated. When the field winding of the electromagnet is energised the excitation energy of ionized atoms and molecules returning to their ground state are converted to electromagnetic radiation such as Ultra-Violet (UV), visible light, or Infra-Red.

It is an object of the present invention to present an improved design and a cost effective method of manufacture for an electrodeless closed core induction lamp that ameliorates, at least in part, the above described limitations of existing electrodeless lamps.

The present invention provides a bulb for a lamp, the bulb including at least one mounting interface having an outer periphery adapted to be connected to an excitation chamber, the mounting interface including at least two tubes extending away therefrom.

The two tubes extending from the mounting interface can be not connected along their length.

The two tubes extending from the mounting interface can be connected intermittently or continuously along their length.

There can be one mounting interface and the two tubes, at an end opposite to the mounting interface that are in gas communication with each other.

The tubes at an end opposite to the mounting interface can be joined by one of the following: a separate joining member to form at least a gas communicating passage between the tubes; by being integrally formed with the tubes to form at least a gas communicating passage between the tubes.

There can be two mounting interfaces and the tubes extend between the two mounting interfaces.

The two tubes can be of any shape including but not limited to, the following cross sectional shapes: round; square; elliptical; ellipsoid; tear drop shape; triangular; triangular where apexes are oppositely facing each other; tear drop shape where the apexes are oppositely facing each other.

The bulb can be manufactured from any suitable material which is transparent or translucent such as any of the following: glass; silica glass; quartz glass; a polymeric material; a composite material; a glass material coated with graphene; a material coated with graphene which enables a charged surface to be generated that will attenuate generated radio frequencies emitted from a lamp made from the bulb.

The present invention also provides a method of manufacturing a tubular bulb for a lamp, the bulb being as described above, wherein the method includes the steps of: (a) forming a single first tube; (b) heating, or maintaining the heat, of a central portion of the single tube to a working temperature; and (c) applying pressure to the central portion so as to form two second tubes from the single first tube.

There can be included a further step, whether performed sequentially or simultaneously, being of one of the following: maintaining at least one end of said single first tube as being an original single first tube shape; modifying at least one end of said single first tube to form a different shape or size to the original single first tube shape.

Step (c) can be performed by means of: a mould; any appropriate means.

Step (c) can create one of the following between the two second tubes: a continuous web between them; an intermittent web between them; a space or void between them.

The preferred embodiment maintains one end as being the original single first tube shape. However, it is recognised that it is possible to have a resultant shape or size differing from the single first tube.

At the end opposite to the one end, the two second tubes can be initially left as open tubes.

At the end opposite to the one end, the two second tubes can be initially left as open tubes but each has a joining flange formed therein.

At the end opposite to the one end, the two second tubes can be joined to each other so that gas communication between them can occur.

Two ends of the single first tube can be maintained in their original single first tube shape.

The end or ends of the single first tube can include a mounting flange to receive an excitation chamber.

The method can be performed sequentially to the single first tube production process in such a manner as to utilise retained tube heat during step (c). Alternatively, the method can be performed at a later time to the single first tube production process.

The method can include the following steps: maintaining an extra single first tube length portion for positioning, rotating or clamping in the subsequent steps; trimming the ends of the single first tube to arrive at a finished bulb configuration.

The method can include the following subsequent steps: cleaning; applying an internal coating or coatings; inserting sub-assemblies; assembling sub-assemblies; welding, affixing, fusing or bonding on of additional sections or components; fusing additional sections or components; applying an external coating or coatings; applying externally a graphene coating.

The method can be performed so that the two second tubes can be formed with any cross sectional shape such as: round; square; elliptical; ellipsoid; tear drop shape; triangular; triangular where apexes are oppositely facing each other; tear drop shape where the apexes are oppositely facing each other.

The tube can be one of the following: glass; silica glass; quartz glass; a polymeric material; a composite material, a translucent material, a transparent material.

The present invention also provides an excitation chamber including a portion which has a generally U-shaped tubular portion the ends of which have at least one joining flange to engage at least one bulb of a mating shape.

The joining flange can be adapted to form a gas tight seal with the at least one bulb.

The joining flange on each end of the U-shaped tubular portion can be generally cylindrical.

The joining flange on each end can be a flared end and can be adapted to receive a gas tight seal with respective tubular bulbs and allow for welding, affixing, fusing or bonding thereto.

The at least one joining flange can be formed as a component separate from said tubular portion and is sealed or joined thereto with a gas tight seal The excitation chamber can be for use with a bulb as described above, and wherein the joining flange can be a single mounting flange to engage the mounting interface of the tubular bulb, the single mounting flange including two apertures therein which correspond to the two tubes of the tubular bulb.

The two apertures and the two tubes can be alignable, whereby the U-shaped tubular portion is generally alignable with a plane of the two tubes.

The excitation chamber can include one or more than one of the following features: an exhaust tube; an amalgam housing; an external coating; a thermal barrier coating; a single piece moulding; a graphene coating on the outside of the chamber; a graphene coating on the outside of the chamber which enables an electric charged surface to be generated that will attenuate generated radio frequencies emitted from a lamp made from the tubular bulb; an amalgam housing that can be thermally isolated from the lamp bulb.

The present invention also provides a lamp having an excitation chamber as described above.

The present invention further provides an electromagnet ferrite core, the core having a shape which includes a generally toroidal or obround outer body with a centrally located diametrical portion, thereby forming one or more shaped apertures on each side of, or around, the centrally located diametrical portion.

The core, when an electromagnet is formed therefrom, can produce a toroidal or obround dipole magnetic field.

The core can be adapted to be separated through and re-joined through, a plane lateral to the direction of extension of the centrally located diametrical portion.

The core can be made of two or more pieces which have a general E shape or rounded E shape and result in a shape representative of two general E shape or rounded E shapes being assembled. It should be recognised that there are numerous variants to achieve a similar magnetic circuit for this ferrite core.

The present invention also provides and excitation chamber and ferrite core subassembly, the core being as described above, and the excitation chamber being as described above.

A lamp having an excitation chamber and ferrite core subassembly as described in the previous paragraph.

The present invention also provides a lamp having a ferrite core as described above.

The present invention further provides an electromagnet being formed from a ferrite core as described above.

A coil or coils of wire can be formed continuously or at either one side or at opposed locations on the centrally located diametrical portion.

The present invention also provides an electromagnet and excitation chamber subassembly, the electromagnet being described above, and the excitation chamber being as described above.

The present invention further provides a lamp having an electromagnet and excitation chamber subassembly as described in the previous paragraph.

The present invention also provides a lamp having an electromagnet as described above.

The present invention further provides a spool for an electromagnetic field coil for an electromagnet, the spool including a body having a generally tubular construction which forms a central aperture and may include at least one winding saddle being formed on the outside of the body so as to wind a wire to form a coil, the spool and the coil being able to be manipulated for assembly into a lamp.

The spool body can be of an elongate shape.

The spool body can be of a skeletal form.

A saddle can be formed at one end or at opposite ends of the spool body.

The spool body can be made from a polymeric material.

The spool can support a single coil at one end and is not compressible or collapsible or deformable at the other end.

The spool can include at least one end which is deformable allowing the spool and the coil to be manipulated for threading through a space between tubular components of a lamp.

Spool deforming can occur prior to, or during, insertion of a core for the electromagnet.

The spool can be deformable by means of being collapsible in response to a compressive pressure or rotatable with respect to an axis lateral to the direction of elongation of the body.

The spool can be deformable by means of collapsing around an axis parallel to a central longitudinal axis of the spool.

The spool can be deformable at opposed ends of the body.

The spool can have at least one end which is deformable in an elastic manner

The spool can have at least one end which is deformable in a plastic manner, which will resume after deformation its original shape or similar, by insertion of a core of an electromagnet.

The present invention provides an electromagnet, spool and excitation chamber subassembly, wherein the electromagnet is as described above, and the excitation chamber is as described above, and the spool is as described above.

A lamp having an electromagnet, spool and excitation chamber subassembly as described in the previous paragraph.

The present invention also provides a lamp having an electromagnet with a spool as described above.

The present invention further provides an excitation chamber cover for a lamp such as an electrodeless radio frequency powered external closed core electromagnetic inductively coupled low pressure gas discharge electrodeless lamp or electromagnetic radiation source, the excitation chamber cover including a wall segment manufactured from a metal, the wall segment being coated on an inner surface with graphene.

The present invention also provides an excitation chamber cover for a lamp such as an electrodeless radio frequency powered external closed core electromagnetic inductively coupled low pressure gas discharge light source, the excitation chamber cover including a wall segment manufactured from a metal, the wall segment including at least one aperture there through.

The present invention further provides an excitation chamber cover being constructed of a non-metallic material and or composite which is, coated inside and or outside with a graphene or similar conductive material so that it can perform physical and other functions of a metallic excitation chamber cover.

The excitation chamber cover and or the wall segment can be one of the following: continuous; partially circumferential; circumferential; box shape; square shape; rectangular shape.

An inner surface of the excitation chamber cover can be coated with graphene.

The aperture or apertures can be present in an array, or in discrete groupings; or randomly across the periphery of the excitation chamber cover or portion of the cover.

One end of the excitation chamber cover can include one or more flanges and openings therein.

The flange can support a polymeric disc, which can include a plug, lamp holder cap and or terminal formations for connection or connecting an assembled lamp to a supply of electricity.

The excitation chamber cover can be one or both of a faraday cage and a passive heat sink.

The excitation chamber cover can perform the following functions: provides cooling of a ferrite core of an electromagnet; provides thermal stability to an amalgam housing; provides thermal stability to at least one excitation chamber; provides physical protection to components and any integral electronics included within the excitation chamber cover; provides a means or mounting point for any integral electronic or other lamp controller; provides a means or mounting point for a lamp holder cap; provides a bonding point for the bulb.

The present invention also provides a lamp having an excitation chamber cover as described above. Such a lamp can also have one of the following: an excitation chamber and ferrite core subassembly as described above; an electromagnet and excitation chamber subassembly described above; an electromagnet, spool and excitation chamber subassembly described above.

The present invention further provides an electrodeless radio frequency powered external closed core electromagnetic inductively coupled low pressure gas discharge electrodeless lamp or electromagnetic radiation source, including a tubular bulb as described above.

The present invention also provides an electrodeless radio frequency powered external closed core electromagnetic inductively coupled low pressure gas discharge electrodeless lamp or electromagnetic radiation source, including a tubular bulb as manufactured by the method described above.

The electrodeless lamp or electromagnetic radiation source can include an excitation chamber as described above.

The electrodeless lamp or electromagnetic radiation source can include an electromagnetic ferrite core as described above.

The electrodeless lamp or electromagnetic radiation source can include an electromagnet as described above.

The electrodeless lamp or electromagnetic radiation source can include a spool as described above.

The electrodeless lamp or electromagnetic radiation source can include an excitation chamber cover as described above.

The electrodeless lamp or electromagnetic radiation source can include one or more of the following: electronic power controller; electrical power controller; other controllers or power controllers; each of the foregoing being remote or integral with the source.

The electrodeless lamp or electromagnetic radiation source assembly can have one of, or a combination of two or more of the following: the excitation chamber is coated with graphene; the bulb is coated with graphene; the excitation chamber cover is coated with graphene; the excitation chamber is coated with graphene to form a faraday cage; the bulb is coated with graphene to form a faraday cage; the excitation chamber cover is coated with graphene to form a faraday cage.

The electrodeless lamp or electromagnetic radiation source can be such that the electromagnetic radiation generated is in one, or more than one, of the following spectrums: ultraviolet; visible light; infra-red.

The present invention also provides a method of manufacturing an excitation chamber for an electrodeless lamp or electromagnetic radiation source, said chamber including a portion which has a generally U-shaped tubular portion the ends of which have at least one joining flange to engage at least one bulb of a mating shape, said method including the steps of forming said generally U-shaped tubular portion, and forming a joining flange separate from said tubular portion, and assembling said joining flange and said tubular portion and joining and or sealing them together with a gas tight seal.

BRIEF DESCRIPTION OF THE DRAWINGS

A detailed description of a preferred embodiment will follow, by way of example only, with reference to the accompanying figures of the drawings, in which:

FIG. 27D2 illustrates a partial cross section of the flange of FIG. 27B;

FIG. 44 illustrates a perspective view of a wound coil produced on a winding spool for an electromagnet such as that of FIGS. 37 to 40;

FIG. 45 illustrates an end view of the coil of FIG. 44;

FIG. 46 illustrates a side view of the coil of FIG. 44;

FIG. 47 illustrates a perspective view of a wound coil produced on a winding spool for an electromagnet such as that of FIGS. 41 to 43;

FIG. 48 illustrates an end view of the coil of FIG. 47;

FIG. 49 illustrates a side view of the coil of FIG. 47;

FIG. 69 illustrates a perspective view of a lamp assembly embodying the components of previous figures having a tubular bulb body of FIGS. 1 to 3, and an excitation chamber/spool/core/coil/cover sub-assembly at both ends with one cover, and one ferrite core half, removed for illustration purposes;

FIG. 70 illustrates a plan view of the lamp assembly of FIG. 69 with both excitation chamber covers present;

FIG. 71 illustrates a side view of the lamp assembly of FIG. 69 with both excitation chamber covers, and one ferrite core half, removed for illustration purposes;

FIG. 72 illustrates a detail perspective view of the end of lamp assembly of FIG. 69 with excitation chamber cover, and one ferrite core half, removed for illustration purposes;

FIG. 73 illustrates an end view of the lamp assembly of FIG. 69;

FIG. 101A illustrates an exploded perspective view of a lamp sub-assembly having a single generally toroidal or round tubular bulb and excitation chamber as shown in FIGS. 27E to 27K illustrating the excitation chamber and intermediate flange components;

FIG. 101B illustrates an exploded perspective view of a lamp assembly having a single generally toroidal or round tubular bulb and excitation chamber as shown in FIGS. 27E to 27K illustrating the excitation chamber and intermediate flange components and excitation chamber cover and an inboard lamp holder;

FIG. 101C illustrates a perspective view of an assembled lamp having a single generally square tubular bulb and excitation chamber as shown in FIGS. 27E to 27K with an intermediate flange like in FIG. 101A and FIG. 101B, with excitation chamber cover and an inboard lamp holder also assembled.

FIG. 102 illustrates a flow chart of an exemplary process for the manufacture of the lamps of FIGS. 77 to 101;

FIG. 103 illustrates a close up view of the optional access hole 104.1 for cabling to enable power distribution to the second end of a double ended lamp;

FIG. 104 illustrates a perspective view of another lamp assembly embodying the components of previous figures having two single tubular bulb bodies, and excitation chambers as illustrated in FIGS. 19 to 21 in an excitation chamber/spool/core/coil/excitation chamber covers sub-assembly at both ends with one excitation chamber cover, and one ferrite core half, removed for illustration purposes;

FIG. 105 illustrates a plan view of the lamp assembly of FIG. 104 with both excitation chamber covers present;

FIG. 106 illustrates a side view of the lamp assembly of FIG. 104 with both excitation chamber covers, and one ferrite core half, removed for illustration purposes;

FIG. 107 illustrates a detail perspective view of an excitation chamber cover end of lamp assembly of FIG. 104 with excitation chamber cover, and one ferrite core half, removed for illustration purposes;

FIG. 108 illustrates a excitation chamber cover end view of the lamp assembly of FIG. 104;

Figure 20:
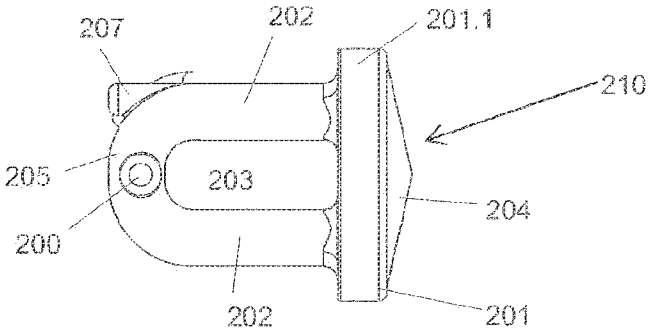
FIG. 20 illustrates side view of the chamber of FIG. 19.
Figure 21:
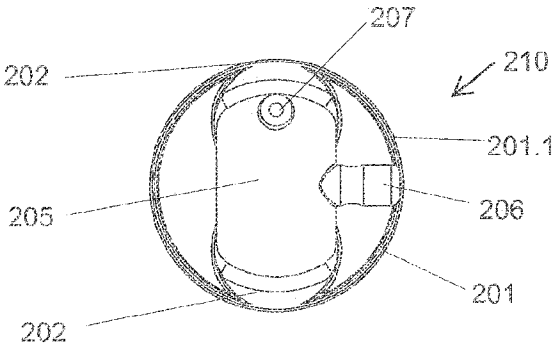
FIG. 21 illustrates an end view of the chamber of FIG. 19.
Figure 19:
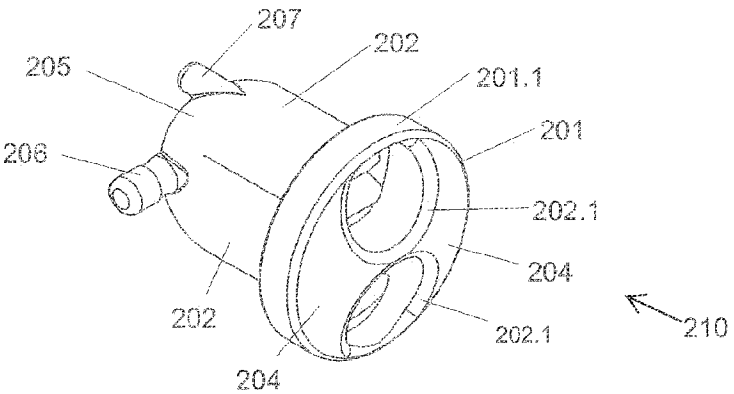
FIG. 19 illustrates a perspective view of another excitation chamber.
Figure 114:
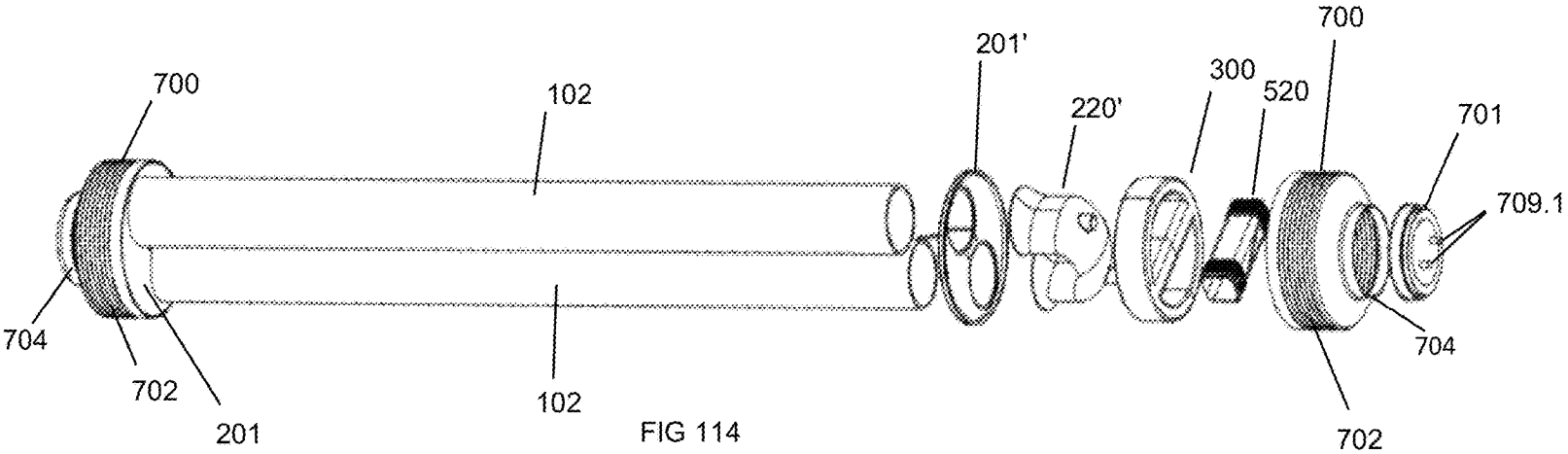
Figure 104:
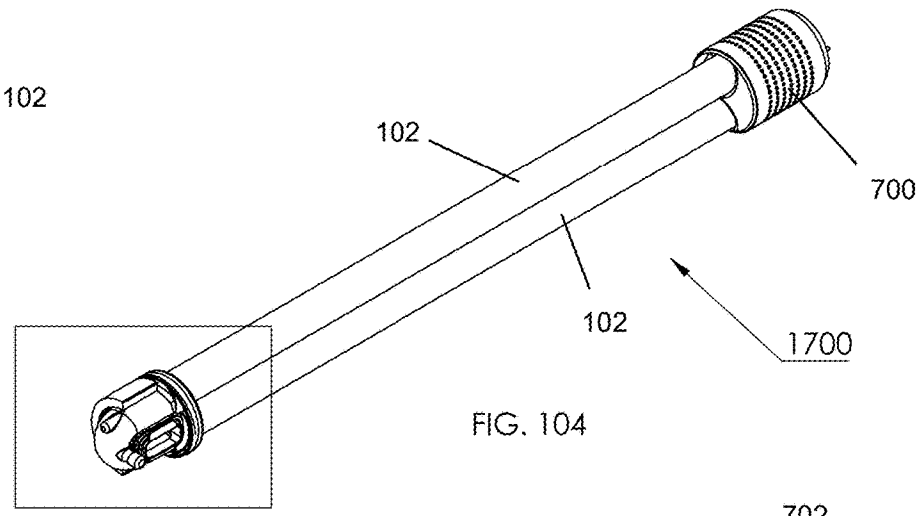
Figure 105:
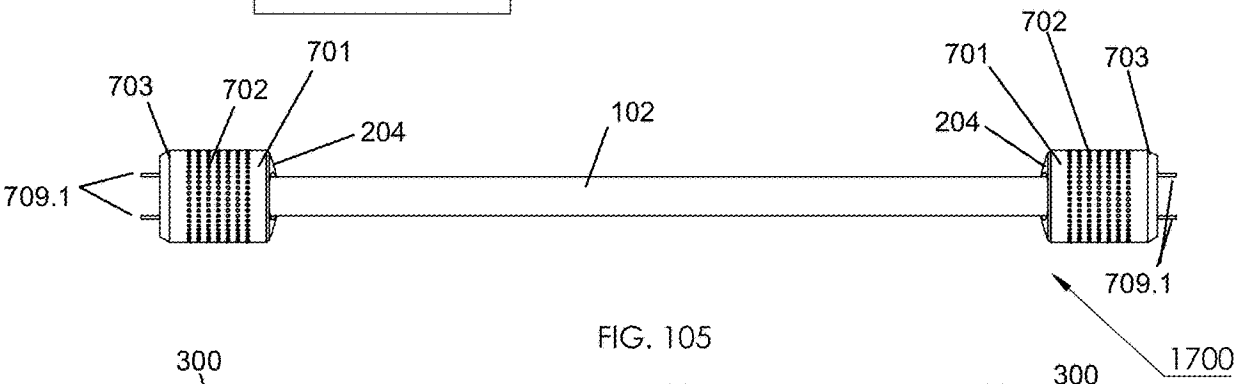
Figure 106:
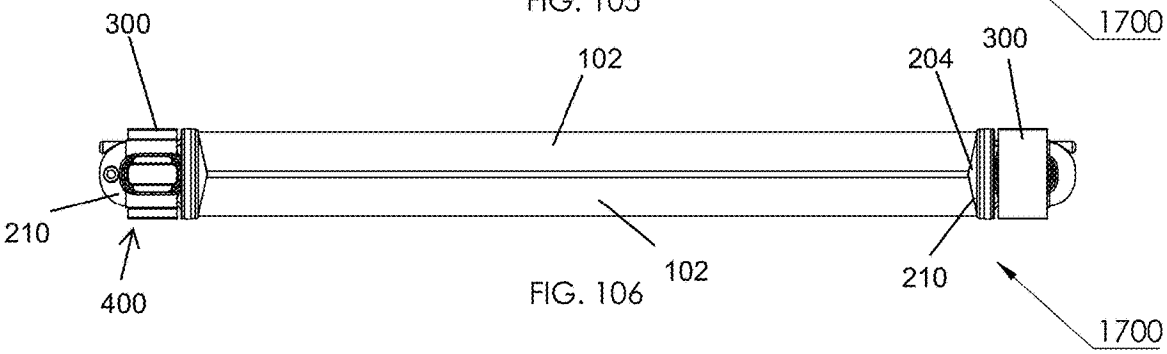
Figure 107:
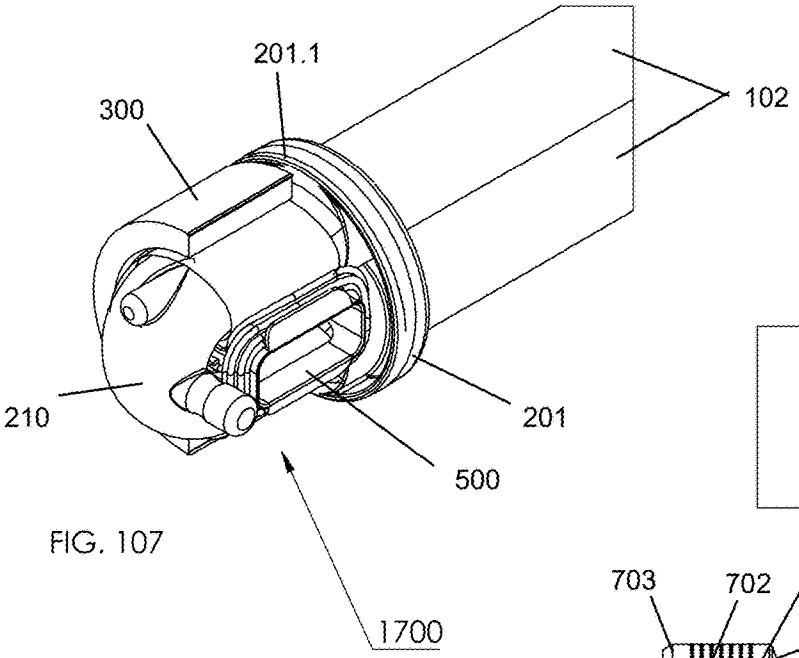
Figure 108:
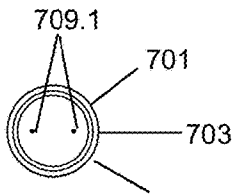
Figure 112:
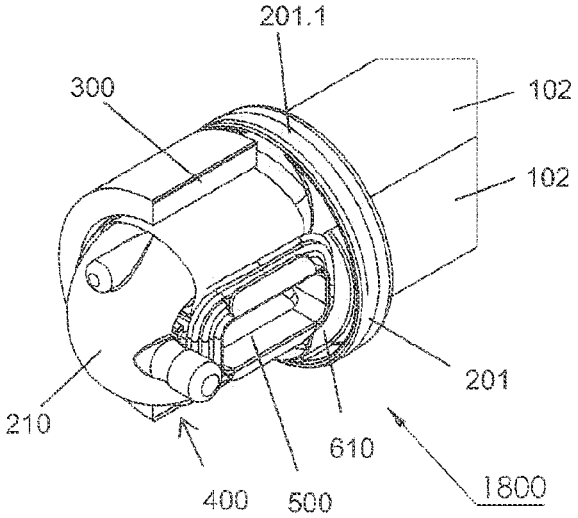
Figure 109:
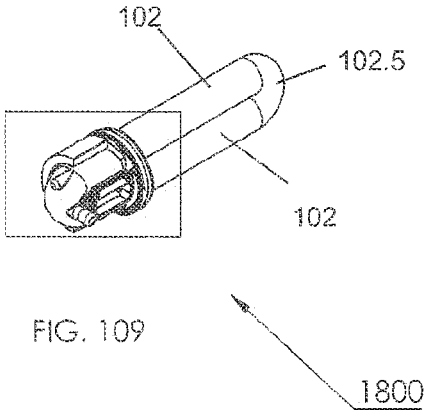
Figure 110:
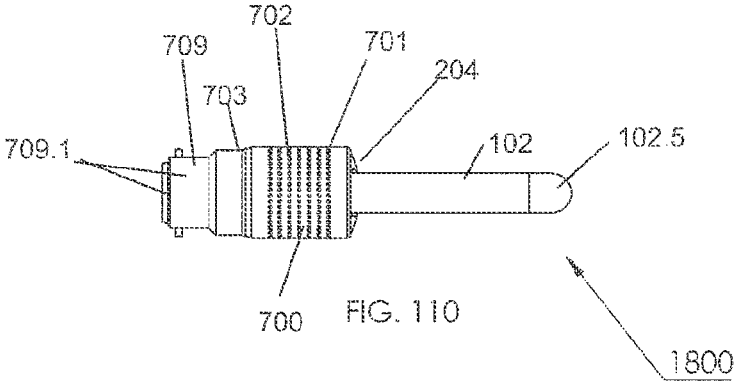
Figure 113:
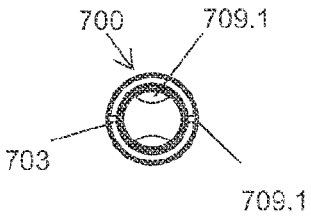
Figure 111:
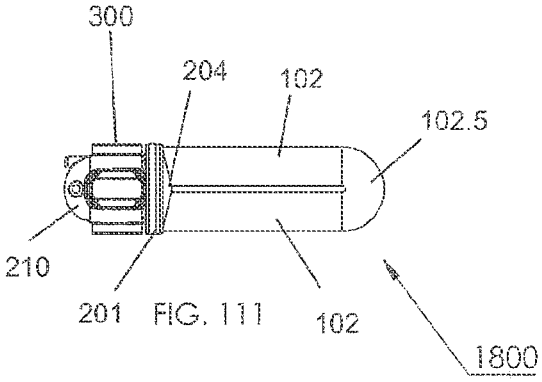

FIG. 109 illustrates a perspective view of another lamp assembly embodying the components of previous figures having a U-shaped tubular bulb body (or two straight tubes with a 180 degree joining piece), and an excitation chamber as illustrated in FIGS. 19 to 21 in an excitation chamber/spool/core/coil/cover sub-assembly one end with its excitation chamber cover, and one ferrite core half, removed for illustration purposes;

FIG. 110 illustrates a plan view of the lamp assembly of FIG. 109 with the excitation chamber cover present and showing a bayonet type fitting lamp holder;

FIG. 111 illustrates a side view of the lamp assembly of FIG. 109 with the one excitation chamber cover, and one ferrite core half, removed for illustration purposes;

FIG. 112 illustrates a detail perspective view of the excitation chamber cover end of lamp assembly of FIG. 109 with excitation chamber cover, and one ferrite core half, removed for illustration purposes;

FIG. 113 illustrates a excitation chamber cover end view of the lamp assembly of FIG. 104; and FIG. 114 illustrates a perspective view of another lamp assembly embodying the components of previous figures having two straight tubes, and an excitation chamber/spool/core/coil/cover sub-assembly at each end as illustrated in FIGS. 27A to 27D, with one excitation chamber/spool/core/coil/cover sub-assembly being shown in an exploded view for illustration purposes.

DETAILED DESCRIPTION OF THE EMBODIMENT OR EMBODIMENTS

Bulb Features and Construction

As is depicted in FIGS. 1 to 14, there are illustrated several bulb constructions, which have different features which will be described in more detail below.

Figure 2:
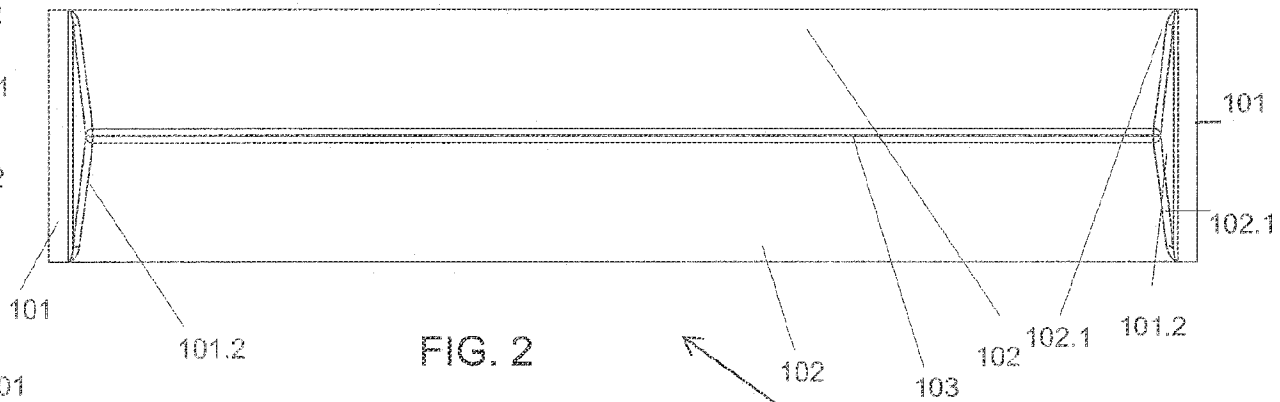
FIG. 2 illustrates a side view of the tubular bulb of FIG. 1.
Figure 3:
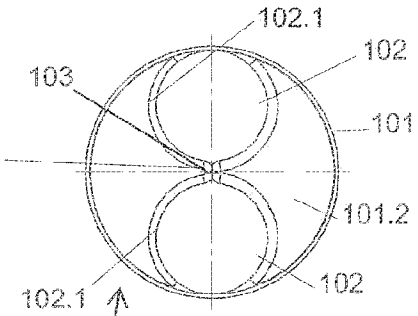
FIG. 3 illustrates an end view of the tubular bulb of FIG. 1.
Figure 1:
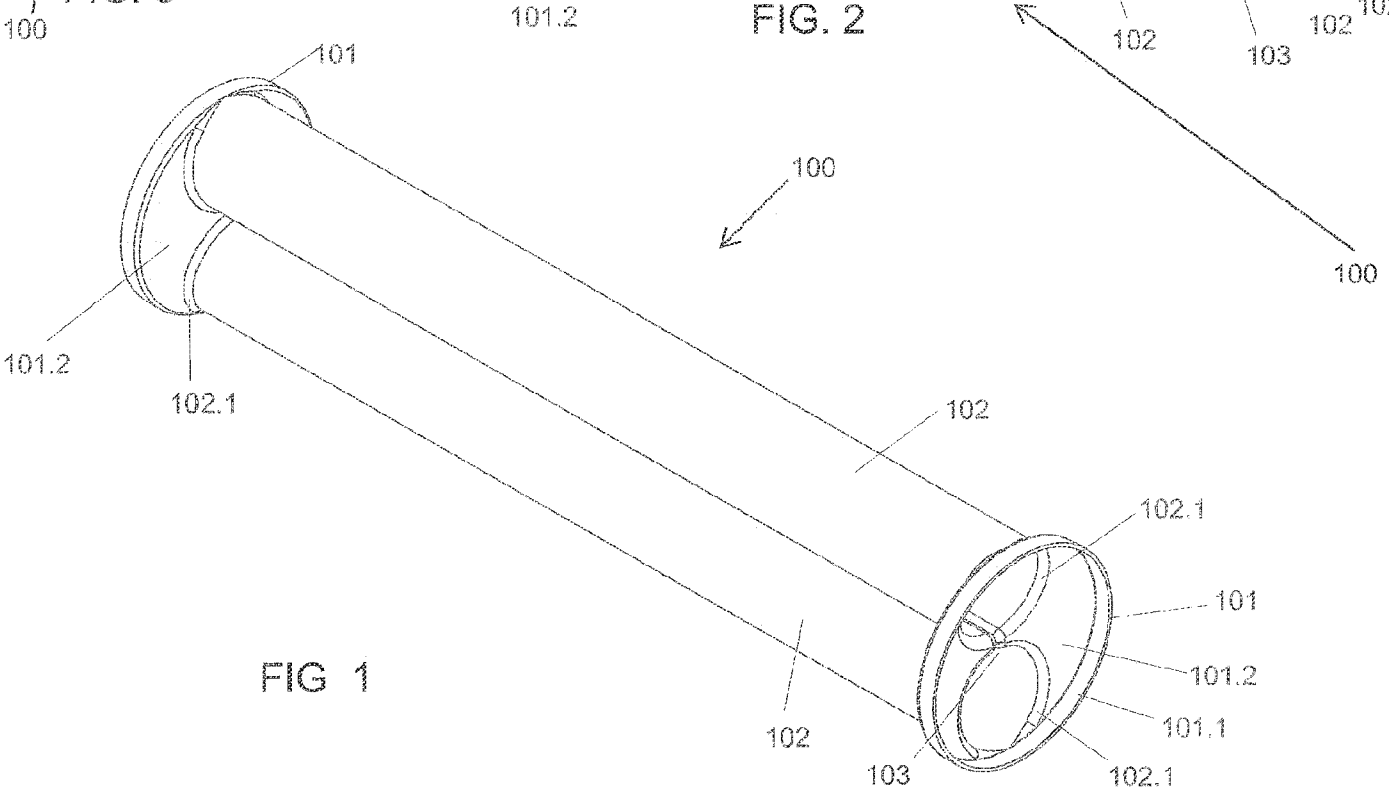
FIG. 1 illustrates a perspective view of a tubular bulb which has a bifurcated body and two mounting interface flanges.

Illustrated in FIGS. 1 to 3 is a tubular bulb 100 for a lamp (such as lamp 1000 of FIG. 69), the tubular bulb 100 includes at least one mounting interface 101, in this case there are two mounting interfaces 101, being one at each end. The mounting interfaces 101 having an inner periphery 101.1 adapted to be connected to an excitation chamber (see below), with the mounting interface 101 including at least two tubes 102 extending away therefrom. The mounting interface 101 has its inner periphery 101.1 being illustrated as, and is preferably, a circular or circumferential rim. However, it will be understood that the mounting interface 101 can have an inner periphery of any appropriate shape or configuration. The mounting interface 101 can be cavity or recess formation into which is received a mating periphery or formation on the excitation chamber (see below). Alternatively, the mounting interface 101 can be a periphery or formation, which is received into a cavity or recess formation on the excitation chamber.

The inner periphery 101.1 transitions from its circular outer shape by a transition surface 101.2 into the start of two tubes 102. At the location of intersection of the two shapes from the transition surface 101.2 to the tubes 102, is a further transition surface 102.1, which because of its smooth blending of surfaces and tangential nature, and the transparent nature of the tubular bulb 100, may not been seen in the final tubular bulb 100.

In the embodiment of FIGS. 1 to 3, the two tubes 102 are formed from a single piece of cylindrical tubing, as will be described in more detail later, whereby the sides of the original tubing are pushed or moulded or formed in a direction towards the central axis of the tube, so that the inner surfaces of the original tube meet and close at the central web 103 in FIG. 3, which web 103 from FIG. 2 extends between the transition surface 101.2 on one end to the other transition surface 101.2 on the other end of the tubular bulb 100. The web 103 extends between the mounting interfaces 101 in a continuous manner, but it will be understood that it could also do so in an intermittent manner or only partially along the whole length of the tubular bulb 100.

The two tubes 102 are illustrated in FIGS. 1 to 3 as being of a generally cylindrical cross section, however, any appropriate cross section can be utilised depending upon the light effect to be produced or the purpose to which the light will be utilised. Such shapes can include square, elliptical, ellipsoid, tear drop shape (which will be described in more detail below), triangular; triangular where apexes are oppositely facing each other; tear drop shape where the apexes are oppositely facing each other, or a multitude of other shapes. While it is expected that for most applications that the two adjacent tubes 102 are, or will be, of the same cross section, this does not need to be the case, and different or combinations of cross sections could be utilised and made.

The tubular bulb 100 can be manufactured from a material which is transparent or translucent, such as: glass; silica glass; quartz glass; a polymeric material; a composite material. If required or desired the outside of the tubular bulb 100 can be coated with graphene. The graphene coating when charged, will enable a surface to be generated that will assist to attenuate generated radio frequencies emitted from a lamp, such as lamp 1000 of FIG. 69, made from said tubular bulb 100.

Figure 5:
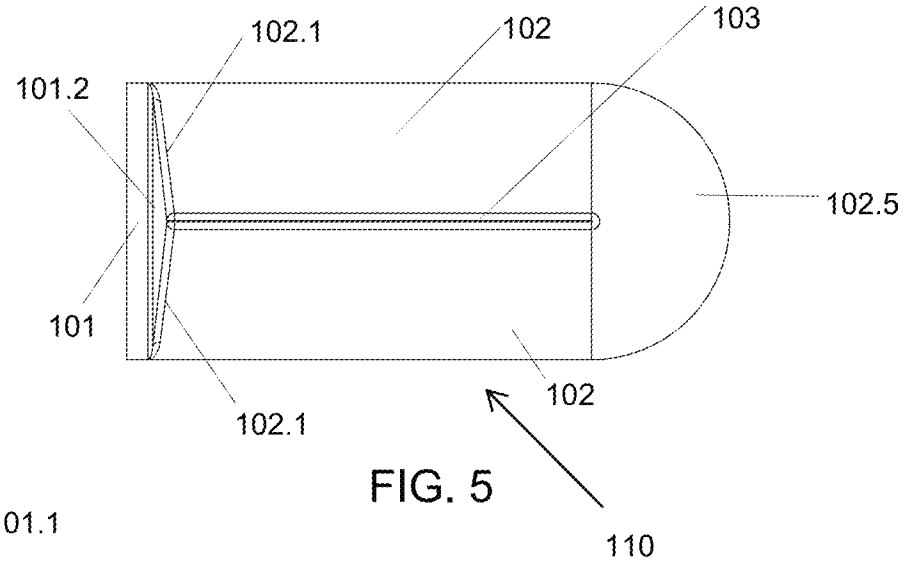
FIG. 5 illustrates a side view of the tubular bulb of FIG. 4.
Figure 6:
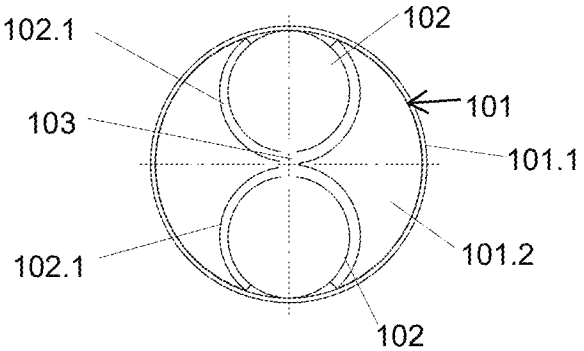
FIG. 6 illustrates an end view of the tubular bulb of FIG. 4.
Figure 4:
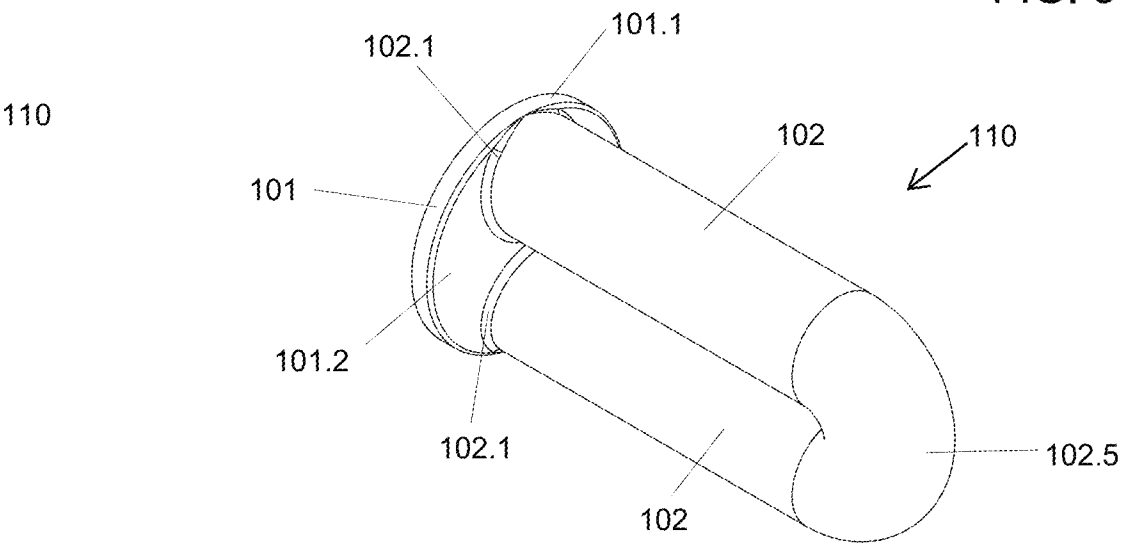
FIG. 4 illustrates a perspective view of another tubular bulb which has a bifurcated body and a single mounting interface flange.

Illustrated in FIGS. 4 to 6 is another embodiment of a tubular bulb 110, which is similar to that of tubular bulb 100 of FIGS. 1 to 3, and like parts are like numbered. The tubular bulb 110 differs from that of bulb 100, by there being only one mounting interface 101 at one end. The other end has a generally "U-shaped" or 180 degree union or joining piece 102.5, generally made of the same material as the tubes 102, which allows the passages through the respective tubes 102 to be in gas communication with each other. This will allow ionised gases to move freely from one tube 102 to the other when energised or not, as the case may be.

The union or joining piece 102.5 can be made separately to the tubes 102 and joined thereto in a subsequent production step, or if desired, the joining piece or union 102.5 can be made integrally with the tubes 102, when they are being formed.

The tubular bulbs 100 and 110 as described above in relation to FIGS. 1 to 6, have the web 103 extending along the line of the connection of the tubes 102. However, if required the forming process could completely separate the tubes 102, such that the web 103 will cease to exist, and the tubes 102 will be near to each other, but separate.

Figure 8:
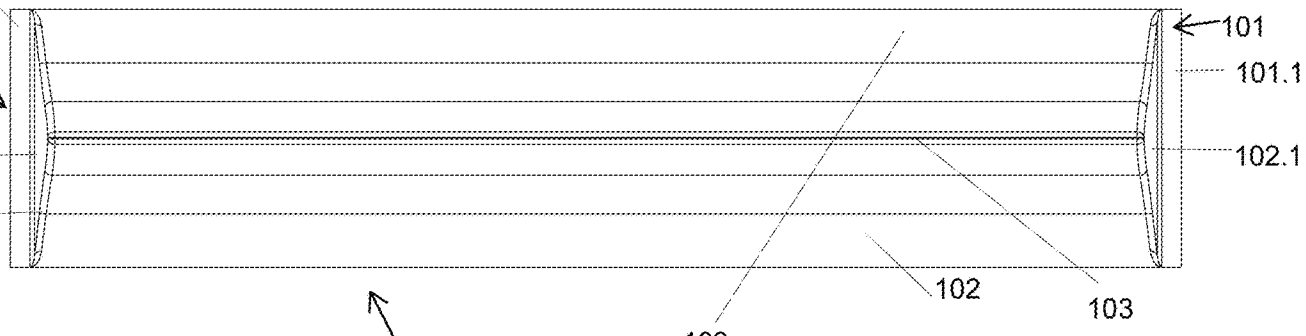
FIG. 8 illustrates a side view of the tubular bulb of FIG. 7.
Figure 9:
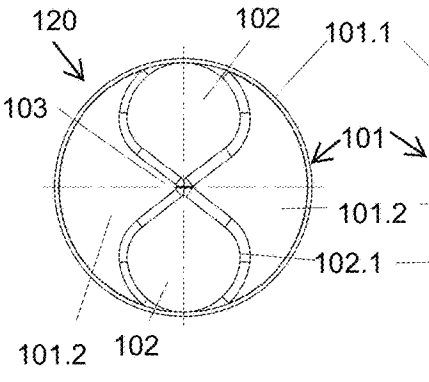
FIG. 9 illustrates an end view of the tubular bulb of FIG. 7.
Figure 7:
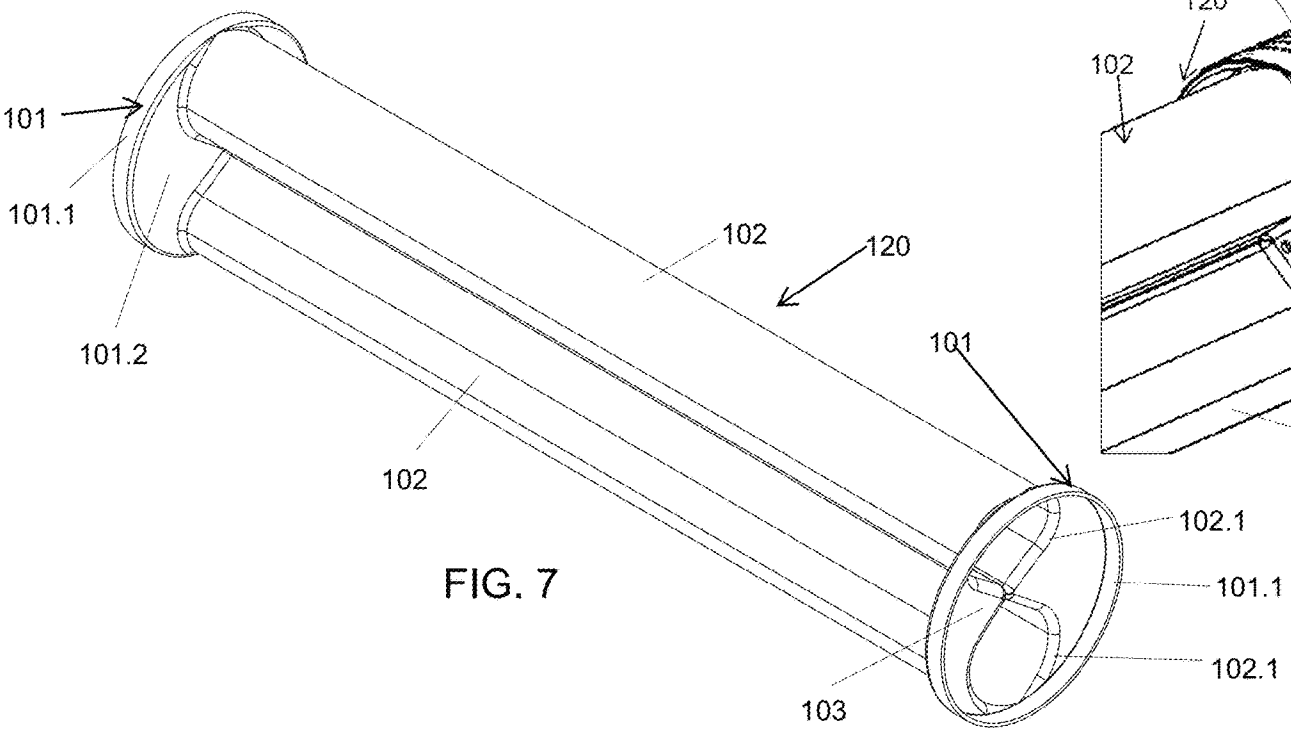
FIG. 7 illustrates a perspective view of a further tubular bulb which has a bifurcated body with tubes of tear drop cross section and two mounting flanges.

Illustrated in FIGS. 7 to 9 is another embodiment of a tubular bulb 120, which is similar to the previously described bulbs 100 and 110, and like parts have been like numbered. The tubular bulb 120 differs from the bulb 100 only in the cross section of the tubes 102. The tubes 102 are of tear-drop or piriform shape with an apex of one tube 102 meeting the apex of the other tube 102 to form the web 103 (this can also be referred to as a sextic form). The opposed tear drop or piriform shape has the advantage that light radiating from the opposed surfaces on either side of an apex on one tube 102, is in the main not blocked or internally reflected by the opposed tube 102. The purpose of this opposed piriform bulb geometry is to minimise internal reflections and self-shading within the ultimate lamp phosphor coated bulb and this will assist to achieve an optimal light generation from the light source. The opposed piriform shape can be achieved by a sextic curve or similar shaped mould to achieve a double but opposed piriform shape as illustrated in FIGS. 7 to 9.

Figure 11:
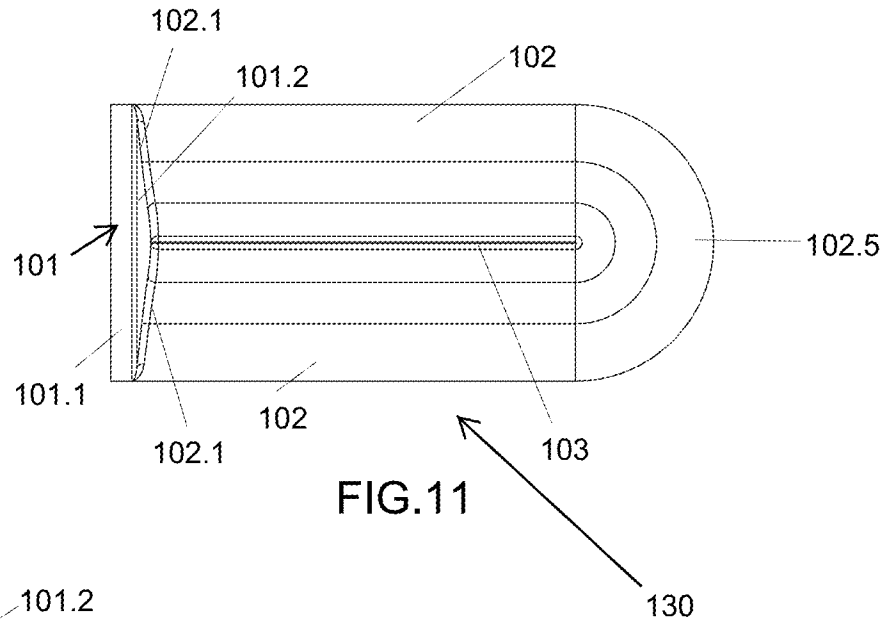
FIG. 11 illustrates a side view of the tubular bulb of FIG. 10.
Figure 12:
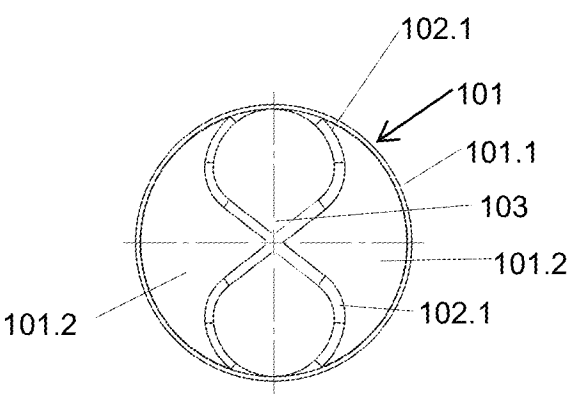
FIG. 12 illustrates an end view of the tubular bulb of FIG. 10.
Figure 10:
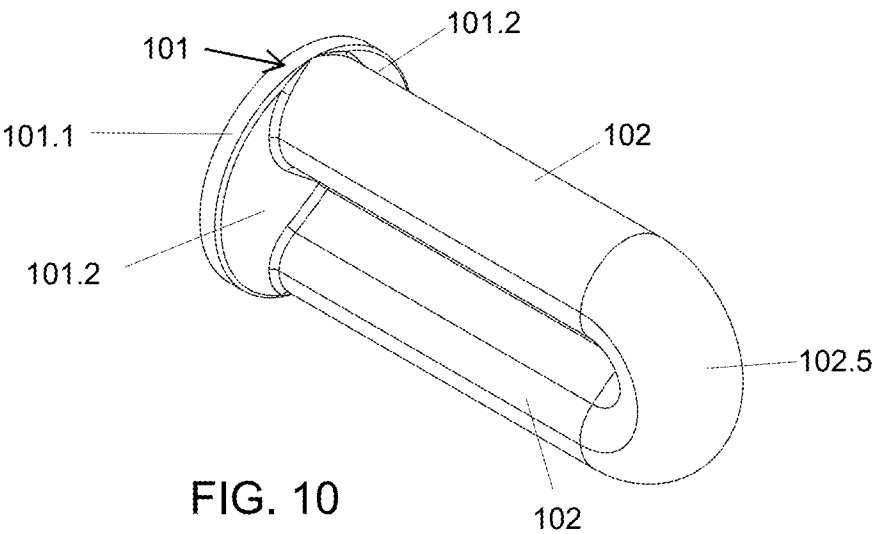
FIG. 10 illustrates a perspective view of a tubular bulb which has a bifurcated body with tubes of tear drop cross section and a single mounting flange.

Illustrated in FIGS. 10 to 12, is an embodiment of tubular bulb 130, which is similar to the tubular bulb 110 of FIGS. 4 to 6 in that it has a single mounting interface 101, but is similar to the tubular bulb 120 of FIGS. 7 to 9 in that the two tubes 102 each have opposed tear-drop or piriform shapes. Like parts have been like numbered. The "U-shaped" union or joining piece 102.5 also has a piriform shape revolved through 180 degrees, to provide a fluid communicable passage between the tubes 102.

Figure 13A:
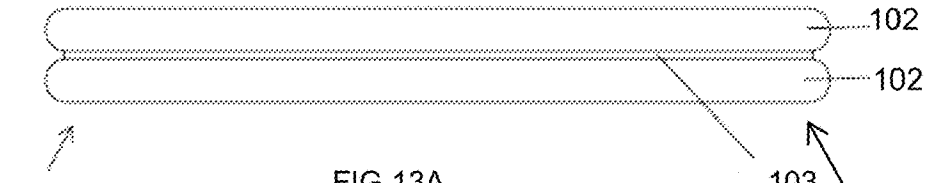
FIG. 13A illustrates a side view of the tubular bulb of FIG. 13.
Figure 13:
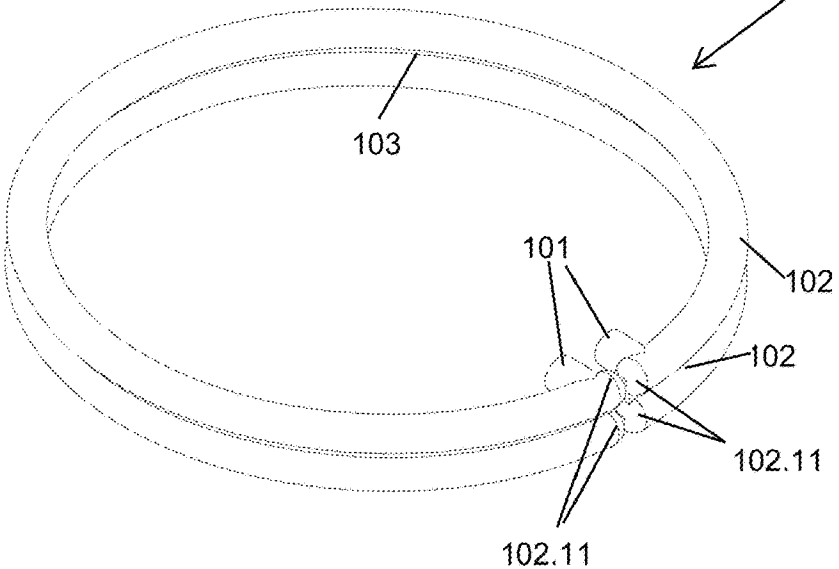
FIG. 13 illustrates a perspective view of a further tubular bulb which has a tubular body and is generally toroidal in shape.

Illustrated in FIGS. 13 and 13A is a tubular bulb 140, which has a generally toroidal shape to form an open ring shaped tubular bulb 140. From the side view of FIG. 13A, it can be seen that the bulb 140 has two tubes 102 which are of a generally circular or cylindrical cross section, in the same manner as that of FIGS. 1 to 6, and like parts have been like numbered. As with the other previously described bulbs 100, 110, 120 and 130, the ultimate operational, aesthetic or performance requirements of the bulb 140 will dictate what cross section is utilised.

The tubular bulb 140 has four mounting interfaces 101, which extend radially inwardly near the ends of the tubes 102. The ends of the tubes 102 may each terminate in a hemispherical end 102.11. The mounting interfaces 101, of which only the upper two are visible in FIG. 13, for the attachment of two excitation chambers, as will be described in more detail below. The mounting interfaces 101 are of a straight-cut variety, and are simply the terminating ends of a cylindrical section. As will be described in more detail later, these interfaces 101 will be received into cavity or recess interfaces on an excitation chamber.

Figure 14A:
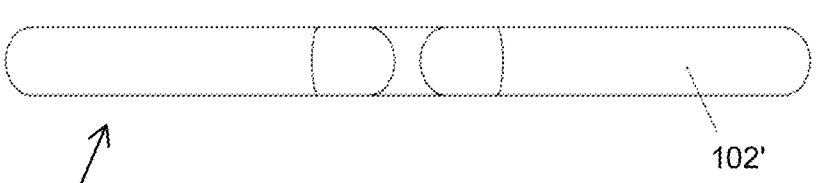
FIG. 14A illustrates a side view of the tubular bulb of FIG. 14.
Figure 14:
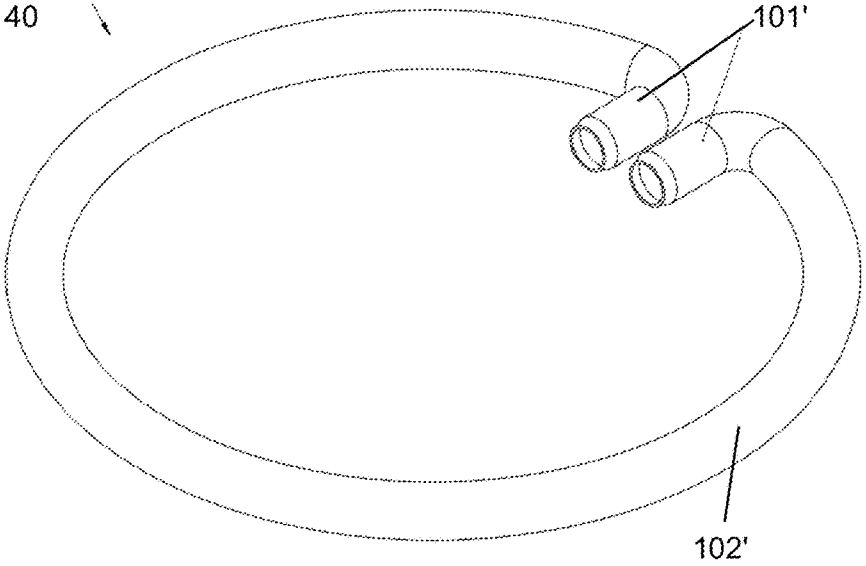
FIG. 14 illustrates a perspective view of a further tubular bulb which has a tubular body and is generally toroidal in shape.

Illustrated in FIGS. 14 and 14A is a single curved tubular bulb 140', which is part toroid or part round, which has a generally toroidal shape to form an open ring shaped tubular bulb 140'. From the side view of FIG. 14A, it can be seen that the bulb 140' has a single tube 102' which is of a generally circular or cylindrical cross section. As with the other previously described bulbs 100, 110, 120 and 130, 140, the ultimate operational, aesthetic or performance requirements of the bulb 140' will dictate what cross section is utilised.

The tubular bulb 140' has two mounting interfaces 101', visible in FIG. 14, for the attachment of the excitation chamber, as will be described in more detail below. The mounting interfaces 101' are of a straight-cut variety having tapered ends 101.1 to be received into the intermediate flange cavity or recess interface of an excitation chamber FIGS. 27E to 27H as will be described in more detail below.

Method of Making the Tubular Bulb

Figure 15:
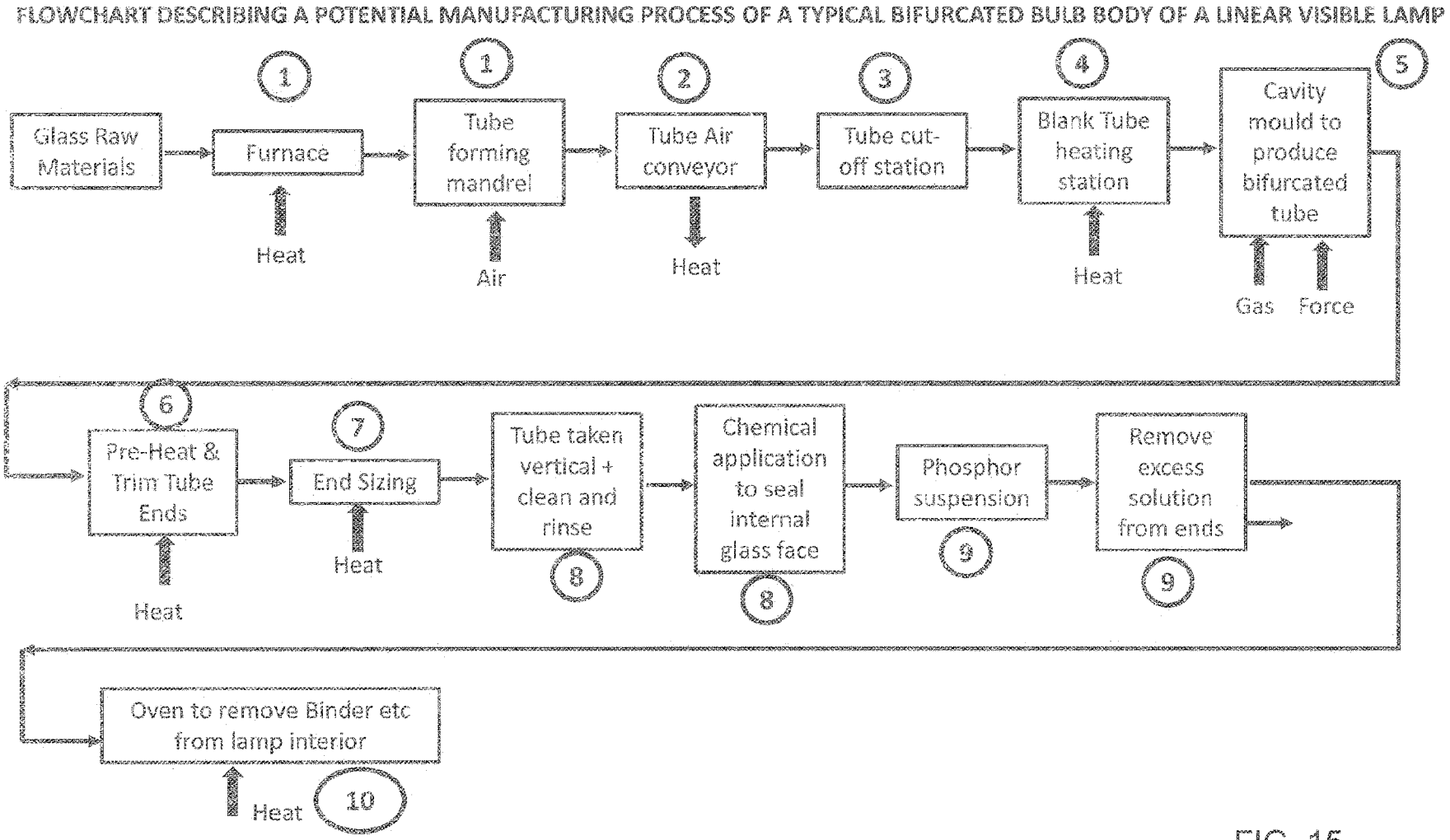
FIG. 15 illustrates a flow chart of an exemplary process for the manufacture of the tubular bulbs of FIGS. 1 to 14.

The above described tubular bulbs 100, 110, 120, 130 and 140, can be made by an exemplary process as illustrated in schematic fashion the flow chart of FIG. 15. The process steps will now be described in more detail.

A brief summary of this process is that the tubular bulbs, such as 100, 110, 120, 130 and 140 from FIGS. 1 to 14, can be formed from one single straight original circular tube, preferably of glass, of a predetermined diameter that when a central portion of this original tube is heated to its softened working state, it can be further moulded using conventional lamp glass making machinery to enable a bifurcated section of any required cross sectional shape. This original tube bifurcation achieves two further distinct tubes 102 as described above, yet they remain part of the original circular straight tube with at least one open end (two are required for a double ended lamp or one for a single ended lamp) yet the bifurcated tube 102 behaves as separate tubular cavities simultaneously as required for a double ended, single ended and circular lamp.

The method of manufacturing the tubular bulbs 100, 110, 120, 130, 140 as described above, includes the steps of: (a) forming a single first tube (the later remainder of which forms rim or rims 101.1 and mounting interface 101); (b) heating, or maintaining the heat, of a central portion of the single tube to a working temperature; (c) applying pressure the central portion so as to form two second tubes 102 from the single first tube.

An additional step can be performed sequentially or simultaneously with the method, namely that of maintaining at least one end of the single first tube as being an original single first tube shape; or alternatively modifying at least one end of the single first tube to result in a different shape or size to the original single first tube shape.

Step (c) is preferably performed by means of a mould or any appropriate means and it creates one of the following between the two second tubes 102: a continuous web 103 between them; an intermittent web between them (not illustrated); a space or void between them (not illustrated).

The method of manufacture, when single ended tubular bulbs 110, 130 are to be made, will leave only one end maintained as being the original single first tube shape. For single ended tubes or tubular bulbs 110, 130, the manufacturing method will either preferably form a U-shaped or 180 degree union 102.5 simultaneously in the mould described in the preceding step; or will, at the end opposite to the one end, leave open the two second tubes 102. If the second tubes 102 are left open, they can later be joined to each other, by a U-shaped or 180 degree union or joining piece 102.5, so that they are in gas communication with each other. Such a later join can be made by any appropriate means such as butt welding; joining flanges; fused joins etc.

At some point further in the production process the method will also include one or more of the following steps maintaining an extra single first tube length portion for positioning, rotating or clamping in the subsequent steps; trimming the ends of the single first tube to arrive at a finished bulb configuration; cleaning; applying an internal coating or coatings; inserting sub-assemblies; assembling sub-assemblies; welding, affixing, fusing or bonding of additional sections or components; fusing additional sections or components; applying an external coating or coatings; applying externally a graphene coating.

The bifurcation forming stage can be introduced into the glass tube production process, optimally in line in such a manner as to utilise retained tube heat during the glass drawing process. Equally the bifurcation forming stage may be performed at a later time requiring higher input energy to reheat the material to the required forming temperature. Refer flowchart describing the potential manufacturing and assembly process for bifurcating the bulb body of a typical linear lamp.

The resultant bifurcated tube may not be the finished shape in that it may contain an extra or remaining length of original single tube length portion that was retained for positioning, rotating or clamping in the subsequent assembly and manufacturing process (either automated or manual). This extra or remaining length of original single tube length portion would be trimmed within the manufacturing process to arrive at the finished lamp tubular bulb configuration.

The benefits which can be achieved by these tubular bulb constructions and manufacturing processes include: better or high speed production; energy efficient production as it uses residual heat from the glass drawing line; it enables a wide range of bulb cross-section geometry due to body moulding possibilities; it enables greater bulb rigidity as webbing 103 and ribbing bosses can be introduced into the bulb shape; it enables potential for embedded power cabling within the bifurcated web for transferring power from one end of the lamp to the other end, giving added safety, physical and electrical protection to the user and cabling—this will be described in more detail below.

As illustrated in FIG. 15, the method of making the tubular bulbs 100, 110, 120, 130 and 140, comprises steps as indicated above and below, which are included in the flow chart illustrated, to which some additional commentary is provided as follows, wherein the number of the comment, namely 1 to 10, is located at, and directed to, particular steps in the flowchart of FIG. 15:

Comment 1: Glass raw materials are fed into the furnace in order to produce the desired glass required e.g. soda ash, quartz or other, in accordance with the manufacturer's specifications. Glass is then introduced into a mandrel, nozzle or some other apparatus where it is typically interfaced with air in order to draw a hollow original tube, typically in accordance with one of the more widely accepted manufacturing fundamentals.

Comment 2: The single original tube will travel either vertically under gravity or by some other means to a point where it has slightly cooled and will engage with either an air or some other form of conveyor (not illustrated). This conveyor will carry the single original tube a distance to the next station by which time it will have hardened and be of the desired final shape, straightness etc.

Comment 3: By the time the single original tube reaches the tube cut off station it will have cooled significantly and will be at the optimum temperature to allow it to be cut to approximate length. The original tube may be cut by means of thermal shock, mechanical apparatus or some other means.

Comment 4: The single original tube having been cut into individual lengths will now enter either an inline or parallel series of heating chambers (dependent on the manufacturing plant, throughput etc.). Each heating station will heat the lengths of glass original tube to an optimal forming temperature until they are passed into the cavity mould(s).

Comment 5: Upon entering the cavity mould station, the single original tube will be partially pressurized with a gas, and a force applied to the mould in order to create the bifurcated shape of bulb designated by the respective design, as illustrated in FIGS. 1 to 14. Creation of nonlinear tubular bulbs, such as that shown in FIG. 13 requires an additional forming process to arrive at the desired geometry. This additional forming can be performed at this stage or alternatively after the actions in Comment 9 below, or at some other time.

Comment 6: Dependent upon the manufacturing process utilised and residual heat within the bifurcated bulb, the tube may be heated before the tube trim station or may be heated after the trim station. Either way, sufficient heat must be present to size the end of the bifurcated lamp post trimming Alternative to this separate station, the manufacturer may elect to trim the single original tube to the exact length immediately after moulding and whilst still held captive by the mould, or immediately afterwards. If performed in a separate station, fine positioning may be required prior to trimming.

Comment 7: The tubular bulb end(s), being the original diameter of the single original tube, are sized for later connection to a predetermined excitation chamber, as will be described in more detail below.

Comment 8: The now bifurcated tubular bulb will then be conveyed to the cleaning station in accordance with the manufacturer's process preference. It is possible that the conveyor will transition the now bifurcated tubular bulb from the horizontal to vertical plane where it will ultimately be cleaned and rinsed to remove any debris or chemicals resulting from the previous manufacturing steps. A chemical application is applied to the internal wall of the bifurcated tubular bulb in order to seal same.

Comment 9: The cleaned and treated open bifurcated tubular bulb progresses to the next station where a phosphor solution is applied (in the case of a visible light lamp) to the entire internal surface of the tubes 102 and is subsequently drained to a prescribed thickness. Excess solution is removed from the ends of the bifurcated tubular bulb which will later interface with the excitation chamber. Lamps designed for other applications such as Ultra violet and infra-red may or may not include a phosphor lining and hence may not have a solution applied as described above.

Comment 10: The bifurcated and coated tubes are conveyed through an oven to remove any residual binder chemicals which had been included in the phosphor or other solution.

Excitation Chamber Features and Construction

Figure 17:
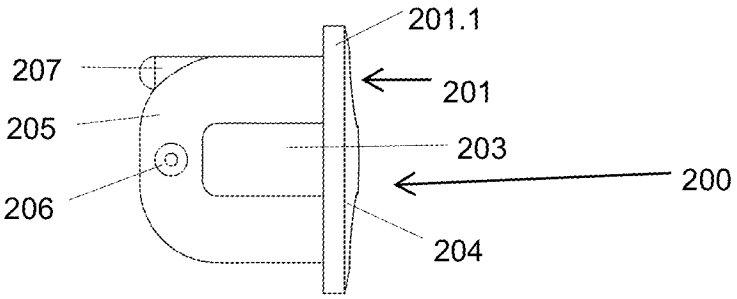
FIG. 17 illustrates side view of the chamber of FIG. 16.
Figure 16:
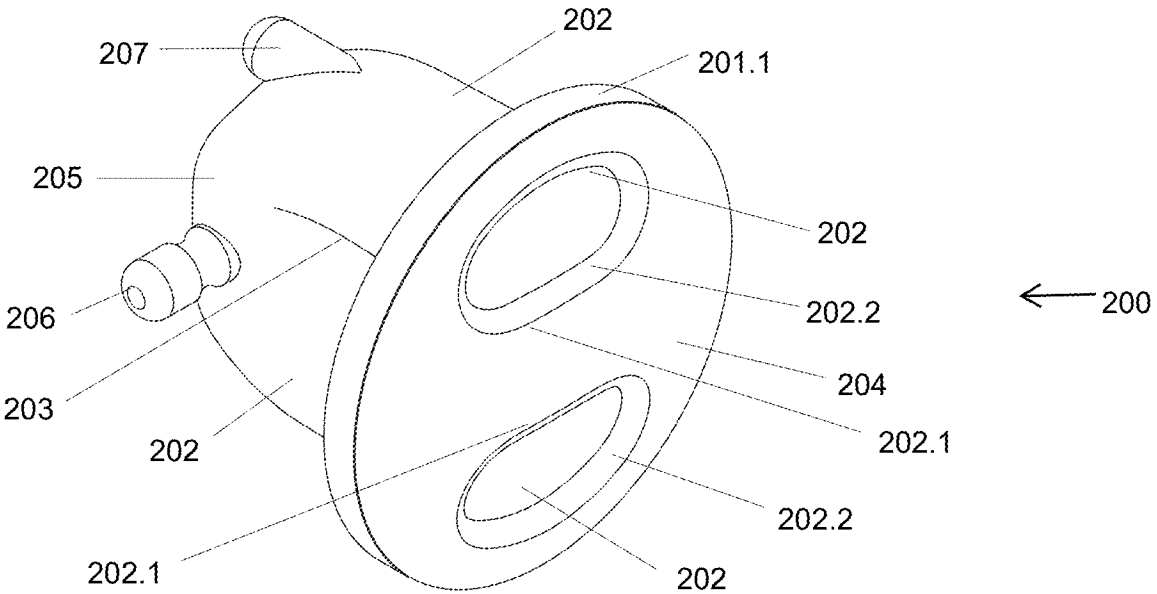
FIG. 16 illustrates a perspective view of an excitation chamber.
Figure 18:
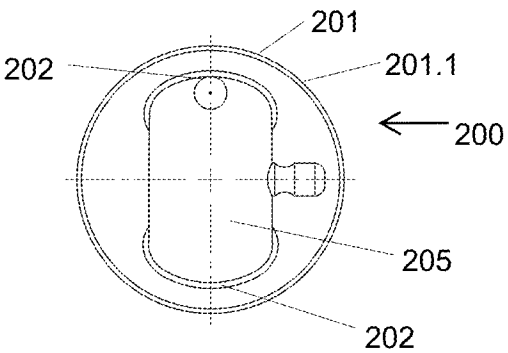
FIG. 18 illustrates an end view of the chamber of FIG. 16.

Illustrated in FIGS. 16 to 18 is a first excitation chamber 200. The chamber 200 has a mounting flange 201 which has a cylindrical outer rim 201.1, and is of a diameter so as to closely mate with, and or engage with, the mounting interfaces 101 of the tubular bulbs 100, 110, 120 and 130, so that the respective passages of tubes 102 will be aligned with two excitation tubes 202 forming part of the excitation chamber 200. Between the two excitation tubes 202 and behind the mounting flange 201, is a space or gap 203 through which can be threaded a spool (see spool 510 below) on which is located coil windings, so as to locate coil windings adjacent to the sides of the excitation tubes 202, as will be described in detail below. It will be noted in FIG. 16, that the facing surfaces of the tubes 102 are generally straight, as is evident by the flat peripheries 202.1. The flat peripheries 202.1 produce a flat upper surface and flat lower surface which bounds the space or gap 203 by the excitation tubes 202, behind the flange 201.

Likewise with the tubular bulbs described above, the intersection of the outlet of the excitation tubes 202 with the face 204 of the excitation chamber 200, as depicted by transition surface or radii 202.2 would not be seen in the glass or transparent construction of the excitation chambers 200, because the transition surfaces 202.2 at their extremities are tangential to the internal shape of the tube portion 202 and the surface 204.

The surface 204, as best seen from FIG. 17, has an angled outer surface on the flange 201, which approximates or matches the hollow transition surface 101.2 on the tubular bulbs 100, 110, 120 and 130. The meeting of surfaces 204 and 101.2, and the outer circumferential rim 201.1 with the inner circumferential surface of the rim 101.1, ensures that a gas tight seal can be made, whether by fusing, welding or otherwise adhering the transition surfaces 202.2 to the transition surface 102.1.

The excitation chamber 200 as best seen from FIGS. 16 to 18 includes an evacuation tube 207 located at the rear of the excitation chamber 200 between the upper end of the connection section 205 and the rear end of the upper tube 202, with the evacuation tube 207 extending rearwardly in the general direction of extension of the tubes 202. Additionally, the excitation chamber 200 also includes an amalgam housing 206 which is approximately centrally located on the connection section 205, and at the side thereof, and extending in a sidewards direction. The amalgam housing can alternatively be sited at other locations and can extend rearwardly in a similar manner to the evacuation tube as described above. More will be described about these in the description below.

The excitation chamber 200, whilst having the above described features for sealingly interacting with the mounting interfaces 101 of the previously described bulbs, will also allow the connection, by welding or fusing etc. of an appropriately shaped end of a tube, which may be straight or u-shaped, or some other appropriate shape.

Illustrated in FIGS. 19 to 21 is another excitation chamber 210, which is similar to that of FIGS. 16 to 18, and like parts have been like numbered. The excitation tubes 202 of excitation chamber 210 do not differ from that of chamber 200. The primary difference of this excitation chamber is that it permits use of circular tubes, whether individual, or part of a bifurcated bulb. While this excitation chamber accepts a circular tube into opening 202.1, there is an internal transition surface to the preferred excitation chamber geometry described earlier in relation to FIGS. 16 to 18.

It should be noted that the excitation tubes 202 for an excitation chamber could be made of any cross sectional shape, anywhere in the excitation chamber, including that area surrounded by the ferrite core. Such cross sectional shapes can include circular, triangular square, obround or rectangular. This list not exhaustive.

Figure 89:
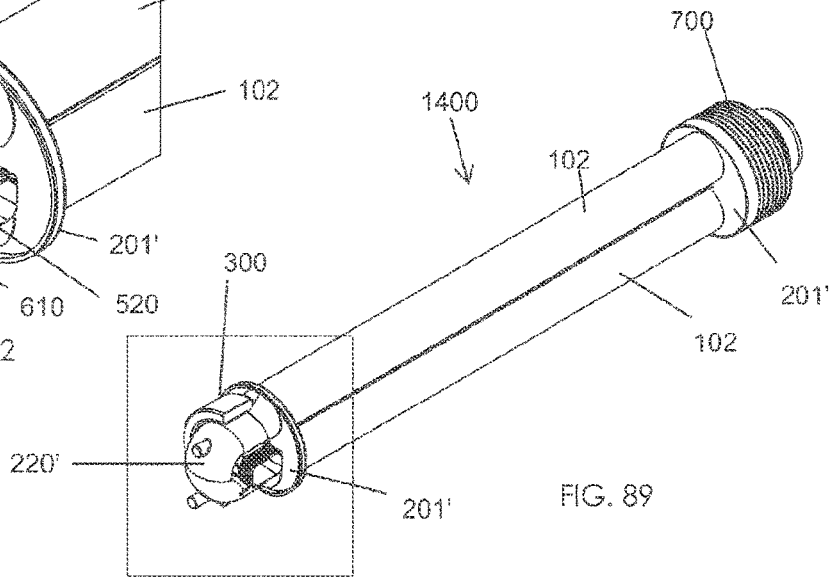
FIG. 89 illustrates a perspective view of another lamp assembly embodying the components of previous figures having two single tubular bulb bodies, and an excitation chamber as illustrated in FIGS. 22/22A to 24 in an excitation chamber/spool/core/coil/excitation chamber covers sub-assembly at both ends with one excitation chamber cover, and one ferrite core half, removed for illustration purposes.
Figure 90:
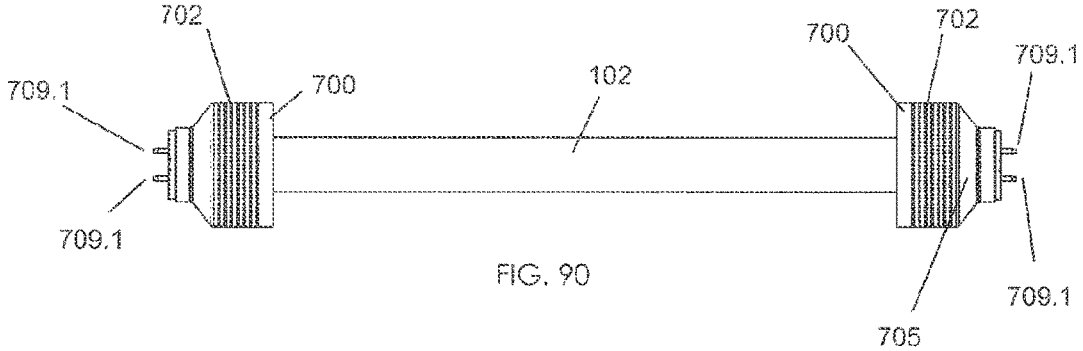
FIG. 90 illustrates a plan view of the lamp assembly of FIG. 89 with both excitation chamber covers present.
Figure 93:
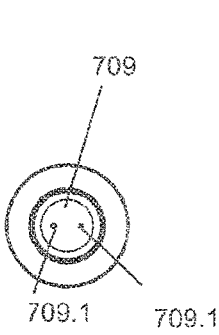
FIG. 93 illustrates the excitation chamber cover end view of the lamp assembly of FIG. 89.
Figure 91:
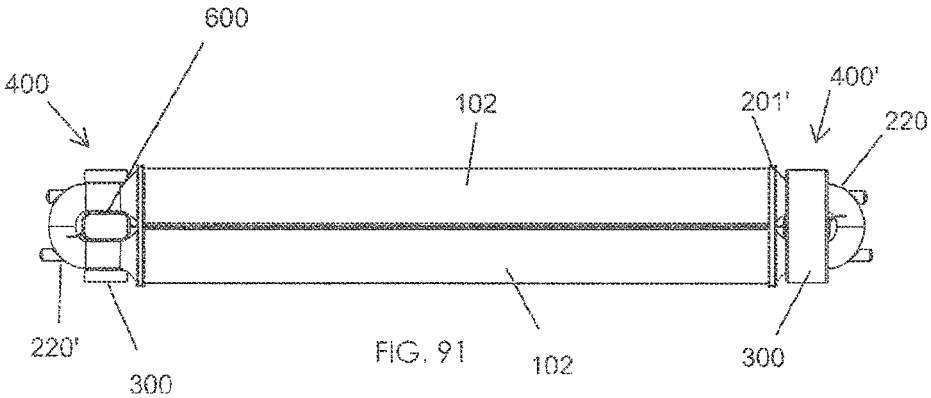
FIG. 91 illustrates a side view of the lamp assembly of FIG. 89 with both excitation chamber covers, and one ferrite core half, removed for illustration purposes.
Figure 97:
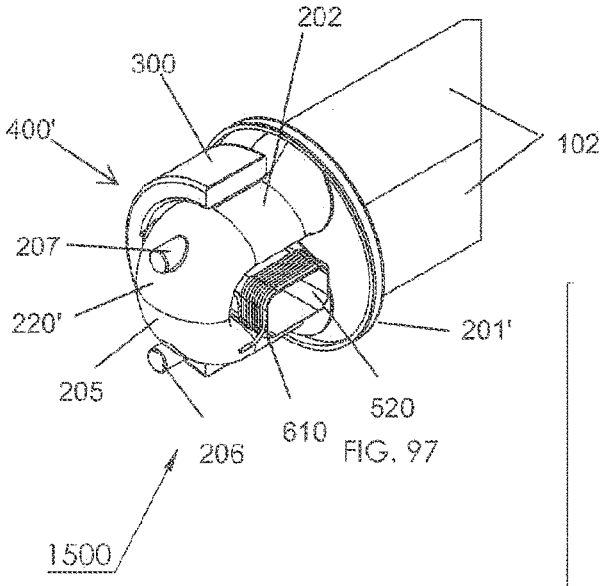
FIG. 97 illustrates a detail perspective view of the excitation chamber cover end of lamp assembly of FIG. 94 which has an excitation chamber cover, and a ferrite core half, removed for illustration purposes.
Figure 94:
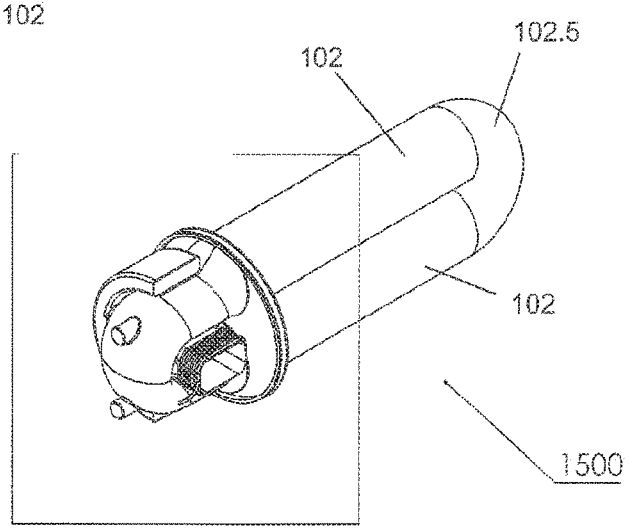
FIG. 94 illustrates a perspective view of a further lamp assembly embodying the components of previous figures having a tubular bulb, and an excitation chamber as illustrated in FIGS. 22 to 24 in an excitation chamber/spool/core/coil/excitation chamber cover sub-assembly at one end with excitation chamber cover, and ferrite core half, removed for illustration purposes.
Figure 95:
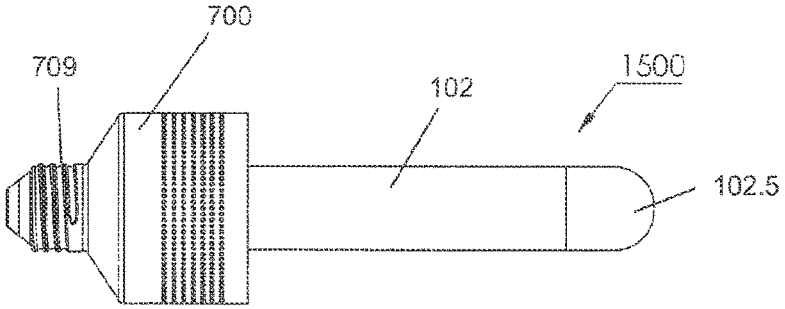
FIG. 95 illustrates a plan view of the lamp assembly of FIG. 94 with excitation chamber cover present and showing an Edison screw type fitting lamp holder.
Figure 96:
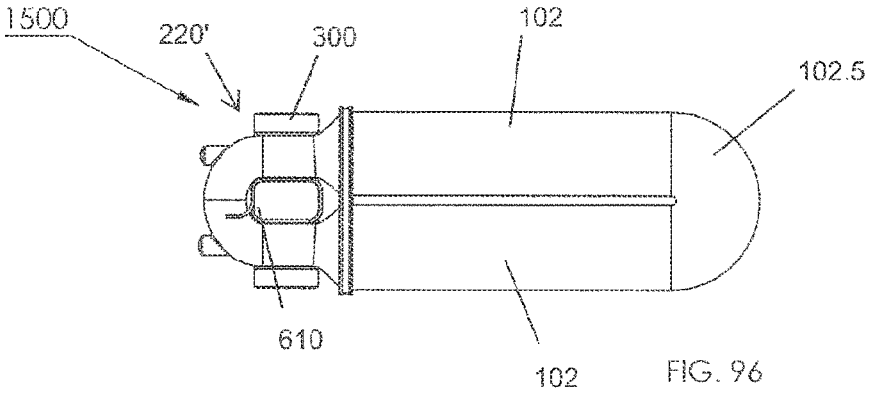
FIG. 96 illustrates a side view of the lamp assembly of FIG. 94 with excitation chamber cover, and ferrite core half, removed for illustration purposes.
Figure 99:
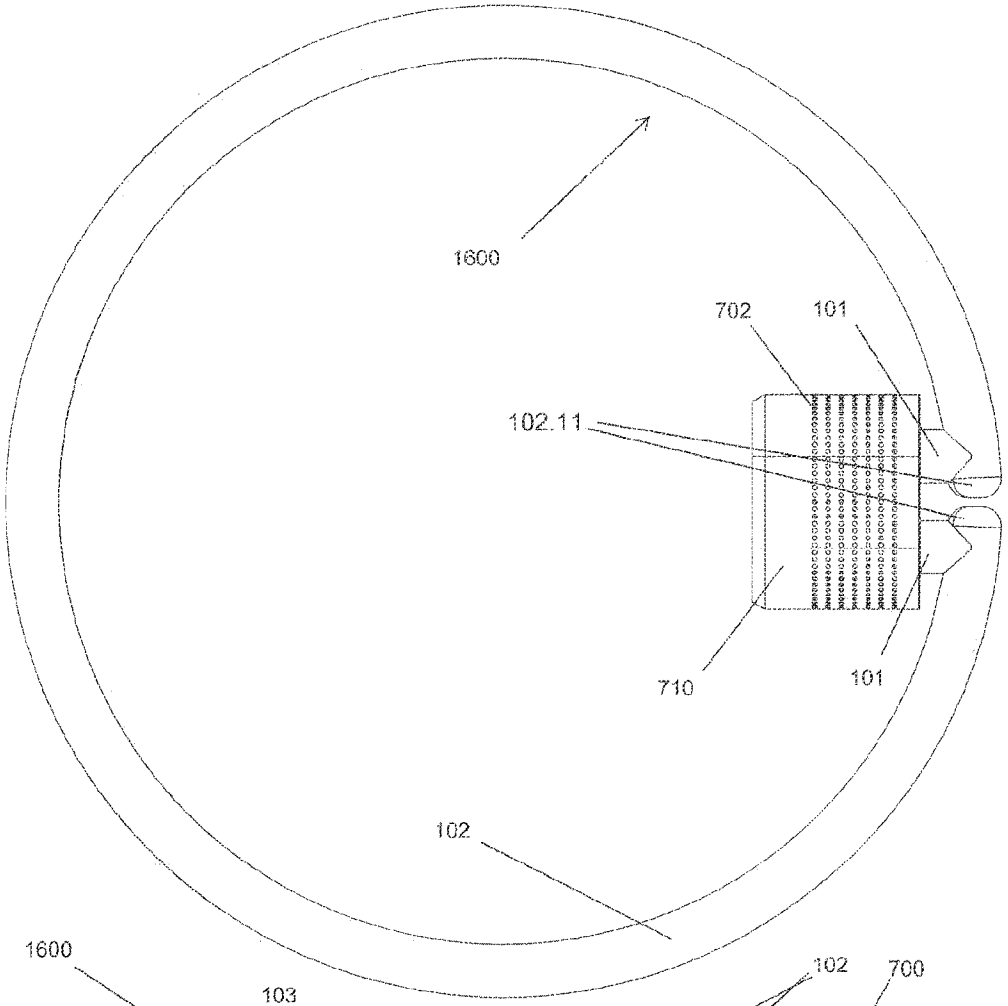
FIG. 99 illustrates a plan view of the lamp assembly of FIG. 98.
Figure 100:
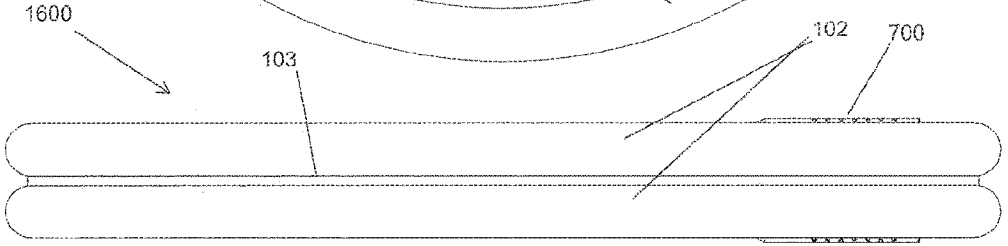
FIG. 100 illustrates a side view of the lamp assembly of FIG. 98.
Figure 98:
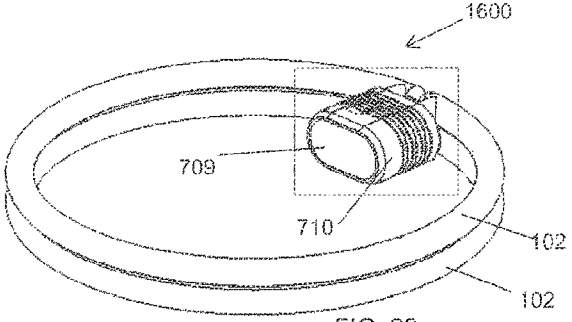
FIG. 98 illustrates a perspective view of a further lamp assembly embodying components of previous figures having a tubular bulb as illustrated in FIGS. 13 and 13A, and excitation chamber as illustrated in FIGS. 25/25A to 27 in an excitation chamber/spool/core/coil/excitation chamber cover sub-assembly.

As described above, the excitation chamber 210, by virtue of mounting flange 201 is connectable to circular straight tubes or U-tubes to produce a lamp as shown in FIG. 89 or FIG. 94. Further, like the excitation chamber 200, the excitation chamber 210 can be provided with a surface 204 which allows engagement with respective mounting interfaces 101 of the tubular bulbs 100,110,120, 130 described earlier. The excitation chamber 210 will thus be useful in constructing lamps where bifurcated bulbs may not be available.

Figure 23:
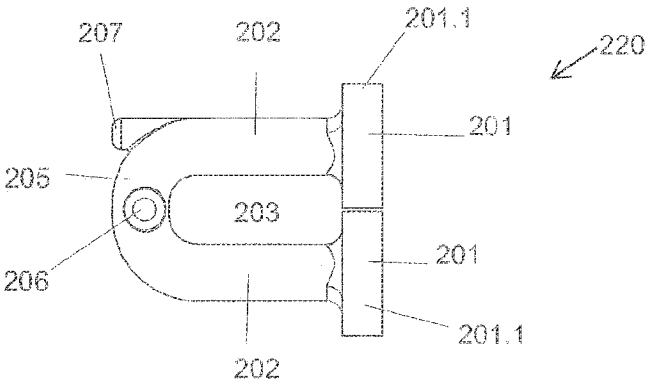
FIG. 23 illustrates side view of the chamber of FIG. 22.
Figure 24:
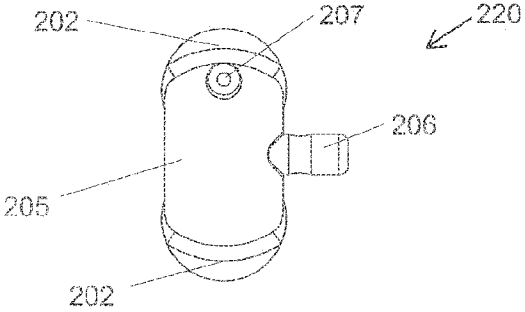
FIG. 24 illustrates an end view of the chamber of FIG. 22.
Figure 22:
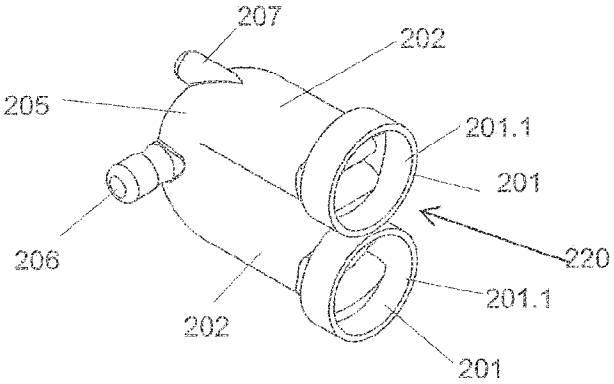
FIG. 22 illustrates a perspective view of a further excitation chamber.

Illustrated in FIGS. 22 to 24 is an excitation chamber 220, which is similar in construction to that of excitation chamber 210 of FIGS. 19 to 21, and like parts have been like numbered. The excitation chamber 220 differs from the excitation chamber 210 in that the joining ends of the tubes 202 each terminate in their own recess or cavity type joining flange 201, which has a circumferential or circular rim 201.1 around it, so as to receive a straight cut end of a cylindrical tube. The joining flange 201 can be formed on the tube ends 202 after the U-shape configuration of tubes 202, 205 and 202 is formed or before on the ends of a straight length of tube and then bent into a U-shaped excitation chamber. By either method, a space or gap 203 will be formed as in the previously described excitation chambers, which will provide a gap into which a spool and coil windings can be assembled.

Figure 26:
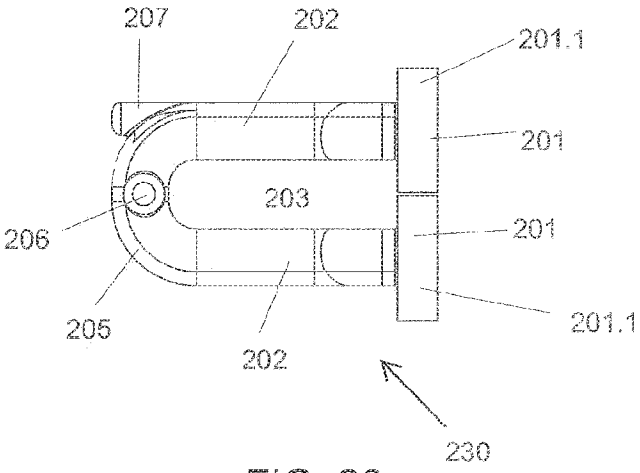
FIG. 26 illustrates side view of the chamber of FIG. 25.
Figure 27:
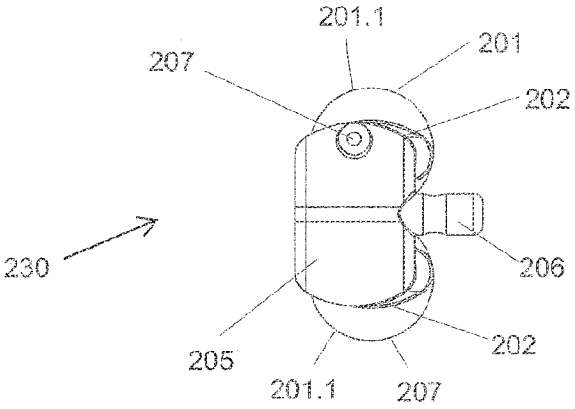
FIG. 27 illustrates an end view of the chamber of FIG. 25.
Figure 25:
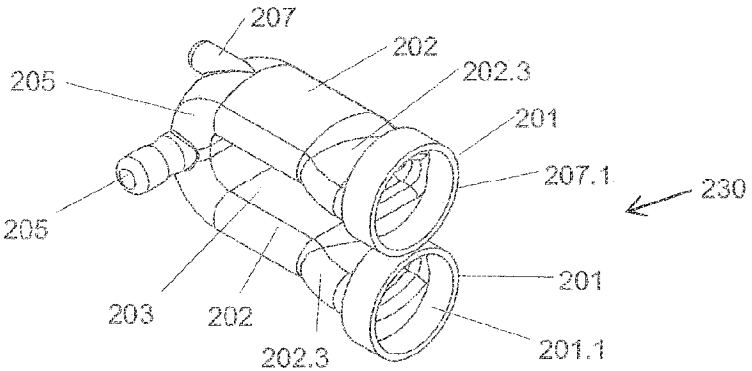
FIG. 25 illustrates a perspective view of another excitation chamber.

Illustrated in FIGS. 25 to 27 is another excitation chamber 230, which is similar to that of excitation chamber 220 of FIGS. 22 to 24, and like parts have been liked numbered. The difference is that the excitation chamber 230 has a horizontal offset portion 202.3 on the ends of each of the tubes 202, which leads to the recess/cavity type mounting flanges 201. It will be understood that in some circumstances an offset, both in the same vertical direction, or in opposite vertical directions, can be produced due to the lamp requirements.

Figures 27A, 27B, 27C, 27D, 27E, 27F, 27G, 27H, 27J, 27K:
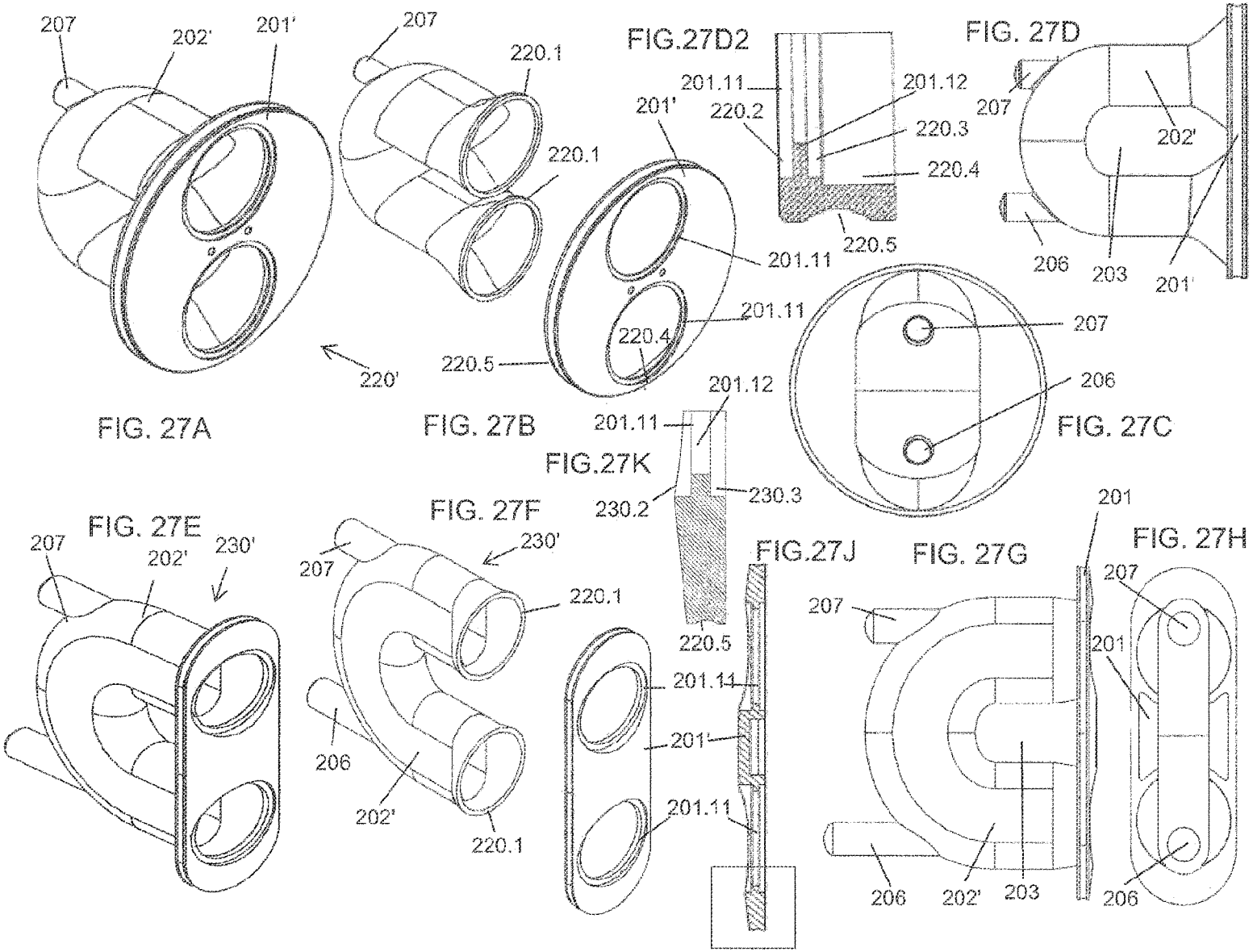
FIG. 27A illustrates a perspective view of further excitation chamber with added circular intermediate flange.
FIG. 27B illustrates an exploded perspective view of the components of FIG. 27A.
FIG. 27C illustrates a rear view of the chamber of FIG. 27A.
FIG. 27D illustrates a side view of the chamber of FIG. 27A.
FIG. 27E illustrates a perspective view of further excitation chamber with added obround flange.
FIG. 27F illustrates an exploded perspective view of the components of FIG. 27E.
FIG. 27G illustrates a rear view of the chamber of FIG. 27E.
FIG. 27H illustrates a side view of the chamber of FIG. 27G.
FIG. 27J illustrates cross section through the flange of FIG. 27F.
FIG. 27K illustrates a detail view of part of the cross section of FIG. 27J.

Illustrated in FIGS. 27A to 27D is an excitation chamber 220', which is similar in construction to that of excitation chamber 210 of FIGS. 19 to 21, and like parts have been like numbered. The excitation chamber 220' differs from the excitation chamber 210 in that a flange 201' is present, which can be called an intermediate flange because it connects between the extremity or surfaces of the U-shaped tube 202' and the cover 700 or similar as described below. The intermediate flange 201' may have a circular outer perimeter, that connects to the U-shaped tube 202'. The flange 201' has a recess or cavity 220.4, as best seen in FIG. 27D2, and may have an outwardly facing circumferential groove 220.5, which has the purpose of providing a location for adhesive to be inserted, so as to bond a cover 700 as described below to the flange 201'. The flange 201' has two large apertures 201.11 which has a circumferential or circular inner rim 201.12 around it, and a co-axial cylindrical rim 220.3 which is of larger diameter to apertures 201.11, so as to receive the straight cut cylindrical rims 220.1 of the U-shaped tube 202' terminus. On the other side of the flange 201' to the rim 220.3, is another co-axial cylindrical rim 220.2 which will receive a straight cut end of a cylindrical tube or bulb. The rim 201.12 provides a wall to separate the cylindrical ends 220.1 of the U-shaped tube 202' from engaging the straight cut ends of the cylindrical tubes or bulbs located on the other side of flange 201'.

A space or gap 203' will be formed as in the previously described excitation chambers, which will provide a gap into which a spool and coil windings can be assembled. In this embodiment, the excitation chamber 220' is made from a separate flange 201' which is joined and sealed to the U tube 202', in a gas tight manner It will be noted from the Figs that the U-shaped tube 202' has a flattened cross section on its tubular construction, while its ends are flared and terminate in cylindrical rims, for engagement with the flange 201'.

Illustrated in FIGS. 27E to 27K is another excitation chamber 230', which is similar to that of excitation chamber 220 of FIGS. 22 to 24, and excitation chamber 220' of FIGS. 27A to 27D and like parts have been liked numbered. In the preferred embodiment, the intermediate flange 201' of the excitation chamber 230' is obround and of a geometry that enables the excitation chamber 230' to be physically smaller than the bulb size. If needed, the intermediate flange 201' can exceed the bulb size such that the excitation chamber cover and power controller can be housed compactly. Additionally, it will be noted from FIGS. 27E to 27K that the tubes of the U-shaped tubular portion 202' have a major and minor axis, with the upper and lower leg segments of the U-shape have their major axes being collinear. The shape of the tubes of portion 202' is obround, and terminates in a flared end which in turn terminates in a circular or cylindrical rim 220.1 to engage the flanges 201'.

A difference between the chamber 230 of FIGS. 22 to 24 and chamber 203' of FIGS. 27E to 27K is that the excitation chamber 230 has a horizontal offset portion 202.3 on the ends of each of the tubes 202, which leads to the recess/cavity type mounting flanges 201. It will be understood that in some circumstances an offset, both in the same vertical direction, or in opposite vertical directions, can be produced due to the lamp requirements. The chamber 230' can be manufactured in the same way that chamber 220' above is manufactured.

The production of an excitation chamber such as 220' or 230' with a separate intermediate flange 201' allows for an assembly of the excitation chamber to the bulb, whereby the excitation chamber and bulb glass may differ. The ring 201.12 intermediates between the glass of the excitation chamber and the glass of the bulb. The intermediate flange 201' allows for the accommodating of a thermal co-efficient difference between the bulb and the excitation chamber, by acting as a medium between them, and also acts as a flux glass when they melt and or are fused together.

Figure 28:
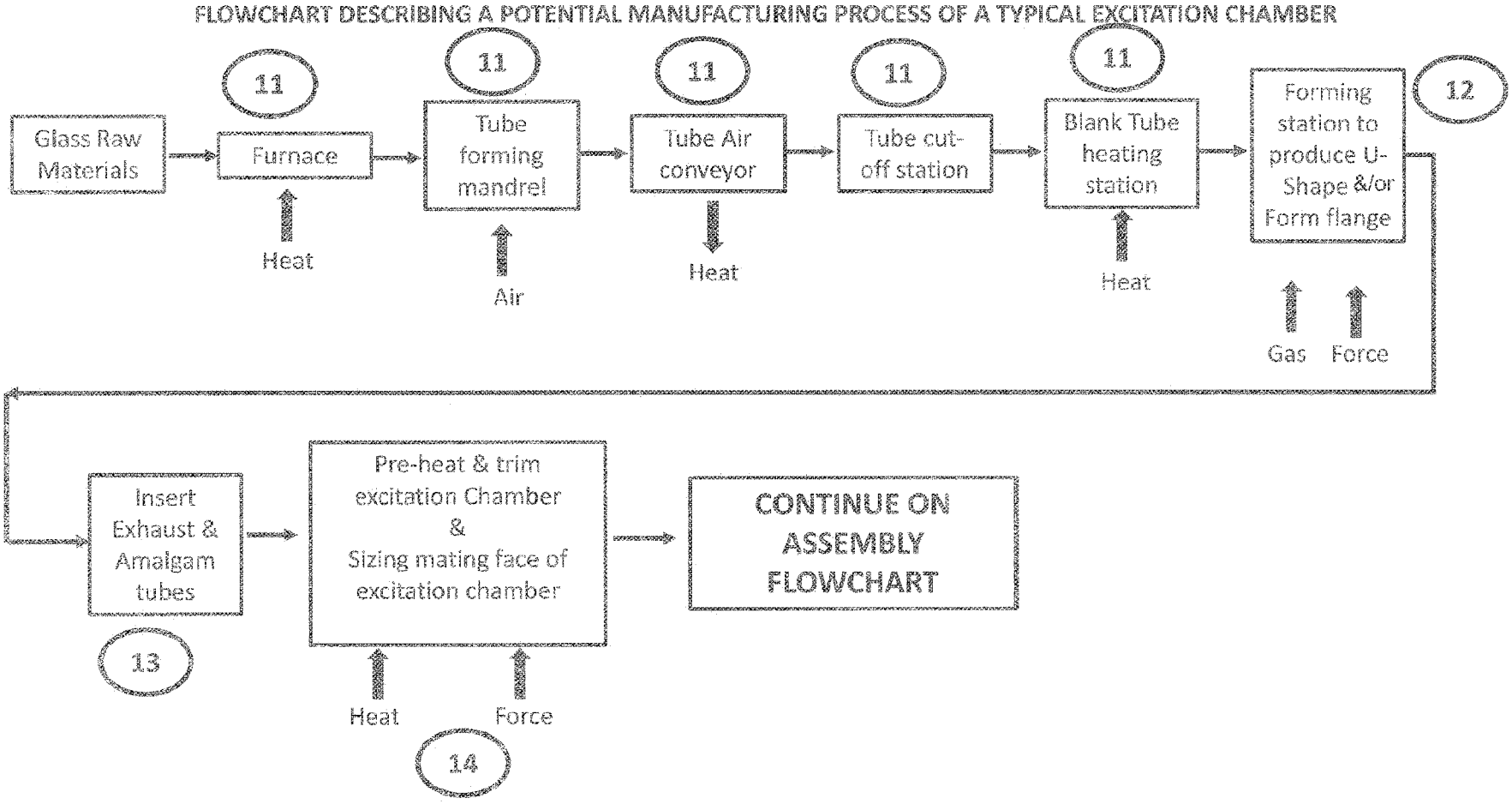
FIG. 28 illustrates a flow chart of an exemplary process for the manufacture of the excitation chambers of FIGS. 16 to 27.

In respect of the manufacture of the excitation tubes 200, 210, 220, 220', 230 and 230', an expected method of manufacture is described in the flowchart of FIG. 28, to which some additional commentary is provided as follows, wherein the number of the comment, namely 11 to 14, is located at, and directed to, particular steps in the flowchart of FIG. 28.

Comment 11: Glass tubes are produced in a similar manner as described in the first 6 steps of the flowchart of FIG. 15 and related Comments 1 to 4 above.

Comment 12: The glass tubes are passed to a forming station where they are heated to an elevated temperature wherein they are bent to form a U-shape after being partially pressurised with gas. The ends of the tube are again heated and undergo a secondary forming process to produce the mating or mounting flange 201 which later mates with the bifurcated bulb body mounting flange 101.

Comment 13: The excitation chamber will index to the next station wherein the amalgam and exhaust tubes will be attached.

Comment 14: This final stage comprises heating of the excitation such that the mating or mounting flange 201 can be trimmed to the final dimensions and the mating face "sized".

The plasma excitation chambers 200, 210, 220 and 230 can also be coated externally with a thermal barrier coating to isolate thermal radiation from the housed plasma. The excitation chambers 200, 210, 220 and 230, due to their relatively small size compared to the tubular lamp body, will also be somewhat isolated from radiation given off by the bulb body when in operation and so will run cooler and more efficiently than current lamps designs.

The plasma excitation chambers 200, 210, 220 and 230 can be produced in a single piece moulding and is initially envisaged to be constructed of glass although other suitable materials may be used.

The plasma excitation chambers 200, 210, 220 and 230 will be mated with the tubes or tubular bulbs and then welded, fused or otherwise joined, during the manufacture/assembly process, to the bifurcated tubes or straight cut tubes as the case may be.

The construction of the above excitation chambers 200, 210, 220 and 230 ensures that when in use (please also refer to the section below entitled "Electromagnet geometry and its electromagnetic field"), the ionisable gases will be excited at two locations in each excitation chamber or U-shaped pathway.

Ferrite Core Features and Construction

Figure 29:
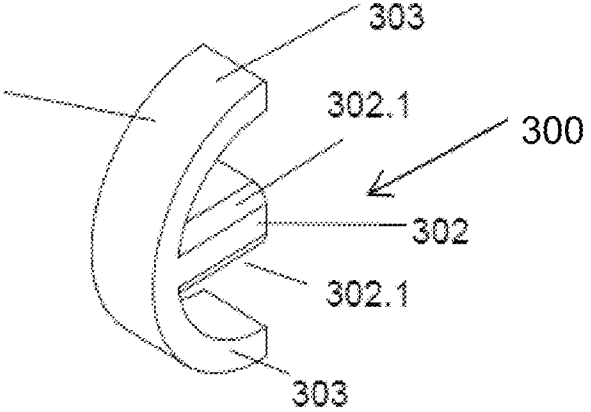
FIG. 29 illustrates a perspective view of a ferrite core of an electromagnet.
Figure 30:
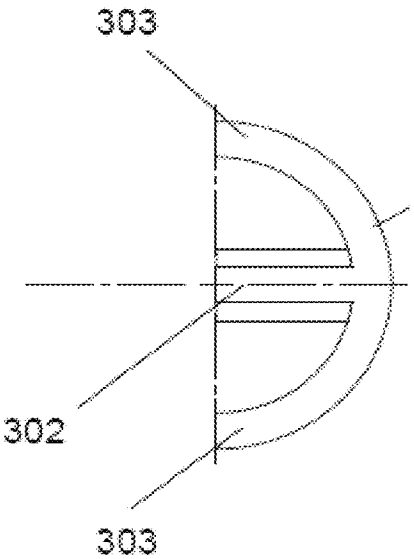
FIG. 30 illustrates side view of the core of FIG. 29.
Figure 31:
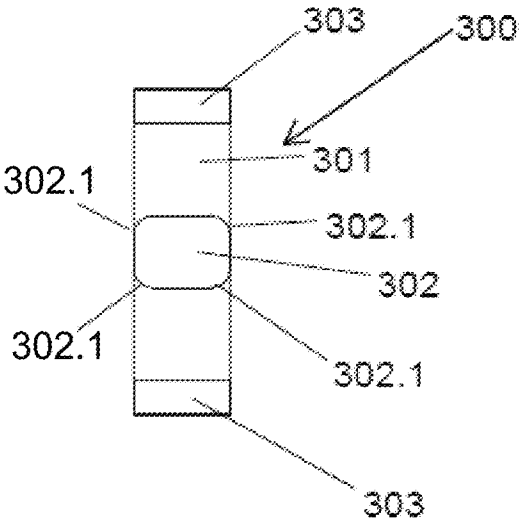
FIG. 31 illustrates an end view of the core of FIG. 29.

Illustrated in FIGS. 29 to 31 is a ferrite half core 300, which with a like half core 300 will form an electromagnet ferrite core, for an electromagnet 400 (see FIGS. 50 to 97), for an electrodeless radio frequency powered external closed core electromagnetic inductively coupled low pressure gas discharge light source or lamp.

The half ferrite core 300 has a body 301 being a circumferential section, which terminates at ends 303, with straight sides 301.1. At the centre of the body 301 the core 300 has a straight projection or portion 302, such that when two half cores are joined face to face, that is in mirror image of each other, so that their opposed ends 303 meet, the respective portions 302 will form a diametrical portion, that is, along a diameter of a circle formed by the contacting bodies 301. The half ferrite core 300 has a generally rounded "E" geometry, similar to the Euro symbol.

Whilst the above describes a preferred design for an assembled ferrite core, it will be recognised that there are numerous variants to achieve a similar electromagnetic field for the electromagnetic circuit and thus a lamp construction. For example, a half toroid with a long middle portion 302, joining up with a half toroid, as in ↻.

The portion 302 is generally twice the cross sectional area of 301 and may be any desirable shape with radiused, or rounded, edges 302.1. As illustrated the portion 302 is generally rectangular or square shape.

The core 300 when joined to a like core to produce a circle with a diametrical line through it, can be described as a shape which includes a generally toroidal outer body with a centrally located diametrical portion formed from two opposed portions 302. This will form D-shaped apertures on each side of, or around, the centrally located diametrical portion formed from two opposed portions 302. When a coil is applied, as discussed in more detail below, this will produce a toroidal dipole magnetic field.

The ferrite core 300 is produced as a half, as this allows easy assembly with an excitation chamber such as 200, 210, 220 or 230 as discussed above, when assembling a lamp such as lamp 1000, as will be discussed below. The half ferrite cores 300 are formed so as to be separated through and re-joined through, a plane lateral to the direction of extension of the centrally located diametrical portion formed from two opposed portions 302.

Figure 33:
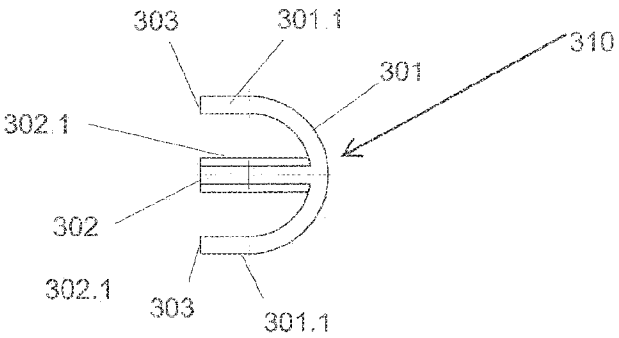
FIG. 33 illustrates a side view of the core of FIG. 32.
Figure 34:
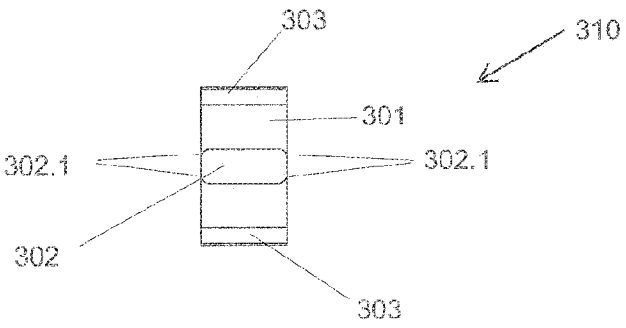
FIG. 34 illustrates an end view of the core of FIG. 32.
Figure 32:
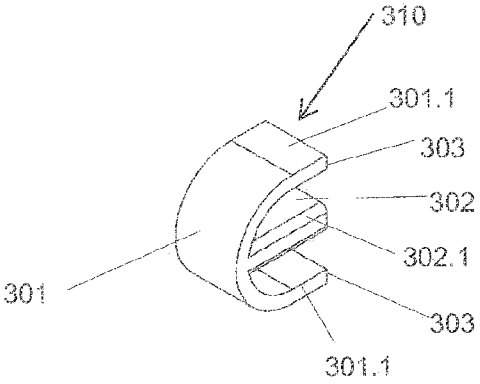
FIG. 32 illustrates a perspective view of another ferrite core of an electromagnet.

Illustrated in FIGS. 32 to 34 is a half ferrite core 310, which is similar to the ferrite core 300 described above. Like parts have been like numbered. The half ferrite core 310, has straight sections which tangentially extend from the ends of the circumferential body portion 301. This produces an "obround" ferrite core when respective ends 303 on adjacent half cores 310 are positioned together. This produces an obround shaped core and electromagnet 400, and is particularly useful when assembled in a lamp with tubular bulb 140, as described in FIGS. 13 and 14 above. The apertures formed through the assembled two cores 310 will be approximately D-shaped just somewhat elongated.

Figure 41:
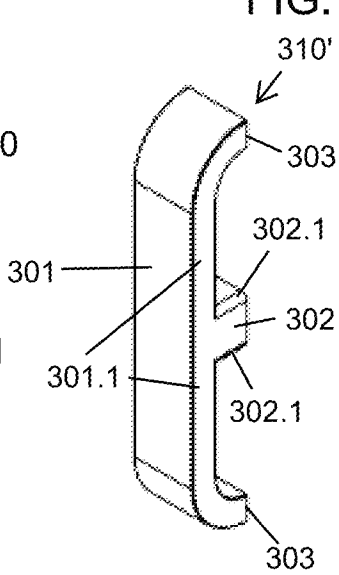
FIG. 41 illustrates a perspective view of another ferrite core of an electromagnet.
Figure 42:
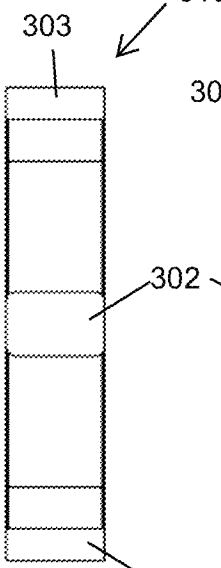
FIG. 42 illustrates a side view of the core of FIG. 41.
Figure 43:
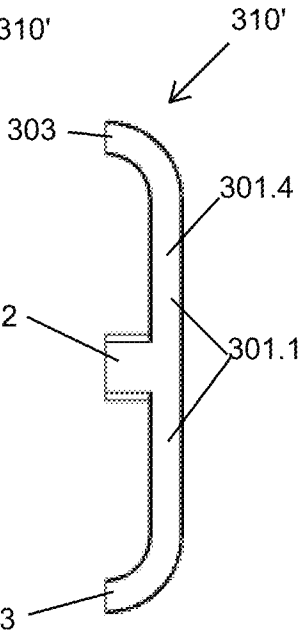
FIG. 43 illustrates an end view of the core of FIG. 41.
Figure 52:
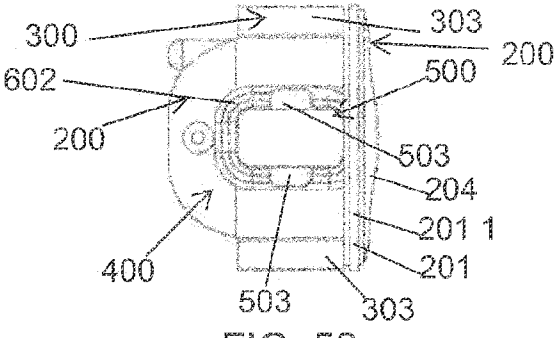
FIG. 52 illustrates a side view of the sub-assembly of FIG. 51, with excitation chamber present and other half of ferrite core removed.
Figure 51:
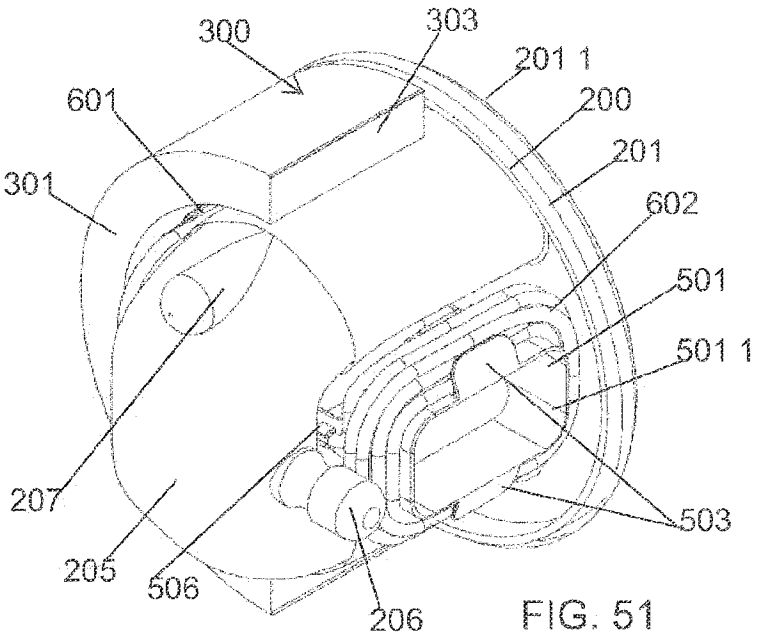
FIG. 51 illustrates a part section perspective view of the sub-assembly of FIG. 50 of a ferrite core half, spool and coil assembly with excitation chamber present and other half of ferrite core removed for illustration purposes.
Figure 53:
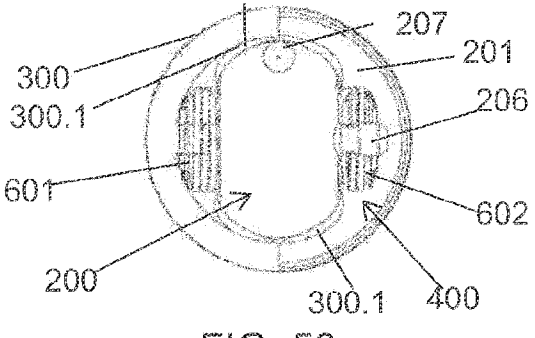
FIG. 53 illustrates an end view of the sub-assembly of FIG. 51.

Illustrate in FIGS. 41 to 43 is a ferrite core 310' half which is similar to the ferrite core half 310 of FIGS. 32 to 34, and like parts have been like numbered. They differ in that ⊃ the core half 310' while still having the general "E" shape, will form two vertically extended apertures one being a side on D-shaped form: ⊃; and the other an upside down side on D-shaped form:

Electromagnet Geometry and its Electromagnetic Field

Figure 50:
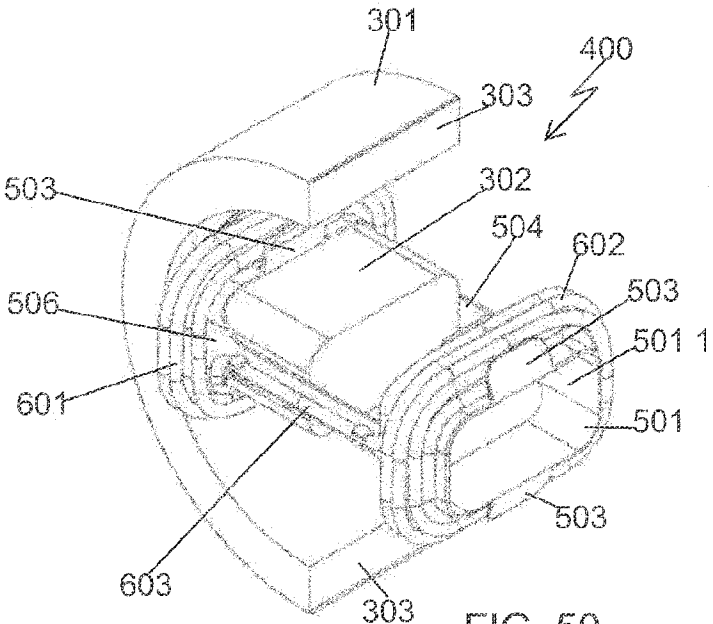
FIG. 50 illustrates a part section perspective view of a sub-assembly of a ferrite core half, spool and coil assembly with excitation chamber removed for illustration purposes.
Figure 102:
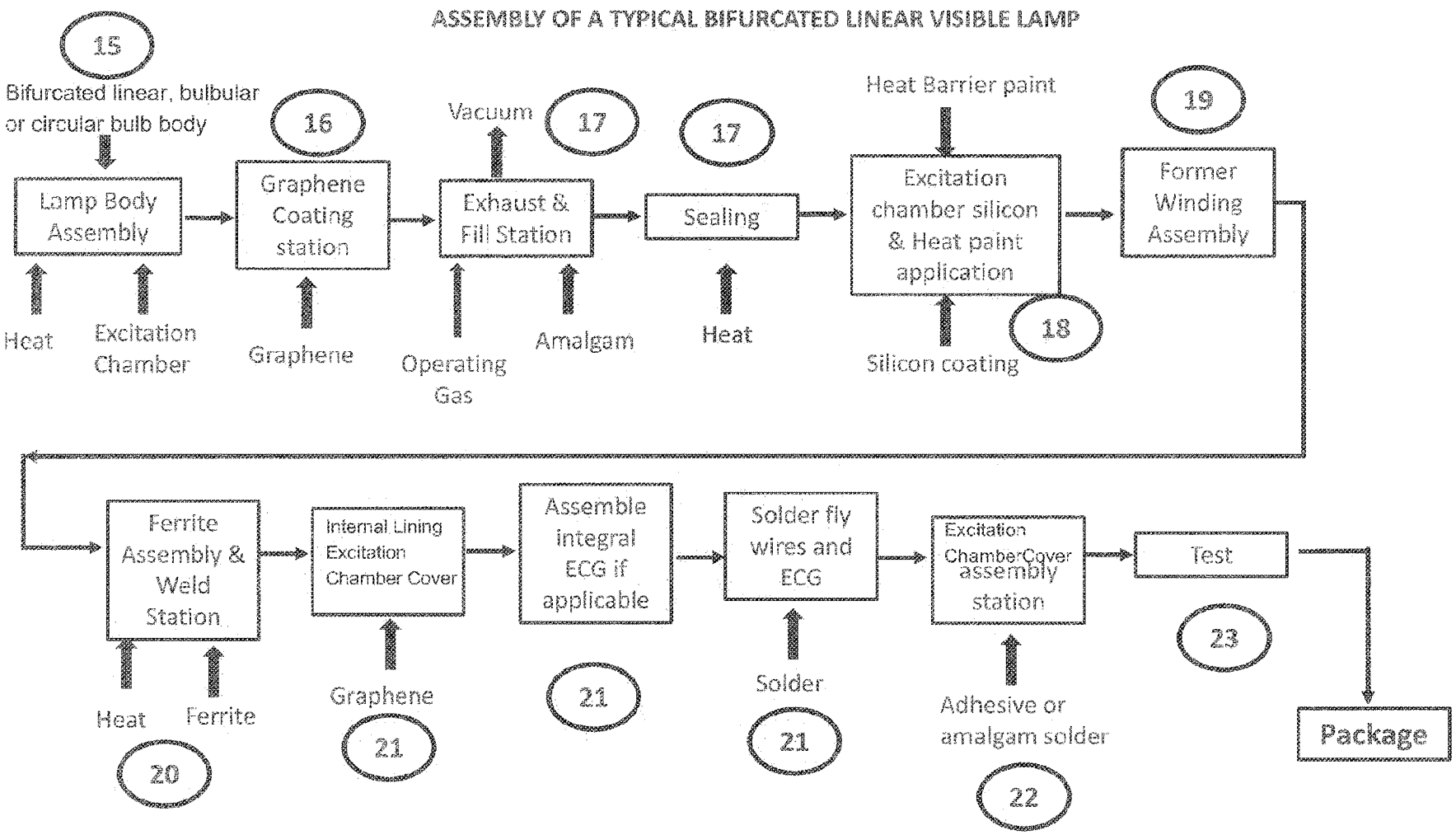

When assembled with a coil, two half ferrite cores 300, or 310, form an electromagnet 400 as is illustrated in FIGS. 50 to 102, for use with a lamp, such as the lamp 1000.

Preferably the coils of wire, which form the electromagnet 400, are formed and positioned at opposed locations on the centrally located diametrical portion made from two opposed central portions 302.

The electromagnet 400 formed from such a rounded double E geometry produces a toroidal dipole electromagnet design that enables plasma excitation advantages previously not possible with current toroidal electromagnet design. These include:

- improved lamp system efficiency as one field winding effectively energises two parts of the excitation chamber;
- improved electromagnetic field coupling efficiency between the excitation field and the plasma current generated; this enables a cooler ferrite electromagnet therefore a smaller more efficient electromagnet due to less heating from the plasma current of the lamp;
- improved ferrite core design, provides greater surface area to interface with the gas discharge that enables smaller discharge tubes to be used, hence physically smaller tubular lamps;
- improved ferrite core design enables a smaller electromagnet core of less weight and cost;

reduced electromagnetic interference due to the enclosed field winding by the electromagnetic core; and the reduced size ferrite core improves light utilisation of the lamp.

The improvements to the plasma excitation electromagnet 400, from the compounded improvements in the spool 500, 510, and coil 600, 610, the ferrite core 300, 310 etc., is that it enables an improved electromagnetic circuit design whereby the electromagnets 400 and excitation chambers 200, 210, 220, 230, can be provided within the footprint or envelope (when viewing down the axial length of the tubular bulb or straight cut tubes) or the within the cross sectional area through a solid of revolution created by revolving the tubular bulb or two straight cut tubes, around a central longitudinal axis of the assembly.

Core Spool—Collapsible Field Winding Mounting Former

In order to assist with the assembly of the electromagnet 400 with and through the excitation chambers 200, 210, 220 and 230, a field winding mounting former or spool 500 has been developed, and is now described in more detail with reference to FIGS. 35 to 49.

Figure 36:
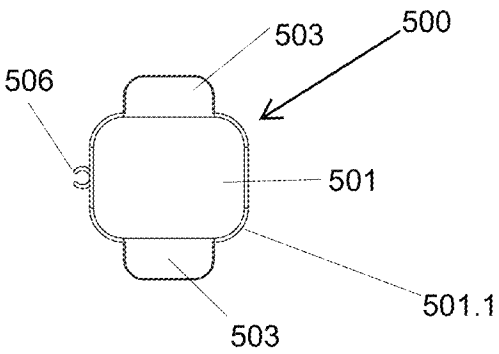
FIG. 36 illustrates an end view of the spool of FIG. 35.
Figure 37A:
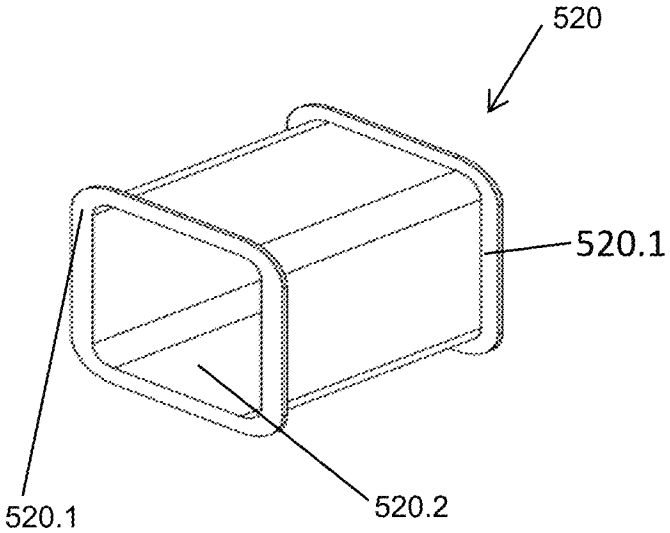
FIG. 37A illustrates a perspective view of a hollow square or rectangular spool to form a coil for use with ferrite core of FIGS. 41 to 43, and excitation chamber assembly of FIGS. 62A to 62C.
Figure 37:
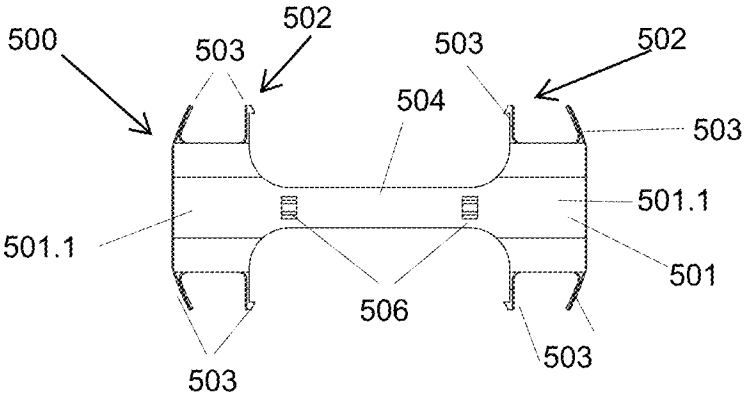
FIG. 37 illustrates a side view of the spool of FIG. 35.
Figure 35:
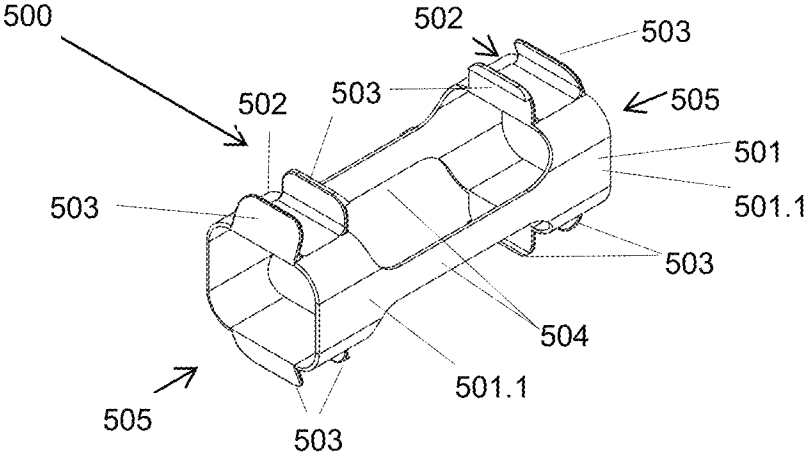
FIG. 35 illustrates a perspective view of a winding spool for an electromagnet.

Illustrated in FIGS. 35 to 37 is a spool 500 for an electromagnetic field coil for an electromagnet. The spool 500 has a body 501 comprising a generally tubular elongated construction which extends in the axial directions of a central aperture 505 and has at least one winding saddle 502, in this case two winding saddles 502, on a respective end of the body 501. The saddles 502 are formed on the outside of the body 501 so as to coil or wind a wire 601, 602 to form a coil 600 (as illustrated in FIGS. 44 to 46). The spool 500 includes at least one end 501.1 which is deformable allowing the spool 500 and the coil 600 to be manipulated for threading through the space or gap 203 on an excitation chamber 200, 210, 220, 230 being a tubular component of a lamp/excitation chamber.

In the event of only one winding saddle 502 or a coil 601 or 602 at only one end of the core spool, then the core spool may or may not have the ability to deform at least one end of 501.1.

The ends 501.1 are of a generally square ring shape and at the upper and lower edges of the ring shape end 501.1 are four vertically extending coil retaining flanges 503. The ends 501.1 are interconnected by pair of spaced axially extending arms 504. On the outboard side of one of the arms 504 is located a wire holder formation 506, which will hold a wire segment 603 of the coil 600, which extends between the coils 601 and 602. The ends 501.1 and the saddles formed by the vertically extending coil retaining flanges 503, will allow a coil of the shape of coil 600 to be formed.

In the event of a coil only being present at one end of the core spool then the wire holder formation 506 may or may not be included.

The body 501 has the aperture 505 through it, so that the middle portion 302 of ferrite cores 300 and 310 can be situated therein in a final assembly.

The body 501 is manufactured from relatively thin sections of polymeric material such as Mylar or polyester, and thus has relatively little weight. The skeletal nature of the body 501 also contributes to this relatively low weight. Additionally, the relatively thin structure of the ends 501.1 is such that, together with the large apertures in the body 501 between the ends 501.1, allows the ends 501.1 to collapse by compressive forces by squeezing the upper and lower sides of the ends 501.1. When a coil 602 or 601 is located therein, this too will collapse, lowering the profile of the end 501.1 and the coil 601 or 602, so that they can be pushed through, or squeezed through, the space or gap 203 on the excitation chambers 200, 210, 220, 230. Once in position, so that coil 601 and 602 are on either side of the space or gap 203, the ends 501.1 can return to their original shape by material memory, or formations provided which may assist this, or be returned to their original shape by means of insertion of the ferrite core portion 302.

The deforming of the ends 501.1 can occur prior to, or during, insertion of a core portion 302 for the electromagnet 400.

In an alternative embodiment of the spool 500, the spool can be of much the same skeletal form, but one or both ring ends 501.1 can be made rotatable or pivotal with respect to the arms 504, so as to be rotatable about an axis lateral to the direction of elongation of the body 501. This will allow the coil 601 or 602 to be pivoted or rotated, thus changing the profile of the coil with respect to passage through the space or gap 203, allowing thereby to be pushed through the gap 203.

The deformation of the ends 501.1 can be by elastic deformation or plastic deformation. If elastic it may resume its shape of its own accord, or if plastic, then assistance to regain its shape is required by later assembly processes, such as by insertion of a core portion 302 of the electromagnet 400.

Figure 39:
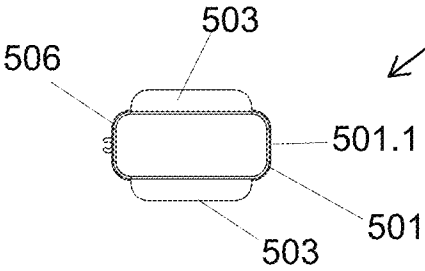
FIG. 39 illustrates an end view of the spool of FIG. 38.
Figure 40:
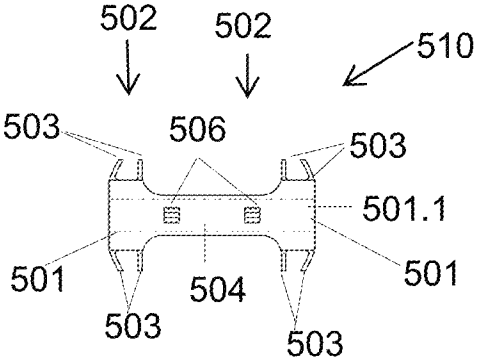
FIG. 40 illustrates a side view of the spool of FIG. 38.
Figure 38:
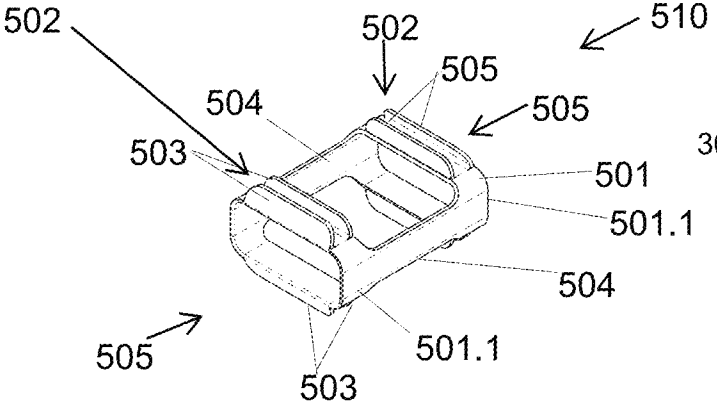
FIG. 38 illustrates a perspective view of another winding spool for an electromagnet.

Illustrated in FIGS. 38 to 40 is another spool 510, which is similar to that of spool 500 and like parts have been like numbered. The spool 510 is especially useful with the excitation chamber 200 and 210 of FIGS. 16 to 21. The spool 510 differs only in overall dimensions by comparison to the spool 500.

Figures 60, 61, 62, 62A, 62B, 62C:
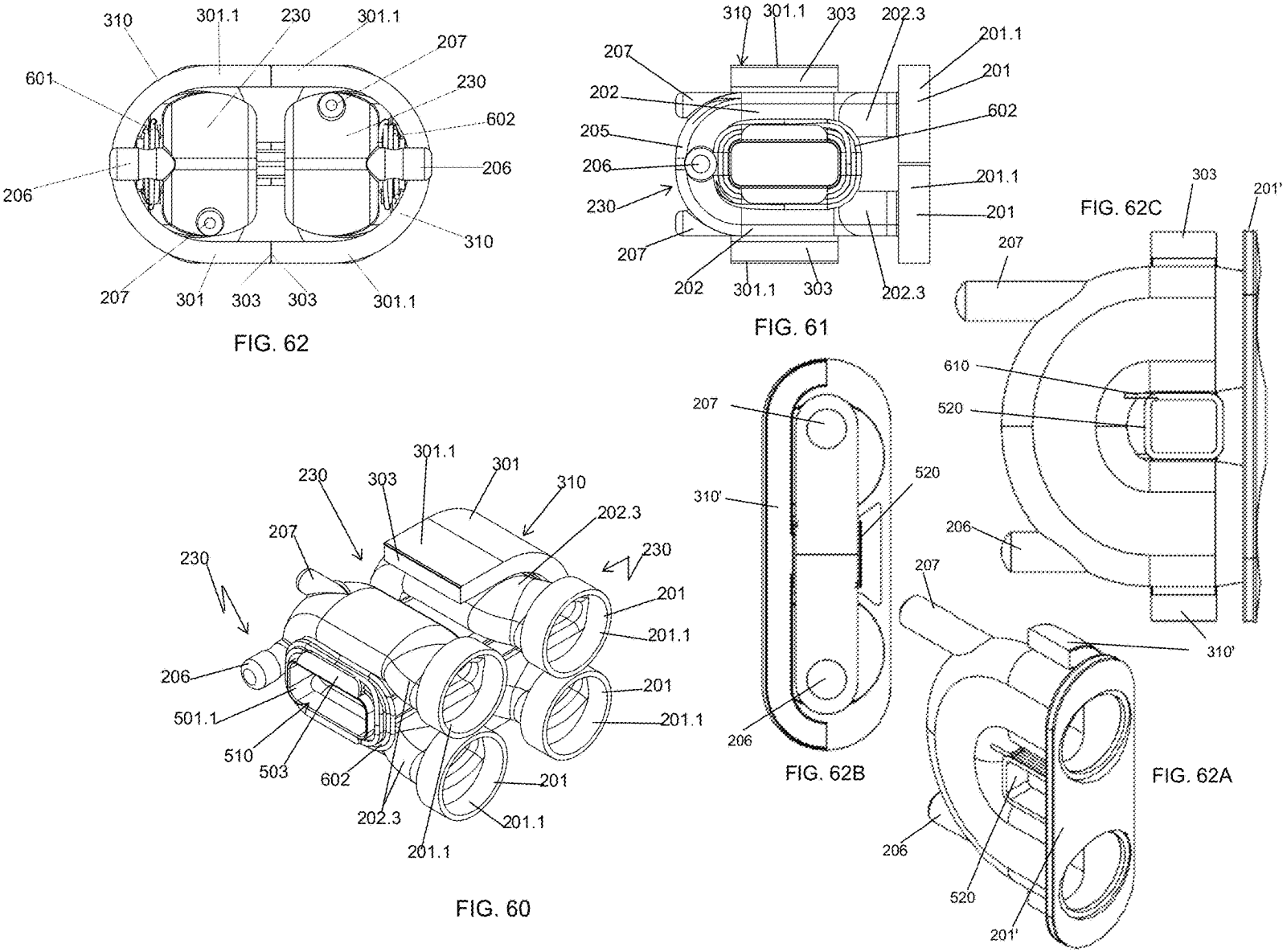
FIG. 60 illustrates a part section perspective view of another sub-assembly of a ferrite core half, spool and coil assembly with two excitation chambers present and the other half of ferrite core removed for illustration purposes.
FIG. 61 illustrates a side view of the sub-assembly of FIG. 60.
FIG. 62 illustrates an end view of the sub-assembly of FIG. 60.
FIG. 62A illustrates a part section perspective view of another sub-assembly of a ferrite core half (as illustrated in FIGS. 27E to 27H), spool and coil assembly and the other half of ferrite core removed for illustration purposes.
FIG. 62B illustrates a rear view of the sub-assembly of FIG. 62A.
FIG. 62C illustrates a side view of the sub-assembly of FIG. 62A.

Illustrated in FIG. 37A is a rectangular hollow spool 520, which can be used to from a coil 610 for use with the ferrite core of FIGS. 41 to 43, and then used in the excitation chamber assembly of FIGS. 62A to 62C. The spool 520 may be more cost effective to make than the spools 500 and 510, due to its relatively simple shape and construction. It will be noted that in this configuration the spool 520 does not provide specific saddles on its form, unlike the spools 500 and 510, which adds to their complexity. In this instance the spool 520 has peripheral lips 520.1 at each end and a hollow middle 520.2 which allows core portions 302 to pass into the spool 520. If desired the spool 520 can also be made without the peripheral lips 520.1. The spool 520 provides the advantage that the coil 610 can be wound on either end as is the case in FIG. 92 or FIG. 114 and, or if it is desired, across the whole length of the spool 520, that is between the rims 520.1, as in the case of FIG. 92, FIG. 97 or FIG. 101B, depending upon the excitation chamber requirements.

The coils 600 and 610 which can be formed on the spools 500, 510, and 520, can be formed so as to make coil segment 601 and 602 so that appropriately sized and insulated wire, as would be commonly known to a skilled person, can be wound thereon with as many windings as needed, depending upon the characteristics, such as strength and field shape, of the magnetic field that needs to be generated to create an appropriate level of induction in the excitation chamber.

By providing the coils 601 and 602 at spaced locations along the central portion of the ferrite cores 300, 310 and 310', and not the whole way along that central portion, facilitates heat dissipation and optimises use of the available excitation chamber.

Excitation Chamber and Electromagnet Assembly or Sub-assembly

Illustrated in FIGS. 50 to 53 is a series of illustrations of an assembly of the excitation chamber 200, with core 300, spool 500 and coil 600, forming electromagnet 400, for the lamp assemblies of FIGS. 69 to 88. It will be noted in the subassembly of FIGS. 50 to 53, that the ferrite cores 300 are adjacent to the mounting flange 201, encapsulating the excitation chamber, which allows an excitation chamber cover 700 (see description below) to be readily placed over the electromagnet 400 and excitation chamber 200, and allowing the rim of the cover 700 to be readily sealed to the outer rim of the mounting interface 101 of tubular bulb 100.

Figure 55:
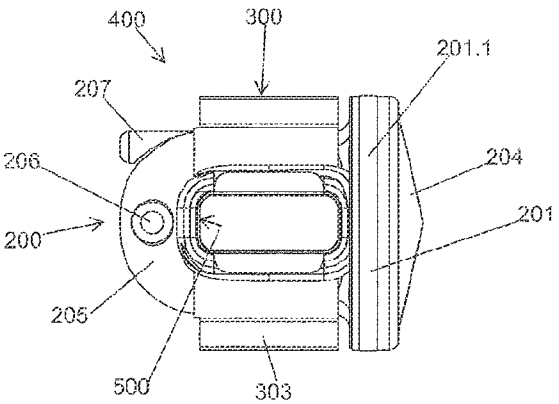
FIG. 55 illustrates a side view of the sub-assembly of FIG. 54.
Figure 56:
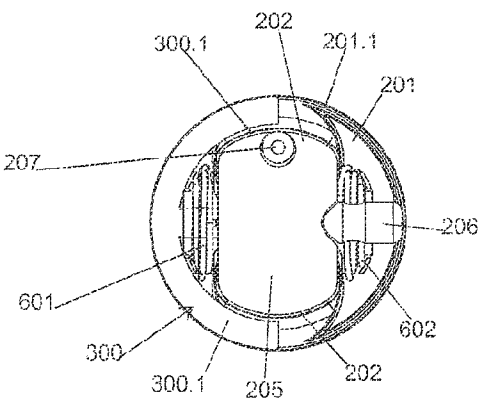
FIG. 56 illustrates an end view of the sub-assembly of FIG. 54.
Figure 54:
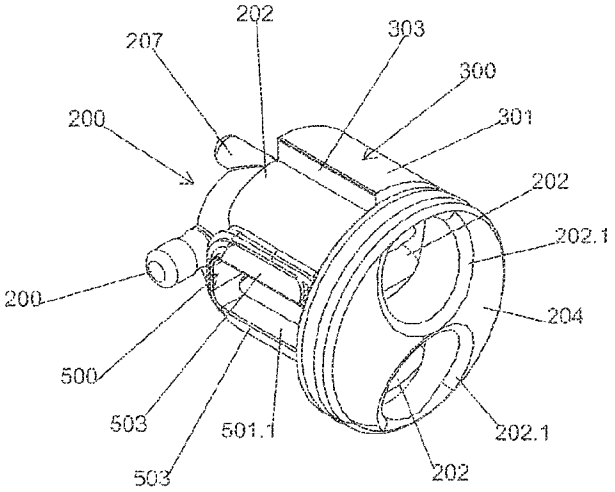
FIG. 54 illustrates a part section perspective view of a further sub-assembly of a ferrite core half, spool and coil assembly with excitation chamber present and other half of ferrite core removed for illustration purposes.

Illustrated in FIGS. 54 to 56 is a series of illustrations of an assembly of the excitation chamber 210, with core 300, spool 510 and coil 600, forming electromagnet 400, which forms an alternative subassembly that can be used with lamp assemblies of FIGS. 89 to 97 where lamps are using straight or U-Tube constructions.

Figure 58:
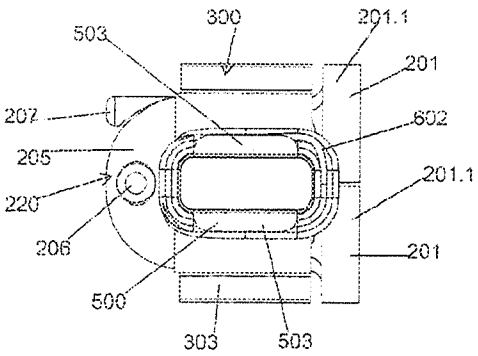
FIG. 58 illustrates a side view of the sub-assembly of FIG. 57.
Figure 59:
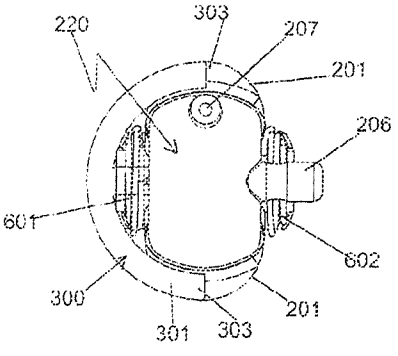
FIG. 59 illustrates an end view of the sub-assembly of FIG. 57.
Figure 57:
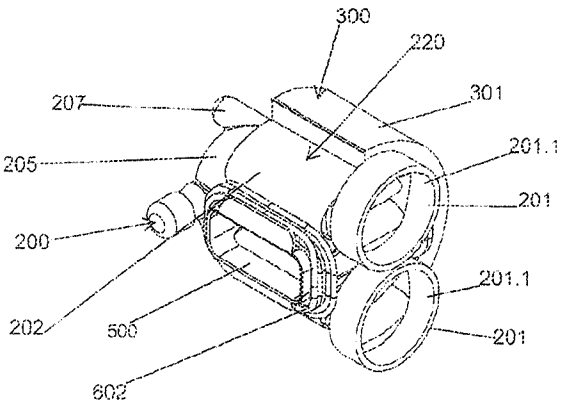
FIG. 57 illustrates a part section perspective view of another sub-assembly of a ferrite core half, spool and coil assembly with excitation chamber present and other half of ferrite core removed.

Illustrated in FIGS. 57 to 59 is a series of illustrations of an assembly of the excitation chamber 220, with core 300, spool 500 and coil 600, forming electromagnet 400, for the lamp assemblies of FIGS. 89 to 97.

Illustrated in FIGS. 60 to 62 is a series of illustrations of an assembly of the excitation chamber 230, with core 310, spool 510 and coil 610, forming electromagnet 400, for the circular or toroidal lamp assembly of FIGS. 98 to 101.

It will be noted from FIG. 62 that the excitation chambers are each designated 230, with the one on the left in FIG. 62 being installed in an inverted condition by comparison to the excitation chamber 230 on the right in FIG. 62. This locates the evacuation tube 207 on the left chamber 230 at the bottom, and the amalgam housing 206 also on the outside of the assembly.

Figure 101C:
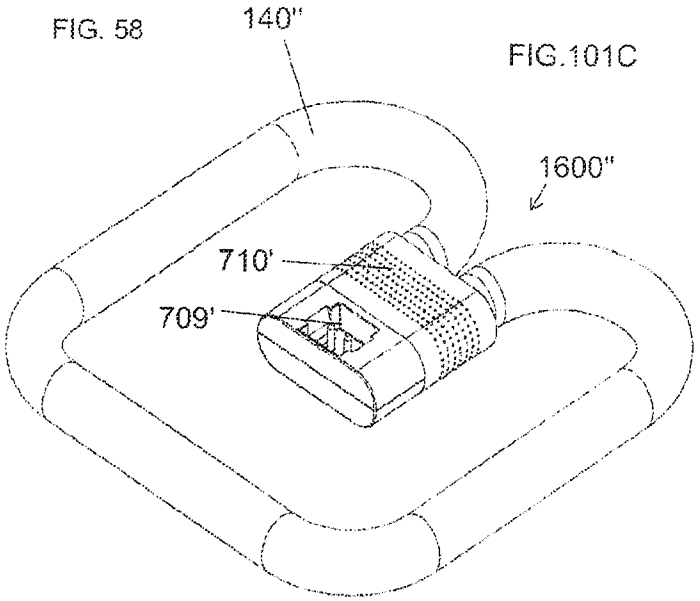
FIG. 101 illustrates a detail perspective view of the cap of lamp assembly of FIG. 98.
Figure 101:
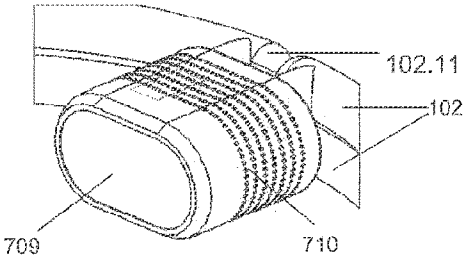
Figures 101A, 101B:
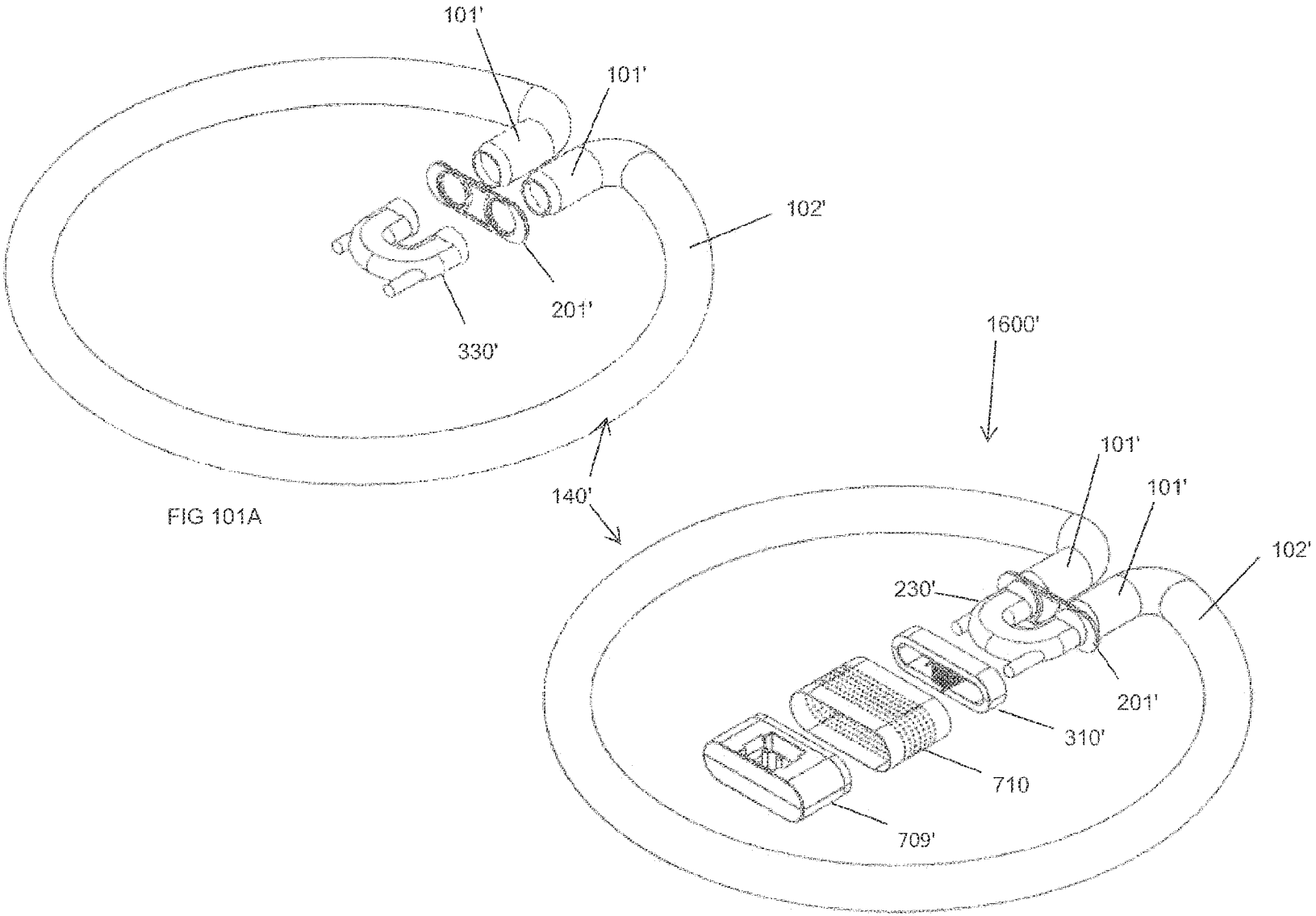

Illustrated in FIGS. 62A to 62C is a series of illustrations of an assembly of the excitation chamber 230', with core 310', a generally rectangular spool and coil, forming electromagnet 400', which can be used with a circular or toroidal lamp assembly of FIGS. 101A to 101C, or with others as described above.

It will be also noted from FIG. 62 that each excitation chamber 230 has only respectively, one coil 601 or 602 located on one side only. While the description of previous embodiments generally positions a coil 601 and 602 on either side of an excitation chamber, this is only done as a preference, and only a single coil need be provided to a single side of any excitation chamber 200, 210, 220, 220', 230 or 230' described herein, if desired.

FIGS. 50 to 62C show the finished positions of the components mentioned above. It will be noted in all of FIGS. 50 to 62C, that a space or gap is present between the upper surface of the upper tube of the excitation chambers and the under surface of the upper parts of the ferrite half cores 300, and between the lower surface of the lower tube of the excitation chambers and the upper surface of the lower parts of the ferrite half cores 300. In production these spaces or gaps will be filled with an expanding foam or silicone product, or equivalent product, so that no relative movement between the excitation chambers and the ferrite cores can occur.

Excitation Chamber Cover—Passive Heatsink & Faraday Cage

Figure 64:
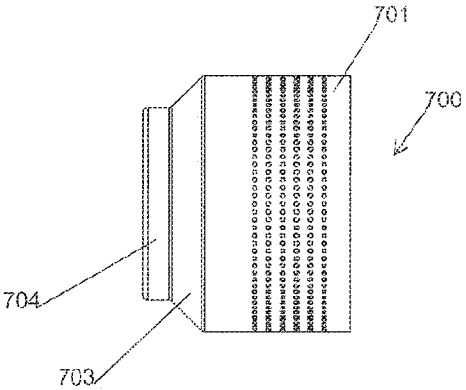
FIG. 64 illustrates a side view of the excitation chamber cover of FIG. 63.
Figure 63:
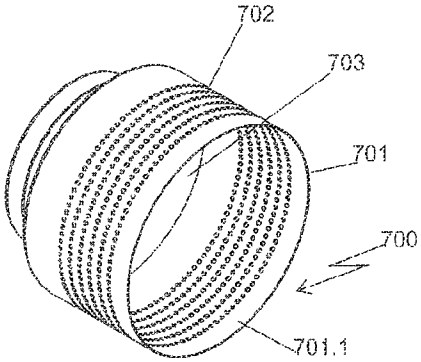
FIG. 63 illustrates a perspective view of an excitation chamber cover.
Figure 65:
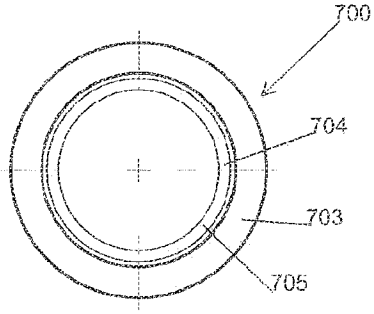
FIG. 65 illustrates an end view of the excitation chamber cover of FIG. 63.

Illustrated in FIGS. 63 to 65 is lamp excitation chamber cover 700 for a lamp such as lamp 1000, which is an electrodeless radio frequency powered external closed core electromagnetic inductively coupled low pressure gas discharge light source. The excitation chamber cover 700 includes a wall segment 701 manufactured from a metal, this wall segment 701 being coated on an interior surface 701.1 with graphene.

The wall segment 701 includes an array of apertures 702 there through. That is each hole or aperture in the array passes through the wall segment 701. While a distinctive linear or line based array of holes is utilised in the illustrations of FIGS. 63 and 64, it will be understood that any appropriate pattern, or random placement of holes, or groupings of holes, will perform a similar function. Even if randomly placed, the holes may be considered to be in a random array or series.

The wall segment 701 is continuous and circular, that is generally cylindrical. But any shape, according to manufacturers or market needs could be utilised such as partially circumferential; box shape; square shape; rectangular shape.

The interior surface 701.1 of the excitation chamber cover 700 can be coated with graphene, to assist it to perform its functions, as described below.

While the excitation chamber cover 700 is preferably made wholly of metal, it may be possible to have a plurality of segments such as a metallised polymeric excitation chamber cover formation, making a composite excitation chamber cover. Alternatively the excitation chamber cover may be constructed of any material including a polymer or composite or other material capable of conducting an electric charge.

The excitation chamber cover 700 has a tapered section 703 at its base which turns down to the base flange 704 which has a radial flange 705, leaving an opening in the base of the excitation chamber cover 700. The excitation chamber cover 700 receives in its base a polymeric disc 709 (visible in FIG. 73), which includes a plug and lamp holder cap and or electric terminals 709.1 (see also FIG. 73) for connecting an assembled lamp to a supply of electricity.

The excitation chamber cover 700 includes or functions as one or both of a faraday cage and a passive heat sink. It provides cooling of a ferrite core of an electromagnet and thus additionally provides thermal stability to an amalgam housing 206 and thus provides a stable temperature environment, by controlling air flow around the at least one excitation chamber. It additionally provides physical protection to components and any integral lamp controller electronics included within the excitation chamber cover or the lamp holder cap; is a means or mounting point for a lamp holder cap; and provides a bonding point for the bulb.

The heatsink and faraday cage formed by the excitation chamber cover 700 together with a graphene coating on the glass tubular bulb, and optionally the excitation chamber(s), enables a charged surface to be generated that will attenuate generated radio frequencies emitted from the assembled lamp when in operation.

Figure 67:
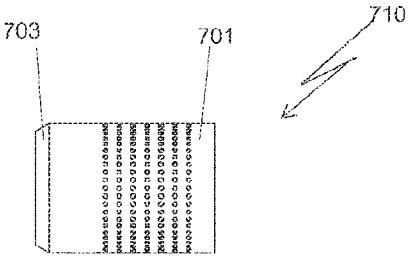
FIG. 67 illustrates a side view of the excitation chamber cover of FIG. 66.
Figure 66:
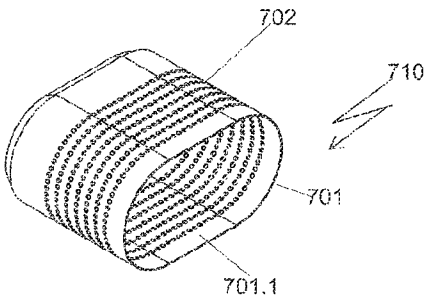
FIG. 66 illustrates a perspective view of another excitation chamber cover.
Figure 68:
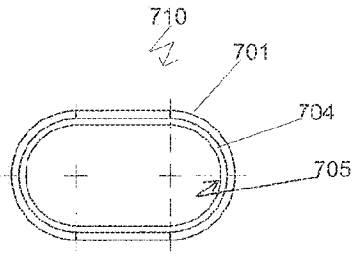
FIG. 68 illustrates an end view of the excitation chamber cover of FIG. 66.
Figure 77:
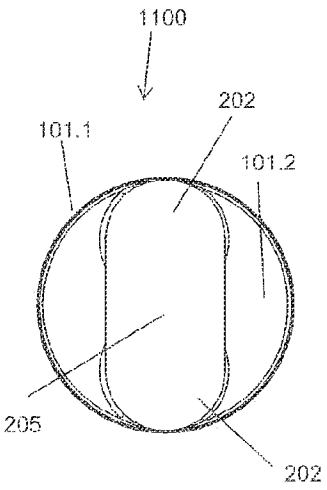
FIG. 77 illustrates a bulb end view of the lamp assembly of FIG. 74
Figure 74:
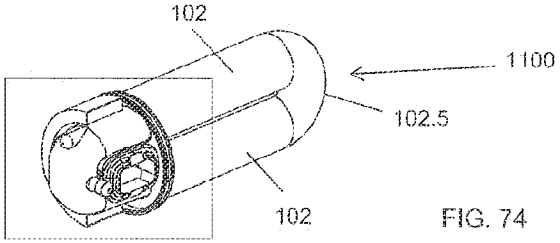
FIG. 74 illustrates a perspective view of a lamp assembly embodying the components of previous figures having a tubular bulb body of FIGS. 4 to 6, and an excitation chamber/spool/core/coil/excitation chamber cover sub-assembly at one end with one excitation chamber cover, and one ferrite core half, removed for illustration purposes.
Figure 75:
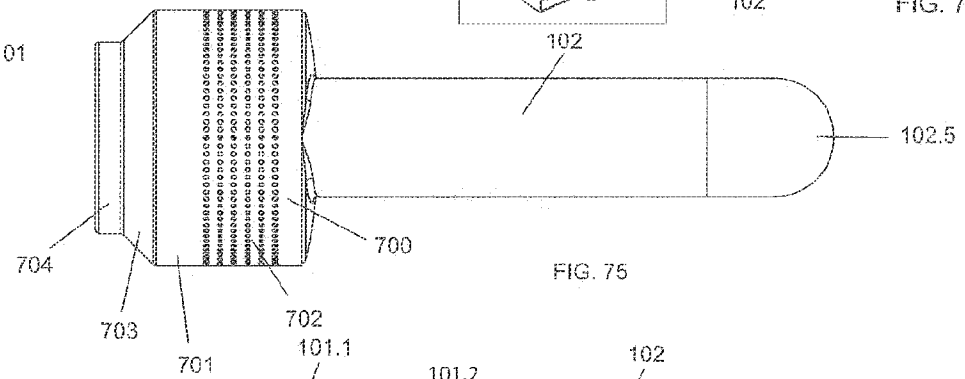
FIG. 75 illustrates a plan view of the lamp assembly of FIG. 74 with excitation chamber cover present.
Figure 76:
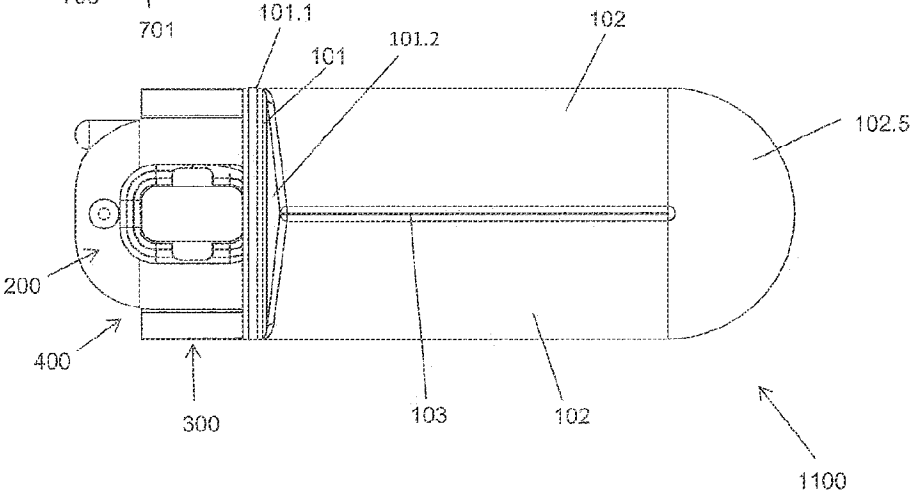
FIG. 76 illustrates a side view of the lamp assembly of FIG. 74 with excitation chamber cover, and one ferrite core half, removed for illustration purposes.
Figure 78:
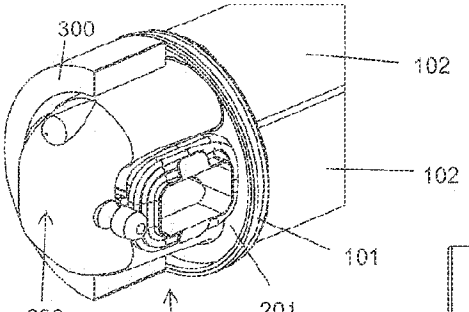
FIG. 78 illustrates a detail perspective view of the excitation chamber end of the lamp assembly of FIG. 74 with excitation chamber cover, and one ferrite core half, removed for illustration purposes.
Figure 79:
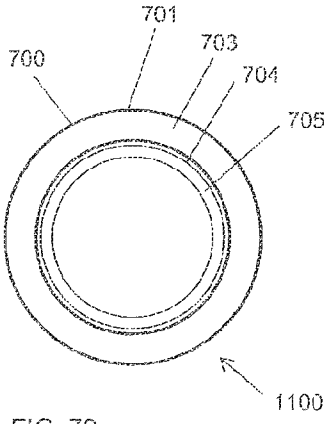
FIG. 79 illustrates a excitation chamber cover end view of the lamp assembly of FIG. 74 with excitation chamber cover absent.
Figure 80:
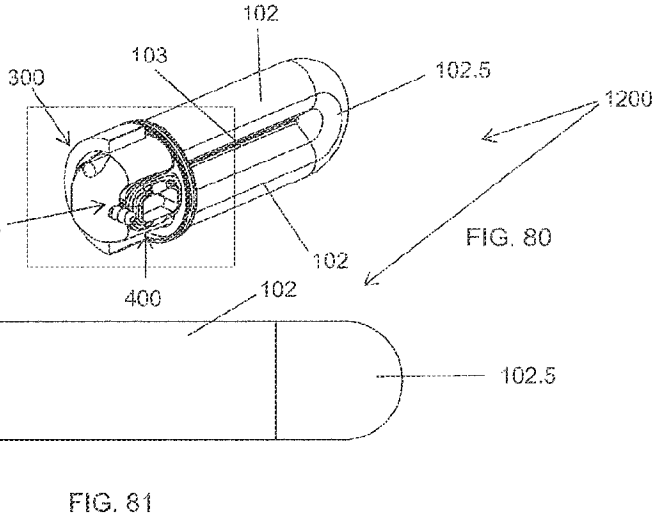
FIG. 80 illustrates a perspective view of a lamp assembly embodying the components of previous figures having a tubular bulb body of FIGS. 10 to 12, and an excitation chamber/spool/core/coil/excitation chamber cover sub-assembly at one end with excitation chamber cover, and one ferrite core half removed for illustration purposes.
Figure 81:
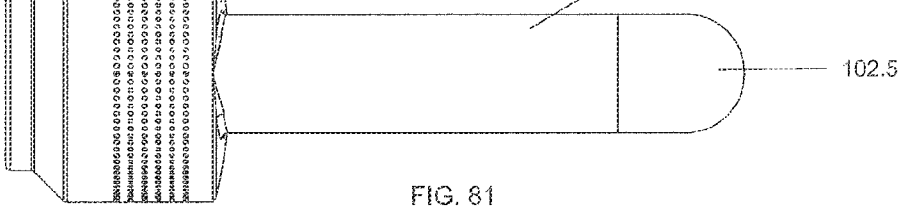
FIG. 81 illustrates a plan view of the lamp assembly of FIG. 80 with excitation chamber cover present.
Figure 84:
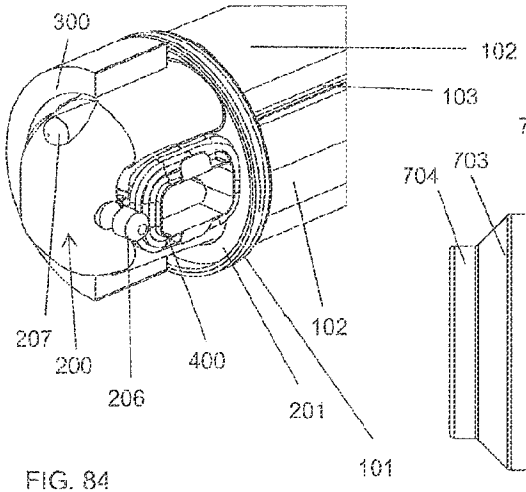
FIG. 84 illustrates a detail perspective view of the excitation chamber cover end of lamp assembly of FIG. 80 with excitation chamber cover, and one ferrite core half, removed for illustration purposes.
Figure 83:
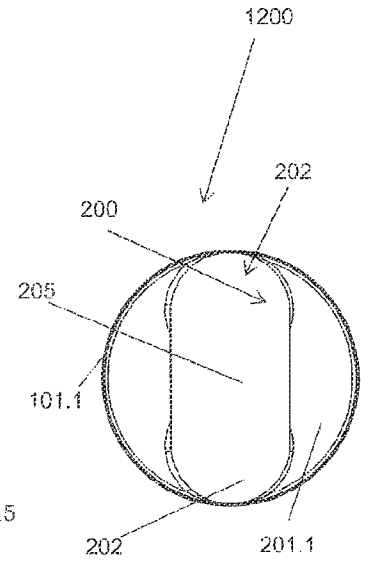
FIG. 83 illustrates a bulb end view of the lamp assembly of FIG. 80
Figure 82:
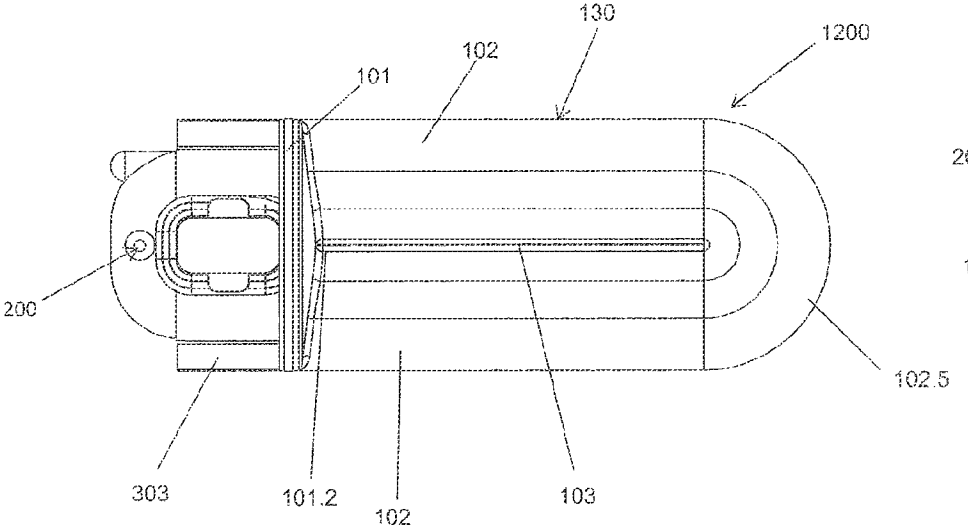
FIG. 82 illustrates a side view of the lamp assembly of FIG. 80 with excitation chamber cover, and one ferrite core half, removed for illustration purposes.
Figures 85, 86, 87, 88:
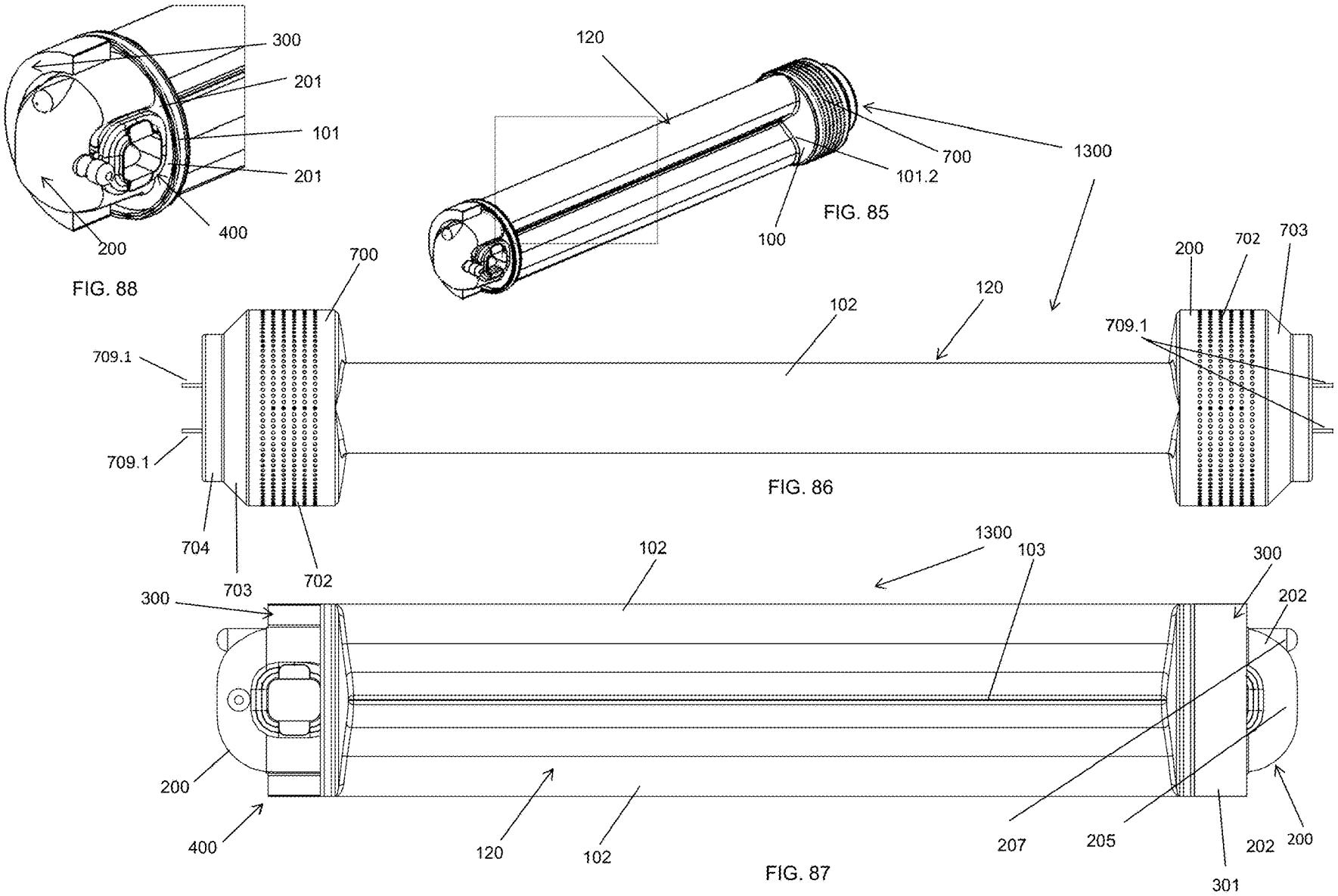
FIG. 85 illustrates a perspective view of a further lamp assembly embodying the components of previous figures having a tubular bulb as illustrated in FIGS. 7 to 9, and an excitation chamber/spool/core/coil/excitation chamber cover sub-assembly at both ends with one excitation chamber cover, and one ferrite core half, removed for illustration purposes.
FIG. 86 illustrates a plan view of the lamp assembly of FIG. 85 with both excitation chamber covers present.
FIG. 87 illustrates a side view of the lamp assembly of FIG. 85 with both excitation chamber covers, and one ferrite core half, removed for illustration purposes.
FIG. 88 illustrates a detail perspective view of a excitation chamber cover end of lamp assembly of FIG. 85 with excitation chamber cover, and one ferrite core half, removed for illustration purposes.
Figure 92:
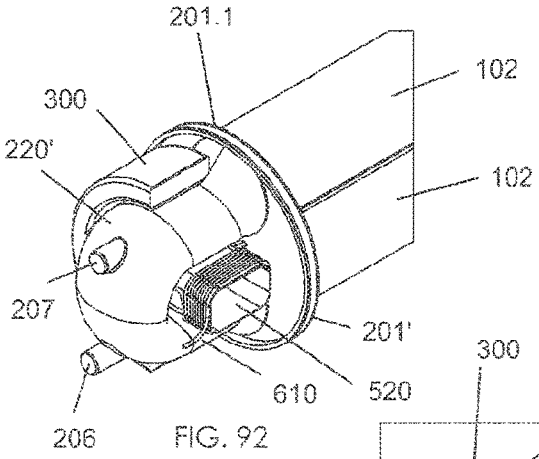
FIG. 92 illustrates a detail perspective view of excitation chamber end of lamp assembly of FIG. 89 with excitation chamber cover, and one ferrite core half, removed for illustration purposes.

Illustrated in FIGS. 66 to 68 is a second lamp cap 710, which is similar to that of an excitation chamber cover 700 and like parts have been like numbered. The excitation chamber covers 700 and 710 differ only in general shape in that the excitation chamber cover 710 is of an obround shape which is used to match the obround nature of the assembled ferrite cores 310 of the electromagnet 400 of FIGS. 60 to 62, for use with the tubular bulb 140 of FIGS. 13 and 13A, and the lamp assembly of FIGS. 98 to 101.

A another excitation chamber cover 710' is Illustrated in FIG. 101B and 101C , which is similar to that of excitation chamber cover 710. The excitation chamber covers 710 and 710' differ only in that the excitation chamber cover 710' is for use with the tubular bulb 140' of FIGS. 14 and 14A, or square tube 140" of FIG. 101C and the lamp assembly 1600' and 1600" of FIGS. 101A to 101C, and must be shaped on its side away from the bulb to receive an obround lamp holder and with recessed connectors, at –34-pprox. 90 degrees to the plane of the bulb, as illustrated in FIG. 101C.

Lamp Assembly

Illustrated in FIGS. 69 to 101C are assembly illustrations for the different configurations of lamps that are possible from the above described components.

FIGS. 69 to 73 illustrates a lamp assembly 1000, being a double ended lamp, made from the tubular bulb 100 with tubes of circular cross section, and at both ends, an excitation chamber 200 or 210, two ferrite cores 300, spool 500, coil 600 to form electromagnet 400, covered at both ends by a cover 700, which respectively seal to the outer rims of the bulb mounting flanges 101.

FIGS. 74 to 79 illustrates a lamp assembly 1100, being a single ended lamp, having the tubular bulb 110 with tubes of circular cross section, and at one end an excitation chamber 200 or 210, two ferrite cores 300, spool 500, coil 600 to form electromagnet 400, covered at its end by a excitation chamber cover 700, which is sealed to the outer rim of the bulb mounting flange 101.

FIGS. 80 to 84 illustrates a lamp assembly 1200, being a single ended lamp, having the tubular bulb 130 with opposed piriform cross section (which may also be described as being of a sextic form), and at one end an excitation chamber 200 or 210, two ferrite cores 300, spool 400, coil 600 to form electromagnet 400, covered at its end by a excitation chamber cover 700, which is sealed to the outer rim of the bulb mounting flange 101.

FIGS. 85 to 88 illustrates a lamp assembly 1300, being a double ended lamp, made from a bifurcated bulb 120, with opposed piriform cross section and at both ends, an excitation chamber 200 or 210, two ferrite cores 300, spool 500, coil 600 to form electromagnet 400, covered at both ends by a excitation chamber cover 700, which respectively seal to the outer rims of the bulb mounting flanges 101.

FIGS. 89 to 93 illustrate a lamp assembly 1400, being a double ended lamp, made from two straight cut cylindrical glass tubes to form the tubular bulbs, and at both ends, an excitation chamber 220 into which the tubes fit directly, two ferrite cores 300, spool 500, coil 600 to form electromagnet 400, covered at both ends by excitation chamber cover 700, each of which respectively seals to the outer rim of the ferrite core 300. This lamp 1400 incorporates two plasma excitation chambers 220 as required for a double ended lamp so that the tubes 102 interface with the excitation chamber cavities to create a gas tight seal. The lamp 1400, as best illustrated in FIG. 89 includes a fascia cap 702.1 through which is passed the glass tubes 102, before they are fused to the excitation chamber 220. The fascia cap 702.1 can be secured to or sealed with the inside rim of the excitation chamber cover 700. A similar fascia cap 702.1 will be present on the other side, but has been removed for illustration purposes. The fascia cap 702.1 can be provided for aesthetic reasons, and as such can be optional. In the case of visible light lamps such fascia caps 702.1 may be required to act as a shield to prevent emission of electromagnetic radiation from the excitation chamber.

FIGS. 94 to 97 illustrates a lamp assembly 1500, being a single ended lamp made from two straight cut cylindrical glass tubes to form the tubular bulbs, and at one end, an excitation chamber 220 into which the tubes fit directly, two ferrite cores 300, spool 500, coil 600 to form electromagnet 400, covered at its end by excitation chamber cover 700, which seals to the outer rim of the adjacent bulb mounting flange 101. This lamp 1500incorporates one plasma excitation chamber 220, as a shaped bent tube with flared ends which physically integrates into a pair of circular tubular bulb ends of a U-tube for a single ended lamp, so that the tubes interface with the excitation chamber cavities to create a gas tight seal whilst maintaining the same plane of the parallel tube bulb.

FIGS. 98 to 101 illustrates a lamp assembly 1600 being a ring shaped tubular lamp made from the bulb 140, to which has been assembled an excitation chamber 230, in the manner illustrated in FIGS. 60 to 62. Also assembled is the spool 510 with coil 610 to form an electromagnet 400, and this is all covered by a excitation chamber cover 710, which seals to the outer surface of the ferrite core assembly.

In the lamp 1600, tube 102 of the bulb 140 is connected to the excitation chamber 230, so that only a single ionization gas circuit is produced. If desired, the excitation chambers 230 can be oriented and connected to the mounting flanges 101 on tubes 102, so that the upper tube 102 is in a separate circuit to that of the lower tube 102.

Illustrated in FIGS. 101A to 101B is a lamp 1600' which is similar to lamp 1600 of lamp 98 to 100, except that the bulb is comprised of a single tube. Other differences include that the wires from the coils of the electromagnet or two and from the power controllers, are connected to terminals 709.1 behind the cover 710', which are located in a cavity 709.2 as best seen in FIG. 101C, which are at right angles to the plane of the bulb.

Illustrated in FIG. 101C is a lamp 1600", which is similar to that of FIGS. 101A and 101B, except that the circular or part toroidal bulb 140' is replaced by a square tubular bulb 140".

FIGS. 104 to 108 illustrate a lamp assembly 1700, being a double ended lamp, made from two straight cut cylindrical glass tubes 102 to form the tubular bulbs, and at both ends, an excitation chamber 210 into which the tubes fit directly, two ferrite cores 300, spool 500, coil 600 to form electromagnet 400, covered at both ends by excitation chamber cover 700, each of which respectively seals to the outer rim 201.1 of the excitation chamber 210. The lamp 1700 is similar in construction to the lamp 1500 of FIGS. 89 to 93, except that the excitation chamber 210 is utilised. This lamp 1700 incorporates two plasma excitation chambers 210 as required for a double ended lamp so that the tubes 102 interface with the excitation chambers' cavities to create a gas tight seal.

FIGS. 109 to 113 illustrate a lamp assembly 1800, being a single ended lamp, made from two straight cut cylindrical glass tubes 102 to form the tubular bulbs, and at one end, an excitation chamber 210 into which the tubes fit directly, two ferrite cores 300, spool 500, coil 600 to form electromagnet 400, covered at its end by cover 700, which seals to the outer rim 201.1 of the excitation chamber 210. The lamp 1800 is similar in construction to the lamp 1500 of FIGS. 94 to 97, except that the excitation chamber 210 is utilised. This lamp 1800 incorporates a single plasma excitation chamber 210 as required for a single ended lamp so that the tubes 102 interface with the excitation chamber cavities to create a gas tight seal.

FIG. 114 illustrates a lamp assembly 1400', which is similar to that of lamp assembly 1400 of FIGS. 89 to 92 as described above. The assembly 1400' has its right end in an exploded view, which shows the components of the excitation chamber 220' and intermediate flange 201' as described above, ferrite core 300, an elongated spool 520' like spool 520 described above, on which coils 600 or 610 are wound on the opposed ends, and a cover 700 and lamp holder 709. It will be noted from FIG. 114 that straight cut cylindrical tubes 102 are used for assembly to the intermediate flanges 201'.

While specific lamp types 1000, 1100, 1200, 1300, 1400, 1400', 1500, 1600, 1600', 1600", 1700 and 1800 are illustrated and described above, other combinations of components can be made. For example, electromagnet 400/dual excitation chamber 230 assembly of FIGS. 60 to 62 can be utilised with two U-shaped tubes with straight cut ends. If each U-shaped tube has its ends fitted to one excitation chamber 230, then a separate circuit will be formed in each U-shaped tube. Whereas if one end of one U-shaped tube is connected to a first excitation chamber, and the other end is on the second excitation chamber, and likewise for the second U-shaped tube, then a single circuit on a single ended lamp will be produced.

Additionally, the electromagnet 400 and dual excitation chamber 230 assembly of FIGS. 60 to 62 can be utilised with 4 separate straight tubes, each with one closed end and one open end. Further, if two assemblies of the electromagnet 400 and dual excitation chamber 230 assembly of FIGS. 60 to 62 were positioned opposite and facing each other, then respective opposed pairs of mounting flanges 201 can be joined to straight cut cylindrical shaped bulbs, making a four bulb double ended lamp, having two circuits. If one assembly of FIGS. 60 to 62 is instead rotated through 90 degrees, before connecting the tubes this will produce a double ended, four tube, single circuit lamp assembly.

The assembly procedure is schematically illustrated in FIG. 102, which needs to be read in conjunction with the following comments, the number of the comment, namely 15 to 23, being located in the flowchart of FIG. 15.

Comment 15: The completed bulb body e.g. 100, and excitation chambers e.g. 200, will be introduced to an assembly station where they will be positioned, held and fused, welded or otherwise joined together with heat to create the lamp body.

Comment 16: A graphene coating will be applied to the outer surface of the lamp body assembly, that is the tubular bulb e.g. 100 and excitation chamber e.g. 200.

Comment 17: A vacuum will be applied to the lamp body prior to the introduction of an operating gas, insertion of mercury or an amalgam, via the exhaust tube 207 and amalgam tube 206. The exhaust and amalgam tubes will be sealed to create an airtight lamp body.

Comment 18: A heat barrier coating will be applied to the excitation chamber ends. A silicon or similar compound will be applied to the excitation chamber in the areas which interface with the ferrite.

Comment 19: The core spool and winding will have been assembled and introduced as a complete assembly to the production line. The core spool with its integral winding will be partially collapsed or deformed in such a manner that it can be fed into the spacing or gap 203 between the tubes 202 of the U-Shaped sections of the excitation chambers e.g. 200 whereupon it will expand back, or be expanded back, to its designated shape.

Comment 20: The half ferrite cores e.g. 300 will be fed into either side of the aperture 505 of the spool e.g. 500 being the core spool/winding assembly and around the outer side of the excitation chamber e.g. 200. Care will be taken to not wipe away the silicon coating or similar coating which had been previously applied to the outer faces of the excitation chamber e.g. 200 where it passes through the half ferrite cores e.g. 300. The half ferrite cores 300 will be fused together, at their abutting ends 303 by heat, or laser welding etc. and or a conductive filler material if preferred by the manufacturer.

Comment 21: An excitation chamber cover 700 will be introduced to the assembly line and a lining of graphene applied to the internal face.

If the particular model of lamp includes an integral controller (Electronic Control Gear or ECG), then the ECG will be installed and mechanically affixed and electrically connected to and within the excitation chamber cover 700.

The end wires of the coils 601 and 602, commonly called fly wires will be soldered to the lamp holder cap electrical terminals, or in the case of an integral ECG, to the ECG which in turn will be connected to the lamp holder cap electrical terminals.

Comment 22: An adhesive or amalgam solder will be applied to the outer surface of the excitation chamber e.g. 201.1 in the area which will interface with the excitation chamber cover 700.

The excitation chamber cover 700 is fitted over the ferrite core outer surface and secured by means of adhesive or amalgam to the outer face of the excitation chamber lamp body.

Comment 23: The complete bifurcated lamp is now tested for technical and functional performance.

Variations to the above method will be needed according to which lamp assembly 1000, 1100, 1200, 1300, 1400, 1500, 1600, 1600', 1600", 1700 or 1800 is being manufactured.

Figure 103:
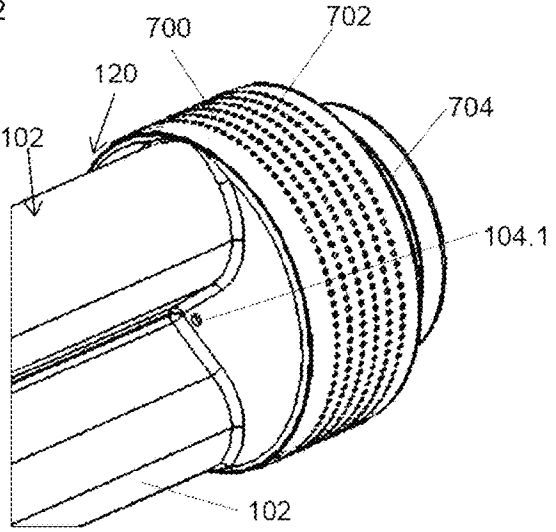

It will be noted that the double ended lamps 1000, 1300 and 1400, are each illustrated as being directly connected to electricity at each end. If desired, for these double ended lamps, as can be seen in FIG. 103 (see sheet 3/32 of the drawings), there can be provided an aperture 104.1 in and through the transition surface 101.2 on opposite ends of the lamp, which will permit the passage of a power take off conductor from the electrics of one end of the lamp to the other, ensuring that the lamp will only need connection to electricity at one end. If needed, a second pair of holes on the other side can be provided for a return conductor.

It will be noted from the above description, that dimensions are not provided, such as wall thickness, length or height or width of tubular bulb; diameter of tubes etc. This is because a person skilled in the art of bulb making, will according to what materials are used, what lamp characteristics are to be obtained, what machinery to make and assemble, will select such dimensions according to needs and conditions, and some trial and error may be required before selecting the dimension to be actually manufactured.

While in the above embodiments and their description, and in some of the claims below, there is utilised the expression "gas communication", it will be understood that this will include liquid communication if a liquid is included in substances held within the bulb. Further, once excited, the expression "gas communication" will include plasma communication to facilitate creation and or sustain plasma through the tubes and the excitation chambers.

Advantages and Benefits of the Lamp Assemblies

The above described lamp assemblies have some of the following benefits.

By locating the amalgam housing 206 behind the mounting flanges 101 and 201, and by utilising a relatively small thermally insulated excitation chamber e.g. 200 in such a manner that it is thermally isolated from the luminous radiation from the tubular bulb e.g. 100 of the lamp e.g. 1000 the amalgam housing will be thermally stabilised. The amalgam therefore operates more efficiently than currently occurs with existing induction lamp designs in the market place.

The deformable or collapsible spool e.g. 500 which is a field winding mounting former, enables automated precision field winding and collapses in such a manner to facilitate easy entry to the excitation chamber e.g. 200 entry aperture or gap 203, and thus a relatively fast, easy assembly during the manufacturing process.

The design of the lamps, enable miniaturisation of an electrodeless lamp with both integral and external low to medium RF powered electromagnetic field to achieve excitation of a low pressure gas to generate a plasma.

The design of the components described above, assists in reducing the cost of lamp manufacture without compromising intrinsic induction lamp performance.

The embodiments described above enable manufacture of both linear and bulbular low pressure induction lamps on modified existing conventional lamp making machines, and allows automated simplification of low pressure induction lamp manufacture.

The embodiments of the invention will also allow self-ballasted low pressure induction lamps to be retrofitted in existing lamp sockets which previously used a self-ballasted lamp of either bulbular GLS incandescent, compact fluorescent, linear or bulbular LED or some other type of lamp. When replacing a lamp which previously used an external ballast, the previous ballast will be disconnected and replaced with a suitable low pressure induction lamp controller (ballast), or will be disconnected and replaced by a self-ballasted low pressure induction lamp.

Currently all low pressure induction lamps are physically large for their respective light or UV radiation output which makes these lamps unappealing for commercial and residential use. This relegates their application to low volume specialised use, and they are expensive to manufacture. It is expected that this will be reversed with the embodiments described above.

The embodiments described above enable miniaturisation of the key components of a low pressure induction lamp construction and thus achieves a smaller, lower cost light source without compromising the intrinsic induction lamp performance. This makes the lamps of the above embodiments more appealing to users and therefore potentially broadens applications, enabling larger market opportunities.

The lamps typical of 1000, 1100, 1200, 1300, 1400, 1500, 1600, 1600', 1600", 1700, and 1800 have a diverse performance range of the order of 2W extending to 2000W. This is supported by the electromagnet assembly geometry and the resultant electromagnetic field allowing greater surface area of electromagnetic field coupling within the excitation chamber. The geometry affords a compact excitation chamber for narrow profile tubular and bulbular lamps of narrow cross section. The geometry also effectively creates two toroidal electromagnetic field couplings while utilising only one field winding, thereby reducing power losses.

The lamps 1000, 1100, 1200, 1300, 1400, 1500, 1600, 1600', 1600", 1700 and 1800 are expected to be simpler, cheaper and faster to manufacturer than existing magnetic induction lamps using conventional lamp glass making machinery.

While the lamps 1600, 1600' and 1600" all show tubular bulbs which are round or square in shape, and other lamps have bulbs which are linear, it will be understood that the embodiments described above can be applied to bulbs of any shape, including rhomboid, triangular, hexagonal, ellipsoidal and many other shapes.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A bulb for an electrodeless radio frequency powered external closed core inductively coupled low pressure gas discharge electromagnetic radiation source, said bulb comprising an outer periphery adapted to be connected to an excitation chamber, said bulb including at least one tubular portion which defines a generally U-shaped flow path, said tubular portion having two sections, whereby said tubular portion in cross section has an apex whereby said apex on said two sections are oppositely facing each other.

2. The bulb as claimed in claim 1 wherein said two sections are not connected to each other along their length.

3. The bulb as claimed in claim 1 wherein said two sections are connected intermittently or continuously along their length.

4. The bulb as claimed in claim 1, wherein said bulb has two elongate tubular portions, where at an end opposite to said outer periphery said two tubular portions are in gas communication with each other.

5. The bulb as claimed in claim 4, wherein said two tubular portions are joined by a separate joining member to form a gas communicating passage between said two tubular portions.

6. The bulb as claimed in claim 1, wherein said outer periphery includes one or more mounting interfaces for connection to an excitation chamber assembly.

7. The bulb as claimed in claim 1, wherein said cross section of each tubular portion or section is a tear drop shape.

8. The bulb as claimed in claim 1, wherein said cross section of each tubular portion or section is of a triangular or square shape.

9. The bulb as claimed in claim 1, wherein said cross section of each tubular portion or section is a piriform shape.

10. The bulb as claimed in claim 1, wherein said cross section of each tubular portion or section has a cross section formed of two straight sides meeting to form an apex, and opposite the apex the straight sides are connected by a curved side.

11. The bulb as claimed in claim 1, wherein said at least one tubular portion is manufactured from a material which is transparent or translucent such as any of the following: glass; silica glass; quartz glass; a polymeric material; a composite material.

12. The bulb as claim in claim 1, wherein said at least one tubular portion is manufactured from a transparent or translucent material coated with graphene to enable a negative charged surface to be generated to attenuate generated radio frequencies emitted from a lamp made from said tubular bulb.

13. An electrodeless radio frequency powered external closed core inductively coupled low pressure gas discharge electromagnetic radiation source which includes a bulb as claimed in claim 1 assembled to an excitation chamber assembly, which source when powered produces visible frequencies of electromagnetic radiation.

* * * * *